US010224049B2

(12) United States Patent
Moriya et al.

(10) Patent No.: US 10,224,049 B2
(45) **Date of Patent: *Mar. 5, 2019**

(54) APPARATUSES AND METHODS FOR ENCODING AND DECODING A TIME-SERIES SOUND SIGNAL BY OBTAINING A PLURALITY OF CODES AND ENCODING AND DECODING DISTORTIONS CORRESPONDING TO THE CODES

(71) Applicants: NIPPON TELEGRAPH AND TELEPHONE CORPORATION, Chiyoda-ku (JP); The University of Tokyo, Bunkyo-ku (JP)

(72) Inventors: Takehiro Moriya, Atsugi (JP); Yutaka Kamamoto, Atsugi (JP); Noboru Harada, Atsugi (JP); Takahito Kawanishi, Atsugi (JP); Hirokazu Kameoka, Atsugi (JP); Ryosuke Sugiura, Bunkyo-ku (JP)

(73) Assignees: NIPPON TELEGRAPH AND TELEPHONE CORPORATION, Chiyoda-ku (JP); The University of Tokyo, Bunkyo-ku (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/544,465

(22) PCT Filed: Jan. 27, 2016

(86) PCT No.: PCT/JP2016/052365

§ 371 (c)(1),
(2) Date: Jul. 18, 2017

(87) PCT Pub. No.: WO2016/121826

PCT Pub. Date: Aug. 4, 2016

(65) Prior Publication Data

US 2018/0047401 A1 Feb. 15, 2018

(30) Foreign Application Priority Data

Apr. 13, 2015 (JP) ..... 2015-081770

(51) Int. Cl.

| | |
|---|---|
| ***G10L 19/06*** | (2013.01) |
| ***G10L 19/12*** | (2013.01) |
| ***G10L 19/22*** | (2013.01) |
| *G10L 19/002* | (2013.01) |
| *G10L 19/032* | (2013.01) |

(52) U.S. Cl.
CPC ..... *G10L 19/06* (2013.01); *G10L 19/12* (2013.01); *G10L 19/22* (2013.01); *G10L 19/002* (2013.01); *G10L 19/032* (2013.01)

(58) Field of Classification Search
USPC ..... 704/219, 229, 500
See application file for complete search history.

(56) References Cited

U.S. PATENT DOCUMENTS 7,031,912 B2 * 4/2006 Yajima ..... G10L 19/06 704/208
8,856,049 B2 * 10/2014 Vasilache ..... G10L 25/78 704/205

(Continued)

FOREIGN PATENT DOCUMENTS

EP 3 226 243 A1 10/2017
EP 3 270 376 A1 1/2018

OTHER PUBLICATIONS

International Search Report dated Mar. 15, 2016 in PCT/JP2016/052365 filed Jan. 27, 2016.

(Continued)

*Primary Examiner* — Shaun Roberts
(74) *Attorney, Agent, or Firm* — Oblon, McClelland, Maier & Neustadt, L.L.P.

(57) ABSTRACT

An encoding apparatus is an encoding apparatus for encoding a time-series signal for each of predetermined time sections in a frequency domain, wherein a parameter η is a (Continued)

positive number, the parameter η corresponding to a time-series signal is a shape parameter of generalized Gaussian distribution that approximates a histogram of a whitened spectral sequence, which is a sequence obtained by dividing a frequency domain sample sequence corresponding to the time-series signal by a spectral envelope estimated by regarding the η-th power of absolute values of the frequency domain sample sequence as a power spectrum, and any of a plurality of parameters η is selective or the parameter η is variable for each of the predetermined time sections; and the encoding apparatus comprises an encoding portion encoding the time-series signal for each of the predetermined time sections by an encoding process with a configuration identified at least based on the parameter η for each of the predetermined time sections.

15 Claims, 23 Drawing Sheets

(56) References Cited

U.S. PATENT DOCUMENTS

2002/0007269 A1* 1/2002 Gao ..... G10L 19/10 704/212
2003/0074192 A1* 4/2003 Choi ..... G01L 19/04 704/219
2013/0339012 A1* 12/2013 Kawashima ..... G10L 19/0208 704/219

OTHER PUBLICATIONS

Takehiro Moriya, "Essential Technology for High-Compression Voice Encoding: Line Spectrum Pair (LSP)" NTT Technical Journal, vol. 26, No. 9, Sep. 2014, 11 Pages (with corresponding English version).
Max Neuendorf, et al., "MPEG Unified Speech and Audio Coding—The ISO/MPEG Standard for High-Efficiency Audio Coding of all Content Types" Audio Engineering Society 132nd Convention, Apr. 2012, 22 Pages.
Extended European Search Report dated Aug. 7, 2018 in corresponding European Patent Application No. 16743429.9 citing documents AO, AP, AX and AY therein, 15 pages.
Ryosuke Sugiura et al., "Optimal Coding of Generalized-Gaussian-Distributed Frequency Spectra for Low-Delay Audio Coder with Powered All-Pole Spectrum Estimation", IEEE/ACM Transactions on Audio, Speech, and Language Processing, vol. 23, No. 8, XP011582768, Aug. 1, 2015, pp. 1309-1321.
Marie Oger et al., "Transform Audio Coding with Arithmetic-Coded Scalar Quantization and Model-Based Bit Allocation", International Conference on Acoustics, Speech, and Signal Processing, IEEE, XX, XP-002464925, Apr. 15, 2007, pp. IV-545-IV-548.

* cited by examiner

APPARATUSES AND METHODS FOR ENCODING AND DECODING A TIME-SERIES SOUND SIGNAL BY OBTAINING A PLURALITY OF CODES AND ENCODING AND DECODING DISTORTIONS CORRESPONDING TO THE CODES

TECHNICAL FIELD

The present invention relates to a technique for encoding or decoding a time-series signal such as a sound signal.

BACKGROUND ART

As a parameter indicating a characteristic of a time-series signal such as a sound signal, a parameter such as LSP is known (see, for example, Non-patent literature 1).

Since LSP consists of multiple values, there may be a case where it is difficult to use LSP directly for sound classification and section estimation. For example, since the LSP consists of multiple values, it is not easy to perform a process based on a threshold for which LSP is used.

By the way, a parameter η is proposed by the inventor though it is not publicly known. This parameter η is a shape parameter that defines probability distribution to which encoding targets of arithmetic codes belong, in an encoding system for performing arithmetic encoding of quantized values of coefficients in a frequency domain, which uses, for example, such a linear prediction envelope that is used in the 3GPP EVS (Enhanced Voice Services) standard. The parameter η has relevance to distribution of the encoding targets, and it is possible to perform efficient encoding and decoding by appropriately specifying the parameter η.

Further, the parameter η can be an indicator indicating a characteristic of a time-series signal. Therefore, it is conceivable to identify an appropriate configuration of an encoding process or a decoding process based on the parameter η and perform an encoding process or a decoding process with the identified configuration, though it is not publicly known.

PRIOR ART LITERATURE

Non-Patent Literature

[Non-patent literature 1] Takehiro Moriya "Essential Technology for High-Compression Voice Encoding: Line Spectrum Pair (LSP)", NTT Technical Journal, September 2014, pp. 58-60

SUMMARY OF THE INVENTION

Problems to be Solved by the Invention

However, a technique for identifying a configuration of an appropriate encoding process or decoding process based on a parameter η and performing the encoding process or decoding process with the identified configuration has not been known so far.

An object of the present invention is to provide an encoding apparatus and a decoding apparatus for identifying a configuration of an appropriate encoding process or decoding process based on a parameter η and performing the encoding process or decoding process with the identified configuration, and methods, programs and recording media for the encoding apparatus and the decoding apparatus.

Means to Solve the Problems

An encoding apparatus according to an aspect of the present invention is an encoding apparatus for encoding a time-series signal for each of predetermined time sections in a frequency domain, wherein a parameter η is a positive number, the parameter η corresponding to a time-series signal is a shape parameter of generalized Gaussian distribution that approximates a histogram of a whitened spectral sequence, which is a sequence obtained by dividing a frequency domain sample sequence corresponding to the time-series signal by a spectral envelope estimated by regarding the η-th power of absolute values of the frequency domain sample sequence as a power spectrum, and any of a plurality of parameters η is selective or the parameter η is variable for each of the predetermined time sections; and the encoding apparatus comprises an encoding portion encoding the time-series signal for each of the predetermined time sections by an encoding process with a configuration identified at least based on the parameter η for each of the predetermined time sections.

An encoding apparatus according to an aspect of the present invention is an encoding apparatus for encoding a time-series signal for each of predetermined time sections in a frequency domain, wherein a parameter η is a positive number, and any of a plurality of parameters η is selective or the parameter η is variable for each of the predetermined time sections; the encoding apparatus comprises an encoding portion encoding a frequency domain sample sequence corresponding to the time-series signal to obtain and output codes by an encoding process in which bit allocation is changed or bit allocation substantially changes based on values of the spectral envelope estimated by spectral envelope estimation regarding the η-th power of absolute values of the frequency domain sample sequence corresponding to the time-series signal as a power spectrum, for each of the predetermined time sections; and a parameter code indicating the parameter η corresponding to the outputted codes is outputted.

According to a decoding apparatus according to an aspect of the present invention, a parameter η is a positive number, and a parameter code indicating the parameter η is a code indicating a shape parameter of generalized Gaussian distribution that approximates a histogram of a whitened spectral sequence, which is a sequence obtained by dividing a frequency domain sample sequence corresponding to the parameter η by a spectral envelope estimated by regarding the η-th power of absolute values of the frequency domain sample sequence as a power spectrum; and the decoding apparatus is provided with: a parameter code decoding portion decoding the inputted parameter code to obtain the parameter η; an identifying portion identifying a configuration of a decoding process at least based on the obtained parameter η; and a decoding portion decoding inputted codes by the decoding process with the identified configuration.

A decoding apparatus according to an aspect of the present invention is a decoding apparatus obtaining a frequency domain sample sequence corresponding to a time-series signal by decoding in a frequency domain, the decoding apparatus provided with: a parameter code decoding portion decoding an inputted parameter code to obtain a parameter η; a linear prediction coefficient decoding portion obtaining coefficients transformable to linear prediction coefficients by decoding inputted linear prediction coefficient codes; an unsmoothed spectral envelope sequence generating portion obtaining an unsmoothed spectral envelope sequence, which is a sequence obtained by raising a sequence of an amplitude spectral envelope corresponding to the coefficients transformable to the linear prediction coefficients to the power of $1/\eta$, using the obtained parameter $\eta$; and a decoding portion obtaining the frequency domain sample sequence corresponding to the time-series sequence signal by decoding inputted integer signal codes in accordance with such bit allocation that changes or substantially changes based on the unsmoothed spectral envelope sequence.

Effects of the Invention

It is possible to identify a configuration of an appropriate encoding process or decoding process based on a parameter $\eta$ and perform the encoding process or decoding process with the identified configuration.

DETAILED DESCRIPTION OF THE EMBODIMENTS

[Technical Background]

As a method for encoding a sound signal with a low-bit rate (for example, about 10 kbit/s to 20 kbit/s), adaptive coding for an orthogonal transform coefficient in a frequency domain, such as DFT (Discrete Fourier Transform) and MDCT (Modified Discrete Cosine Transform), is known. For example, MPEG USAC (Unified Speech and Audio Coding), which is a standard technique, has a TCX (transform coded excitation) encoding mode, and, in this mode, MDCT coefficients are normalized for each frame and variable-length encoded after being quantized (see, for example, Reference literature 1).

<Reference literature 1>M. Neuendorf, et al., "MPEG Unified Speech and Audio Coding—The ISO/MPEG Standard for High-Efficiency Audio Coding of all Content Types", AES 132$^{nd}$ Convention, Budapest, Hungary, 2012.

Figure 1:
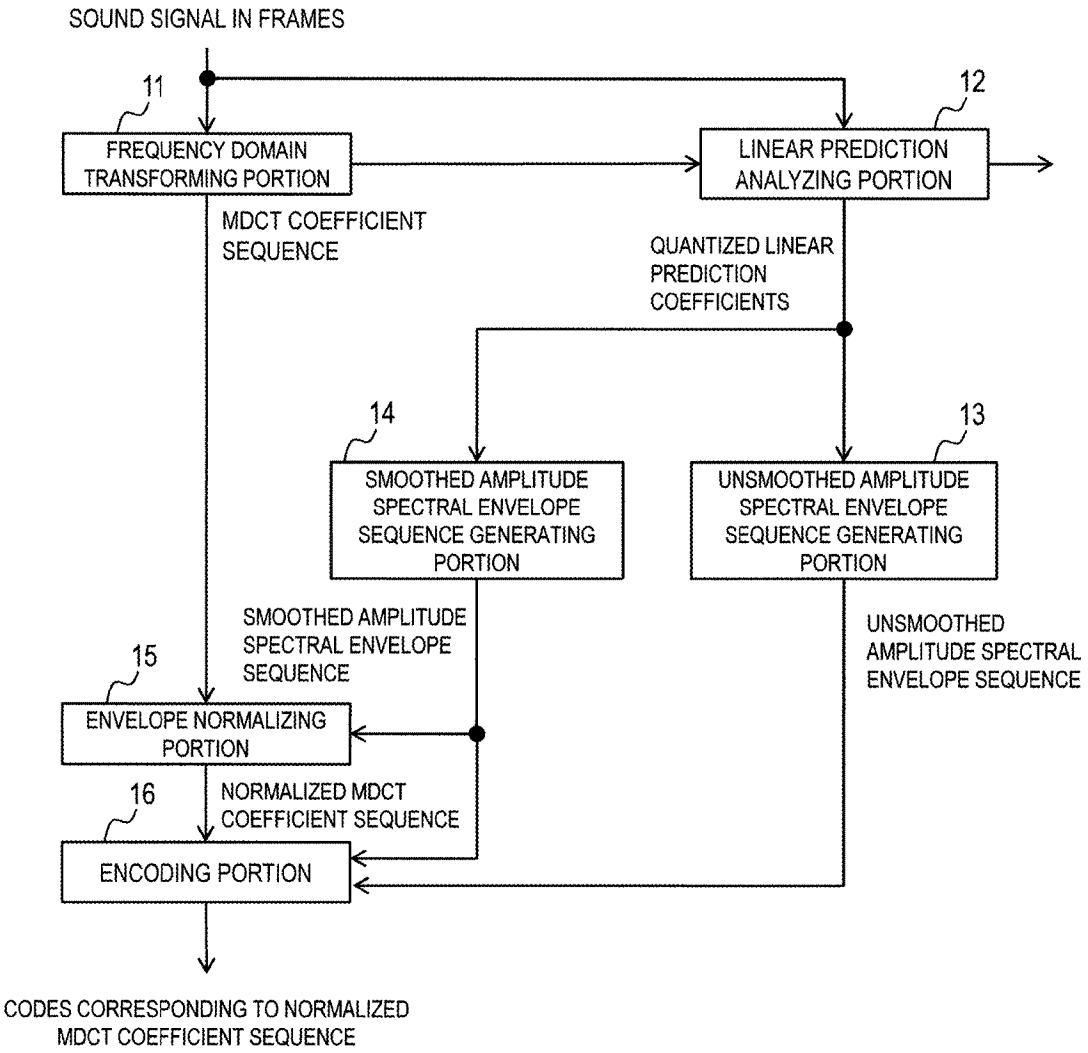
FIG. 1 is a block diagram for illustrating an example of a conventional encoding apparatus.

A configuration example of a conventional TCX-based encoding apparatus is shown in FIG. 1. Each portion in FIG. 1 will be described below.

<Frequency Domain Transforming Portion 11>

A sound signal, which is a time domain time-series signal, is inputted to the frequency domain transforming portion 11. The sound signal is, for example, a voice signal or an acoustic signal.

The frequency domain transforming portion 11 transforms the inputted time domain sound signal to an MDCT coefficient sequence X(0),X(1), . . . , X(N−1) at a point N in a frequency domain for each frame with a predetermined time length. Here, N is a positive integer.

The transformed MDCT coefficient sequence X(0), X(1), . . . , X(N−1) is outputted to the envelope normalizing portion 15.

<Linear Prediction Analyzing Portion 12>

A sound signal, which is a time-series signal in a time domain, is inputted to the linear prediction analyzing portion 12.

The linear prediction analyzing portion 12 generates linear prediction coefficients $\alpha_1,\alpha_2, \ldots, \alpha_p$ by performing linear prediction analysis for a sound signal inputted in frames. Further, the linear prediction analyzing portion 12 encodes the generated linear prediction coefficients $\alpha_1, \alpha_2, \ldots, \alpha_p$ to generate linear prediction codes. An example of the linear prediction coefficient codes are LSP codes, which are codes corresponding to a sequence of quantized values of an LSP (Line Spectrum Pairs) parameter sequence corresponding to the linear prediction coefficients $\alpha_1, \alpha_2, \ldots, \alpha_p$. Here, p is a positive integer equal to or larger than 2.

Further, the linear prediction analyzing portion 12 generates quantized linear prediction coefficients $\hat{\alpha}_1,\hat{\alpha}_2, \ldots, \hat{\alpha}_p$ which are linear prediction coefficients corresponding to the generated linear prediction coefficient codes.

The generated quantized linear prediction coefficients $\hat{\alpha}_1,\hat{\alpha}_2, \ldots, \hat{\alpha}_p$ are outputted to the smoothed amplitude spectral envelope sequence generating portion 14 and the unsmoothed amplitude spectral envelope sequence generating portion 13. Further, the generated linear prediction coefficient codes are outputted to a decoding apparatus.

For the linear prediction analysis, for example, a method is used in which linear prediction coefficients are obtained by determining autocorrelation for the sound signal inputted in frames and performing a Levinson-Durbin algorithm using the determined autocorrelation. Otherwise, a method may be used in which linear prediction coefficients are obtained by inputting an MDCT coefficient sequence determined by the frequency domain transforming portion 11 to the linear prediction analyzing portion 12 and performing the Levinson-Durbin algorithm for what is obtained by performing inverse Fourier transform of a sequence of square values of coefficients of the MDCT coefficient sequence.

<Smoothed Amplitude Spectral Envelope Sequence Generating Portion 14>

The quantized linear prediction coefficients $\hat{\alpha}_1, \hat{\alpha}_2, \ldots, \hat{\alpha}_p$ generated by the linear prediction analyzing portion 12 are inputted to the smoothed amplitude spectral envelope sequence generating portion 14.

The smoothed amplitude spectral envelope sequence generating portion 14 generates a smoothed amplitude spectral envelope sequence $\hat{W}_\gamma(\mathbf{0}), \hat{W}_\gamma(\mathbf{1}), \ldots, \hat{W}_\gamma(N-1)$ defined by the following expression (B1) using the quantized linear prediction coefficients $\hat{\alpha}_1, \hat{\alpha}_2, \ldots, \hat{\alpha}_p$. In the expression (1), exp(•) indicates an exponential function with a Napier's constant as a base on the assumption that • is a real number, and j indicates an imaginary unit. Further, γ is a positive constant equal to or smaller than 1 and is a coefficient which reduces amplitude unevenness of an amplitude spectral envelope sequence $\hat{W}(\mathbf{0}), \hat{W}(\mathbf{1}), \ldots, \hat{W}(N-1)$ defined by the following expression (B2), in other words, a coefficient which smoothes the amplitude spectral envelope sequence.

[Expression 1]

$$\hat{W}_\gamma(k) = \frac{1}{\sqrt{2\pi}} \frac{1}{\left|1 + \sum_{n=1}^{p} \hat{\alpha}_n \gamma^n \exp(-j2\pi kn/N)\right|} \tag{B1}$$

$$\hat{W}(k) = \frac{1}{\sqrt{2\pi}} \frac{1}{\left|1 + \sum_{n=1}^{p} \hat{\alpha}_n \exp(-j2\pi kn/N)\right|} \tag{B2}$$

The generated smoothed amplitude spectral envelope sequence $\hat{W}_\gamma(\mathbf{0}), \hat{W}_\gamma(\mathbf{1}), \ldots, \hat{W}_\gamma(N-1)$ is outputted to the envelope normalizing portion 15 and a variance parameter determining portion 163 of the encoding portion 16.

<Unsmoothed Amplitude Spectral Envelope Sequence Generating Portion 13>

The quantized linear prediction coefficients $\hat{\alpha}_1, \hat{\alpha}_2, \ldots, \hat{\alpha}_p$ generated by the linear prediction analyzing portion 12 are inputted to the unsmoothed amplitude spectral envelope sequence generating portion 13.

The unsmoothed amplitude spectral envelope sequence generating portion 13 generates an unsmoothed amplitude spectral envelope sequence $\hat{W}(\mathbf{0}), \hat{W}(\mathbf{1}), \ldots, \hat{W}(N-1)$ defined by the above expression (B2) using the quantized linear prediction coefficients $\hat{\alpha}_1, \hat{\alpha}_2, \ldots, \hat{\alpha}_p$.

The generated unsmoothed amplitude spectral envelope sequence $\hat{W}(\mathbf{0}), \hat{W}(\mathbf{1}), \ldots, \hat{W}(N-1)$ is outputted to the variance parameter determining portion 163 of the encoding portion 16.

<Envelope Normalizing Portion 15>

The MDCT coefficient sequence $X(\mathbf{0}), X(\mathbf{1}), \ldots, X(N-1)$ generated by the frequency domain transforming portion 11 and the smoothed amplitude spectral envelope sequence $\hat{W}_\gamma(\mathbf{0}), \hat{W}_\gamma(\mathbf{1}), \ldots, \hat{W}_\gamma(N-1)$ outputted by the unsmoothed amplitude spectral envelope sequence generating portion 14 are inputted to the envelope normalizing portion 15.

The envelope normalizing portion 15 generates a normalized MDCT coefficient sequence $X_N(\mathbf{0}), X_N(\mathbf{1}), \ldots, X_N(N-1)$ by normalizing each coefficient X(k) of the MDCT coefficient sequence by a corresponding value $\hat{W}_\gamma(k)$ of the smoothed amplitude spectral envelope sequence. That is, $X_N(k) = X(k)/\hat{W}_\gamma(k)$ [k=0, 1, . . . ,N−1] is satisfied.

The generated normalized MDCT coefficient sequence $X_N(\mathbf{0}), X_N(\mathbf{1}), \ldots, X_N(N-1)$ is outputted to the encoding portion 16.

Here, in order to realize such quantization that auditory distortion is reduced, the envelope normalizing portion 15 normalizes the MDCT coefficient sequence $X(\mathbf{0}), X(\mathbf{1}), \ldots, X(N-1)$ in frames, using the smoothed amplitude spectral envelope sequence $\hat{W}_\gamma(\mathbf{0}), \hat{W}_\gamma(\mathbf{1}), \ldots, \hat{W}_\gamma(N-1)$, which is a sequence obtained by smoothing an amplitude spectral envelope.

<Encoding Portion 16>

The normalized MDCT coefficient sequence $X_N(\mathbf{0}), X_N(\mathbf{1}), \ldots, X_N(N-1)$ generated by the envelope normalizing portion 15, the smoothed amplitude spectral envelop sequence $\hat{W}_\gamma(\mathbf{0}), \hat{W}_\gamma(\mathbf{1}), \ldots, \hat{W}_\gamma(N-1)$ outputted by the smoothed amplitude spectral envelope sequence generating portion 14 and the unsmoothed amplitude spectral envelope sequence $\hat{W}(\mathbf{0}), \hat{W}(\mathbf{1}), \ldots, \hat{W}(N-1)$ outputted by the unsmoothed amplitude spectral envelope sequence generating portion 13 are inputted to the encoding portion 16.

The encoding portion 16 generates codes corresponding to the normalized MDCT coefficient sequence $X_N(\mathbf{0}), X_N(\mathbf{1}), \ldots, X_N(N-1)$.

The generated codes corresponding to the normalized MDCT coefficient sequence $X_N(\mathbf{0}), X_N(\mathbf{1}), \ldots, X_N(N-1)$ are outputted to the decoding apparatus.

Coefficients of the normalized MDCT coefficient sequence $X_N(\mathbf{0}), X_N(\mathbf{1}), \ldots, X_N(N-1)$ are divided by a gain (global gain) g, and codes obtained by encoding a quantized normalized coefficient sequence $X_Q(\mathbf{0}), X_Q(\mathbf{1}), \ldots, X_Q(N-1)$, which is a sequence of integer values obtained by quantizing results of the division, are caused to be integer signal codes. In a technique of Non-patent Literature 1, the encoding portion 16 decides such a gain g that the number of bits of the integer signal codes is equal to or smaller than the number of allocated bits B, which is the number of bits allocated in advance, and is as large as possible. Then, the encoding portion 16 generates a gain code corresponding to the determined gain g and an integer signal code corresponding to the determined gain g.

The generated gain code and integer signal codes are outputted to the decoding apparatus as codes corresponding to the normalized MDCT coefficient sequence $X_N(\mathbf{0}), X_N(\mathbf{1}), \ldots, X_N(N-1)$.

[Specific Example of Encoding Process Performed by Encoding Portion 16]

A specific example of the encoding process performed by the encoding portion 16 will be described.

Figure 2:
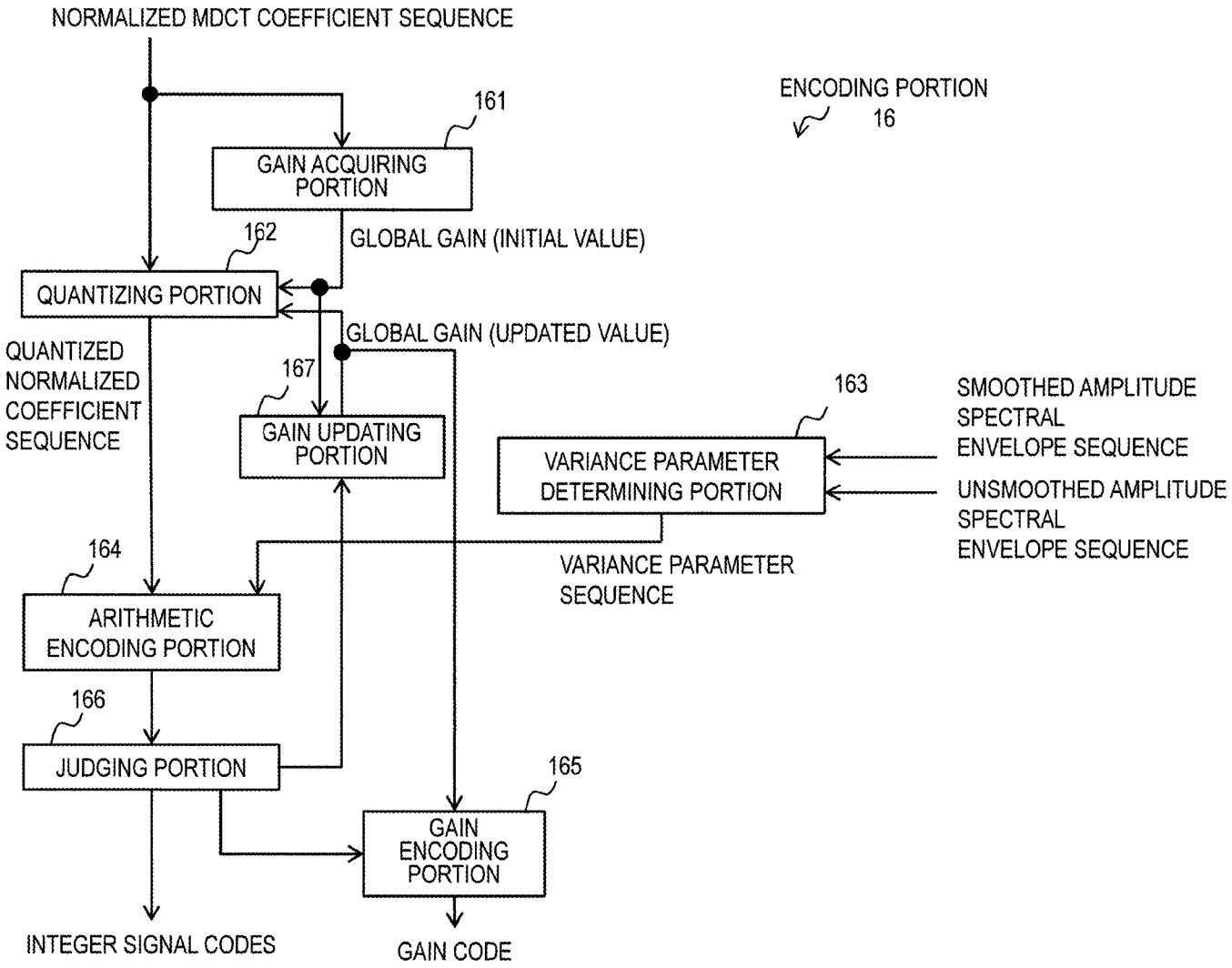
FIG. 2 is a block diagram for illustrating an example of a conventional encoding portion.

A configuration example of the specific example of the encoding portion 16 is shown in FIG. 2. As shown in FIG. 2, the encoding portion 16 is, for example, provided with a gain acquiring portion 161, a quantizing portion 162, a variance parameter determining portion 168, an arithmetic encoding portion 169, a gain encoding portion 165, a judging portion 166 and a gain updating portion 167. Each portion in FIG. 2 will be described below.

<Gain Acquiring Portion 161>

The gain acquiring portion 161 decides such a global gain g that the number of bits of integer signal codes is equal to or smaller than the number of allocated bits B, which is the number of bits allocated in advance, and is as large as possible from an inputted normalized MDCT coefficient sequence $X_N(\mathbf{0}), X_N(\mathbf{1}), \ldots, X_N(N-1)$ and outputs the global gain g. The global gain g obtained by the gain acquiring portion 161 becomes an initial value of a global gain used by the quantizing portion 162.

<Quantizing Portion 162>

The quantizing portion 162 obtains and outputs a quantized normalized coefficient sequence $X_Q(0),X_Q(1),\ldots,X_Q(N-1)$, which is a sequence constituted by integer parts of a result of dividing each coefficient of the inputted normalized MDCT coefficient sequence $X_N(0),X_N(1),\ldots,X_N(N-1)$ by the global gain g obtained by the gain acquiring portion 161 or the gain updating portion 167.

Here, a global gain g used when the quantizing portion 162 is executed for the first time is a global gain g obtained by the gain acquiring portion 161, that is, an initial value of the global gain. Further, a global gain g used when the quantizing portion 162 is executed at and after the second time is a global gain g obtained by the gain updating portion 167, that is, an updated value of the global gain.

<Variance Parameter Determining Portion 163>

The variance parameter determining portion 163 obtains and outputs variance parameters $\varphi(0),\varphi(1),\ldots,\varphi(N-1)$ each of which corresponds to each frequency by an expression (B3) below from the inputted unsmoothed amplitude spectral envelope sequence $\hat{W}(0),\hat{W}(1),\ldots,\hat{W}(N-1)$ and the inputted smoothed amplitude spectral envelope sequence $\hat{W}_\gamma(0),\hat{W}_\gamma(1),\ldots,\hat{W}_\gamma(N-1)$.

[Expression 2]

$$\phi(k)=\frac{\hat{W}(k)}{\hat{W}_\gamma(k)},\ (k=0,\ldots,N-1) \tag{B3}$$

<Arithmetic Encoding Portion 164>

The arithmetic encoding portion 164 performs arithmetic encoding of the quantized normalized coefficient sequence $X_Q(0),X_Q(1),\ldots,X_Q(N-1)$ obtained by the quantizing portion 162, using the variance parameters $\varphi(0),\varphi(1),\ldots,\varphi(N-1)$ obtained by the variance parameter determining portion 163, to obtain integer signal codes, and outputs the integer signal codes and the number of consumed bits C, which is the number of bits of the integer signal codes. As for the arithmetic coding, such bit allocation that the quantized normalized coefficient sequence for each frequency k (=0, . . . ,N−1) becomes optimal when being in accordance with a Laplace distribution, for example, indicated by an expression below for a random variable X below is performed.

[Expression 3]

$$f_L(X\mid\phi(k))=\frac{1}{2\phi(k)}\exp\left(-\frac{|X|}{\phi(k)}\right)$$

<Judging Portion 166>

When the number of times of updating the gain is a predetermined number of times, the judging portion 166 outputs the integer signal codes as well as outputting an instruction signal to encode the global gain g obtained by the gain updating portion 167 to the gain encoding portion 165. When the number of times of updating the gain is smaller than the predetermined number of times, the judging portion 166 outputs the number of consumed bits C measured by the arithmetic encoding portion 164 to the gain updating portion 167.

<Gain Updating Portion 167>

When the number of consumed bits C measured by the arithmetic encoding portion 164 is larger than the number of allocated bits B, the gain updating portion 167 updates the value of the global gain g to be a larger value and outputs the value. When the number of consumed bits C is smaller than the number of allocated bits B, the gain updating portion 167 updates the value of the global gain g to be a smaller value and outputs the updated value of the global gain g.

<Gain Encoding Portion 165>

The gain encoding portion 165 encodes the global gain g obtained by the gain updating portion 167 to obtain and output a gain code in accordance with an instruction signal outputted by the judging portion 166.

The integer signal codes outputted by the judging portion 166 and the gain code outputted by the gain encoding portion 165 are outputted to the decoding apparatus as codes corresponding to the normalized MDCT coefficient sequence.

As described above, in the conventional TCX-based encoding, an MDCT coefficient sequence is normalized with the use of a smoothed amplitude spectral envelope sequence obtained by smoothing an unsmoothed amplitude spectral envelope, and, after that, the normalized MDCT coefficient sequence is encoded. This encoding method is adopted in the MPEG-4 USAC described above and the like.

In a conventional encoding apparatus, optimal bit allocation is performed for Laplace distribution by arithmetic coding, and, in order to use unevenness information about a spectral envelope at the time of arithmetic encoding, variance parameters corresponding to variance of the above Laplace distribution are generated from values of an envelope. However, since probability distributions to which encoding targets belong are diverse, the encoding targets are not necessarily in accordance with the Laplace distribution. Thus, if similar bit allocation is performed for an encoding target belonging to distribution departing from an assumption, there is a possibility that compression efficiency decreases. Further, at the time of introducing different distribution, it is difficult to improve efficiency without generating variance parameters for the distribution and correctly incorporating unevenness information about a spectral envelope similarly to the conventional encoding apparatus.

By the way, normalization of an MDCT sequence $X(0),X(1),\ldots,X(N-1)$ by a smoothed amplitude spectral envelope whitens the MDCT sequence $X(0),X(1),\ldots,X(N-1)$ less than normalization by an unsmoothed amplitude spectral envelope sequence. Specifically, unevenness of a normalized MDCT coefficient sequence $X_N(0)=X(0)/\hat{W}_\gamma(0),X_N(1)=X(1)/\hat{W}_\gamma(1),\ldots,X_N(N-1)=X(N-1)/\hat{W}_\gamma(N-1)$, which is obtained by normalizing the MDCT coefficient sequence $X(0),X(1),\ldots,X(N-1)$ by the smoothed amplitude spectral envelope sequence $\hat{W}_\gamma(0),\hat{W}_\gamma(1),\ldots,\hat{W}_\gamma(N-1)$, is larger than unevenness of a normalized sequence $X(0)/\hat{W}(0),X(1)/\hat{W}(1),\ldots,X(N-1)/\hat{W}(N-1)$, which is obtained by normalizing the MDCT coefficient sequence $X(0),X(1),\ldots,X(N-1)$ by the unsmoothed amplitude spectral envelope sequence $\hat{W}(0),\hat{W}(1),\ldots,\hat{W}(N-1)$, by $\hat{W}(0)/\hat{W}_\gamma(0),\hat{W}(1)/\hat{W}_\gamma(1),\ldots,\hat{W}(N-1)/\hat{W}_\gamma(N-1)$. Therefore, when it is assumed that the normalized sequence $X(0)/\hat{W}(0),X(1)/\hat{W}(1),\ldots,X(N-1)/\hat{W}(N-1)$, which is obtained by normalizing the MDCT coefficient sequence $X(0),X(1),\ldots,X(N-1)$ by the unsmoothed amplitude spectral envelope sequence $\hat{W}(0),\hat{W}(1),\ldots,\hat{W}(N-1)$, is such that envelope unevenness has been smoothed to an extent suitable for encoding by the encoding portion 16, the normalized MDCT coefficient sequence $X_N(0),X_N$ (1), . . . ,$X_N$(N−1) to be inputted to the encoding portion 16 has envelope unevenness indicated by a sequence of ˆW(0)/ˆ$W_\gamma$(0),ˆW(1)/ˆ$W_\gamma$(1), . . . ,ˆW(N−1)/ˆ$W_\gamma$(N−1) (hereinafter referred to as a normalized amplitude spectral envelope sequence ˆ$W_N$(0),ˆ$W_N$(1), . . . ,ˆ$W_N$(N−1)) that is left.

Figure 16:
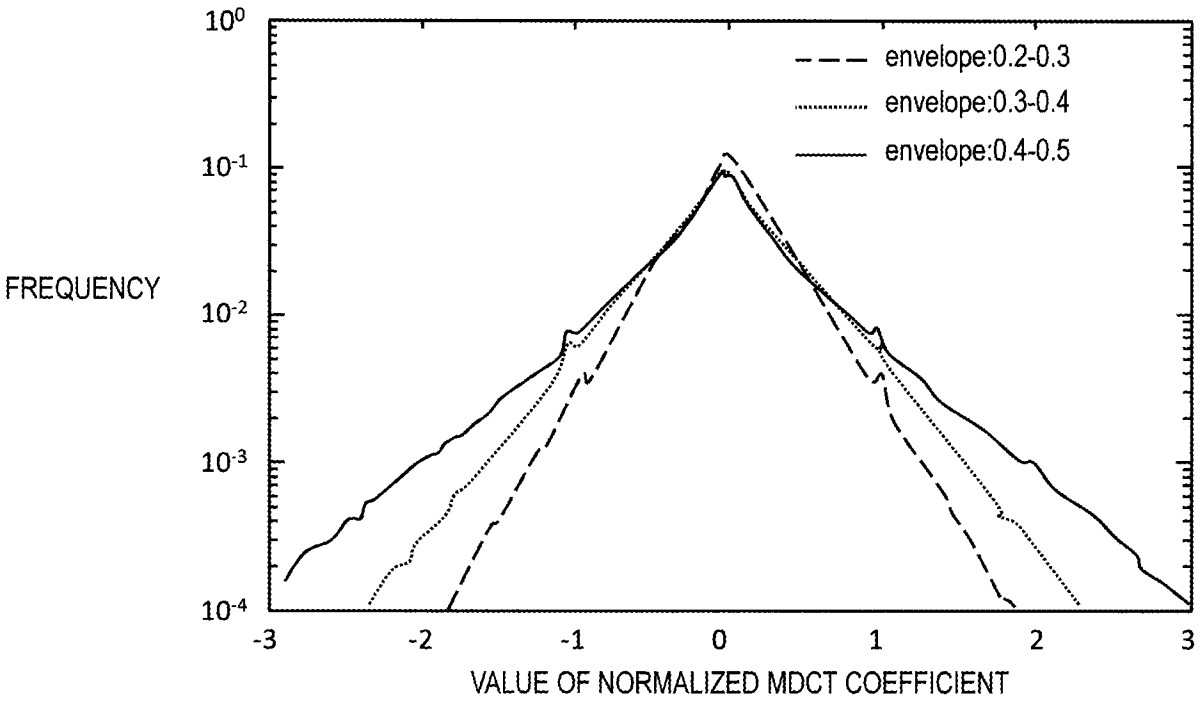
FIG. 16 is a histogram for illustrating a technical background.

FIG. 16 shows an appearance frequency of a value of each coefficient included in the normalized MDCT coefficient sequence when the envelope unevenness ˆW(0)/ˆ$W_\gamma$(0),ˆW(1)/ˆ$W_\gamma$(1), . . . ,ˆW(N−1)/ˆ$W_\gamma$(N−1) of the normalized MDCT sequence takes each value. A curve of envelope: 0.2-0.3 indicates a frequency of a value of a normalized MDCT coefficient $X_N$(k) corresponding to such a sample k that envelope unevenness ˆW(k)/ˆ$W_\gamma$(k) of the normalized MDCT sequence is equal to or larger than 0.2 and smaller than 0.3. A curve of envelope: 0.3-0.4 indicates a frequency of a value of the normalized MDCT coefficient $X_N$(k) corresponding to such a sample k that the envelope unevenness ˆW(k)/ˆ$W_\gamma$(k) of the normalized MDCT sequence is equal to or larger than 0.3 and smaller 0.4. A curve of envelope: 0.4-0.5 indicates a frequency of a value of the normalized MDCT coefficient $X_N$(k) corresponding to such a sample k that the envelope unevenness ˆW(k)/ˆ$W_\gamma$(k) of the normalized MDCT sequence is equal to or larger than 0.4 and smaller than 0.5.

It is seen from FIG. 16 that, though an average of values of coefficients included in the normalized MDCT coefficient sequence is almost zero, variance of the values is relevant to envelope values. That is, the larger the envelope unevenness of the normalized MDCT sequence is, the longer the foot of a curve indicating a frequency is. Therefore, it is seen that there is a relevance that, the larger the envelope unevenness is, the larger the variance of the normalized MDCT coefficient is. In order to realize more efficient compression, encoding utilizing this relevance is performed. Specifically, for each coefficient of a frequency domain coefficient sequence targeted by encoding, such encoding is performed that changes bit assignment or that bit assignment substantially changes based on a spectral envelope.

Thus, for example, in a case of performing arithmetic encoding of a quantized normalized coefficient sequence $X_Q$(0),$X_Q$(1), . . . ,$X_Q$(N−1), variance parameters determined based on a spectral envelope are used.

Further, since probability distributions to which encoding targets belong are diverse, there is a possibility that, when optimal bit assignment on the assumption of an encoding target belonging to certain probability distribution (for example, Laplace distribution) is performed for an encoding target belonging to probability distribution departing from the assumption, compression efficiency decreases.

Therefore, as probability distribution to which encoding targets belong, generalized Gaussian distribution represented by the following expression, which is distribution capable of expressing various probability distributions, is used.

[Expression 4]

$$f_{GG}(X \mid \phi, \eta) = \frac{A(\eta)}{\phi}\exp\left(-\left|B(\eta)\frac{X}{\phi}\right|^{\eta}\right),$$

$$A(\eta) = \frac{\eta B(\eta)}{2\Gamma(1/\eta)},$$

$$B(\eta) = \sqrt{\frac{\Gamma(3/\eta)}{\Gamma(1/\eta)}},$$

$$\Gamma(x) = \int_0^\infty e^{-t}t^{x-1}\,dt$$

Figure 3:
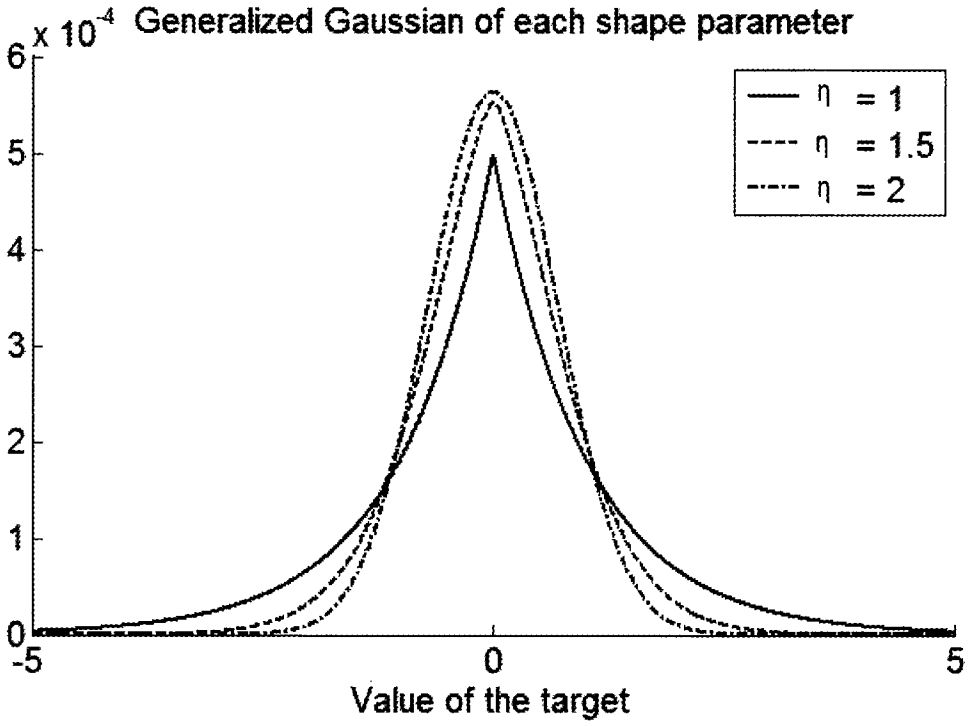
FIG. 3 is a diagram for illustrating generalized Gaussian distribution.

By changing a parameter η (>0), which is a shape parameter, the generalized Gaussian distribution can express various distributions, for example, Laplace distribution at the time of η=1 and Gaussian distribution at the time of η=2 as shown in FIG. 3. Here, η is a predetermined number larger than 0. The value of η may be determined in advance or may be selected or variable for each frame, which is a predetermined time section. Further, φ in the above expression is a value corresponding to variance of distribution. Information about unevenness of a spectral envelope is incorporated with this value as a variance parameter. That is, variance parameters φ(0),φ(1), . . . ,φ(N−1) are generated from a spectral envelope; for a quantized normalized coefficient $X_Q$(k) at each frequency k, such an arithmetic code that becomes optimal when being in accordance with $f_{GG}$(X|φ(k),η) is configured; and encoding is performed with the arithmetic codes based on this configuration.

For example, distribution information to be used is further adopted in addition to information about predictive residual energy $\sigma^2$ and the global gain g, and a variance parameter for each coefficient of the quantized normalized coefficient sequence $X_Q$(0),$X_Q$(1), . . . ,$X_Q$(N−1) is calculated, for example, by the following expression (A1).

[Expression 5]

$$\phi(k) = \eta^{1/\eta}B(\eta)\hat{H}_N(k)\frac{\sigma^{2/\eta}}{g} \tag{A1}$$

Here, σ is a square root of $\sigma^2$.

Specifically, the Levinson-Durbin algorithm is performed for what is obtained by performing inverse Fourier transform for a sequence of values obtained by raising absolute values of MDCT coefficients to the power of η; and, using ˆ$\beta_1$,ˆ$\beta_2$, . . . ,ˆ$\beta_p$, which are obtained by quantizing linear prediction coefficients obtained thereby, instead of the quantized linear prediction coefficients ˆ$\alpha_1$,ˆ$\alpha_2$, . . . ,ˆ$\alpha_p$, the unsmoothed amplitude spectral envelope sequence ˆH(0),ˆH(1), . . . ,ˆH(N−1) and the smoothed amplitude spectral envelope sequence ˆ$H_\gamma$(0),ˆ$H_\gamma$(1), . . . ,ˆ$H_\gamma$(N−1) are determined from the following expressions (A2) and (A3), respectively.

[Expression 6]

$$\hat{H}(k) = \left(\frac{1}{2\pi}\frac{1}{\left|1+\sum_{n=1}^{p}\hat{\beta}_n\exp(-j2\pi kn/N)\right|^2}\right)^{1/\eta} \tag{A2}$$

$$\hat{H}_\gamma(k) = \left(\frac{1}{2\pi}\frac{1}{\left|1+\sum_{n=1}^{p}\hat{\beta}_n\gamma^n\exp(-j2\pi kn/N)\right|^2}\right)^{1/\eta} \tag{A3}$$

By dividing each of coefficients of the determined unsmoothed amplitude spectral envelope sequence ˆH(0),ˆH(1), . . . ,ˆH(N−1) by a corresponding coefficient of the smoothed amplitude spectral envelope sequence ˆ$H_\gamma$(0),ˆ$H_\gamma$(1), . . . ,ˆ$H_\gamma$(N−1), to obtain a normalized amplitude spectral envelope sequence ˆ$H_N$(0)=ˆH(0)/ˆ$H_\gamma$(0),ˆ$H_N$(1)=ˆH(1)/ˆ$H_\gamma$(1), . . . ,ˆ$H_N$(N−1)=ˆH(N−1)/ˆ$H_\gamma$(N−1). From the normalized amplitude spectral envelope sequence and the global gain g, variance parameters are calculated with the above expression (A1).

Here, $\sigma^{2/\eta}/g$ in the expression (A1) is a value closely related with entropy, and fluctuation of the value for each frame is small when a bit rate is fixed. Therefore, it is possible to use a predetermined fixed value as $\sigma^{2/\eta}/g$. In the case of using a fixed value as described above, it is not necessary to newly add information for the method of the present invention.

The above technique is based on a minimization problem based on a code length at the time of performing arithmetic encoding of the quantized normalized coefficient sequence $X_Q(\mathbf{0}), X_Q(\mathbf{1}), \ldots, X_Q(N-1)$. Derivation of the above technique will be described below.

When it is assumed that quantization has been performed sufficiently in detail, a code length at the time of encoding each quantized normalized coefficient $X_Q(k)$ with an arithmetic code using generalized Gaussian distribution of the shape parameter $\eta$ by a corresponding variance parameter $\varphi(k)$ is in proportion to the following expression (A4).

[Expression 7]

$$L = \sum_{k=0}^{N-1} -\log_2 f_{GG}(X_Q(k) \mid \phi(k), \eta) \tag{A4}$$

Consideration will be made on determining the variance parameter sequence $\varphi(\mathbf{0}), \varphi(\mathbf{1}), \ldots, \varphi(N-1)$ based on linear prediction coefficients which have been already quantized and encoded, in order to reduce the code length. The above expression (A4) can be rewritten as below by performing expression transformation.

[Expression 8]

$$\begin{aligned} L &= (\log_2 e)\sum_{k=0}^{N-1}\left[\left|\frac{B(\eta)X_Q(k)}{\phi(k)}\right|^{\eta} + \ln\phi(k) - \ln A(\eta)\right] \\ &= (\log_2 e)\sum_{k=0}^{N-1}\left[\begin{array}{c}\frac{1}{\eta}\left(\frac{|X_Q(k)|^{\eta}}{\phi^{\eta}(k)/(\eta B^{\eta}(\eta))} - \ln\frac{|X_Q(k)|^{\eta}}{\phi^{\eta}(k)/(\eta B^{\eta}(\eta))} - 1\right) + \\ \frac{1}{\eta}\ln\eta B^{\eta}(\eta) + \ln|X_Q(k)|^{\eta} + \frac{1}{\eta} - \ln A(\eta)\end{array}\right] \\ &= \frac{1}{\eta\ln 2}\sum_{k=0}^{N-1} D_{IS}\left(\frac{\phi^{\eta}(k)}{\eta B^{\eta}(\eta)}\,\middle|\,|X_Q(k)|^{\eta}\right) + C \end{aligned} \tag{A5}$$

It is assumed that ln indicates a logarithm with a Napier's constant as a base, C indicates a constant for the variance parameters, and $D_{IS}(X|Y)$ indicates an Itakura Saito distance of X from Y.

[Expression 9]

$$D_{IS}(X \mid Y) = \frac{Y}{X} - \ln\frac{Y}{X} - 1$$

That is, the minimization problem of a code length L for a variance parameter sequence comes down to a minimization problem of a sum total of Itakura Saito distances between $\varphi^{\eta}(k)/(\eta B^{\eta}(\eta))$ and $|X_Q(k)|^{\eta}$. It is possible to make an optimization problem for determining linear prediction coefficients for minimizing a code length if one of correspondence relationships between the variance parameter sequence $\varphi(\mathbf{0}), \varphi(\mathbf{1}), \ldots, \varphi(N-1)$ and the linear prediction coefficients $\beta_1, \beta_2, \ldots, \beta_p$ and between the variance parameter sequence $\varphi(\mathbf{0}), \varphi(\mathbf{1}), \ldots, \varphi(N-1)$ and the predictive residual energy $\sigma^2$ is determined. Here, association will be made as shown below in order to use a conventional faster method.

[Expression 10]

$$\phi(k) = \frac{1}{g\hat{H}_{\gamma}(k)}\cdot\left(\frac{\eta B^{\eta}(\alpha)\sigma^2/(2\pi)}{\left|1 + \sum_{n=1}^{p}\beta_n \exp(-j2\pi kn/N)\right|^2}\right)^{1/\eta} \tag{A6}$$

When influence of quantization is ignored, each quantized normalized coefficient sequence $X_Q(\mathbf{0}), X_Q(\mathbf{1}), \ldots, X_Q(N-1)$ can be represented as $X_Q(k)=X(k)/(g\hat{H}_{\gamma}(k))$ with the use of the MDCT sequence $X(\mathbf{0}), X(\mathbf{1}), \ldots, X(N-1)$, the smoothed amplitude spectral envelope $\hat{H}_{\gamma}(\mathbf{0}), \hat{H}_{\gamma}(\mathbf{1}), \ldots, \hat{H}_{\gamma}(N-1)$ and the global gain g. Therefore, a term depending on the variance parameters in the expression (A5) is represented as Itakura Saito distance between absolute values of an MDCT coefficient sequence and an all-pole spectral envelope by the expression (A6).

[Expression 11]

$$\begin{aligned} &\frac{1}{\eta\ln 2}\sum_{k=0}^{N-1} D_{IS}\left(\frac{\phi^{\eta}(k)}{\eta B^{\eta}(\eta)}\,\middle|\,|X_Q(k)|^{\eta}\right) = \\ &\frac{1}{\eta\ln 2}\sum_{k=0}^{N-1} D_{IS}\left(\left(\frac{1}{g\hat{H}_{\gamma}(k)}\right)^{\eta}\cdot\frac{\sigma^2/(2\pi)}{\left|1 + \sum_{n=1}^{p}\beta_n \exp(-j2\pi kn/N)\right|^2}\,\middle|\,\frac{|X(k)|^{\eta}}{(g\hat{H}_{\gamma}(k))^{\eta}}\right) = \\ &\frac{1}{\eta\ln 2}\sum_{k=0}^{N-1} D_{IS}\left(\frac{\sigma^2}{2\pi}\frac{1}{\left|1 + \sum_{n=1}^{p}\beta_n \exp(-j2\pi kn/N)\right|^2}\,\middle|\,|X(k)|^{\eta}\right) \end{aligned}$$

Conventional linear prediction analysis, that is, analysis in which the Levinson-Durbin algorithm is applied to what is obtained by performing inverse Fourier transform for a power spectrum is known as an operation of determining linear prediction coefficients minimizing Itakura Saito distances between the power spectrum and an all-pole spectral envelope. Therefore, as for the code length minimization problem described above, an optimal solution can be determined by applying the Levinson-Durbin algorithm to an amplitude spectrum raised to the power of $\eta$, that is, what is obtained by performing inverse Fourier transform for the $\eta$-th power of absolute values of an MDCT coefficient sequence, similarly to the conventional method.

[First Embodiment]

(Encoding)

Figure 4:
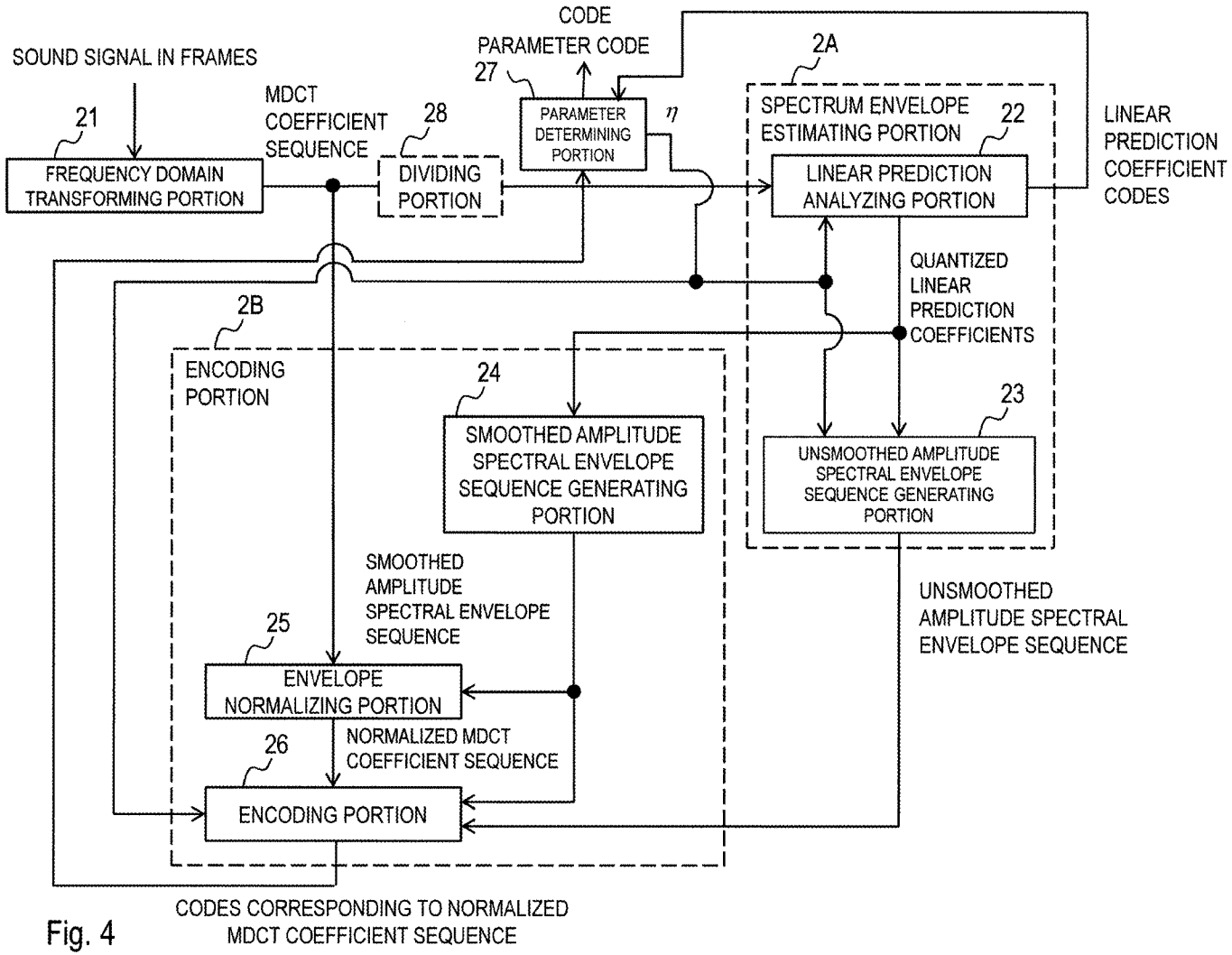
FIG. 4 is a block diagram for illustrating an example of an encoding apparatus.
Figure 5:
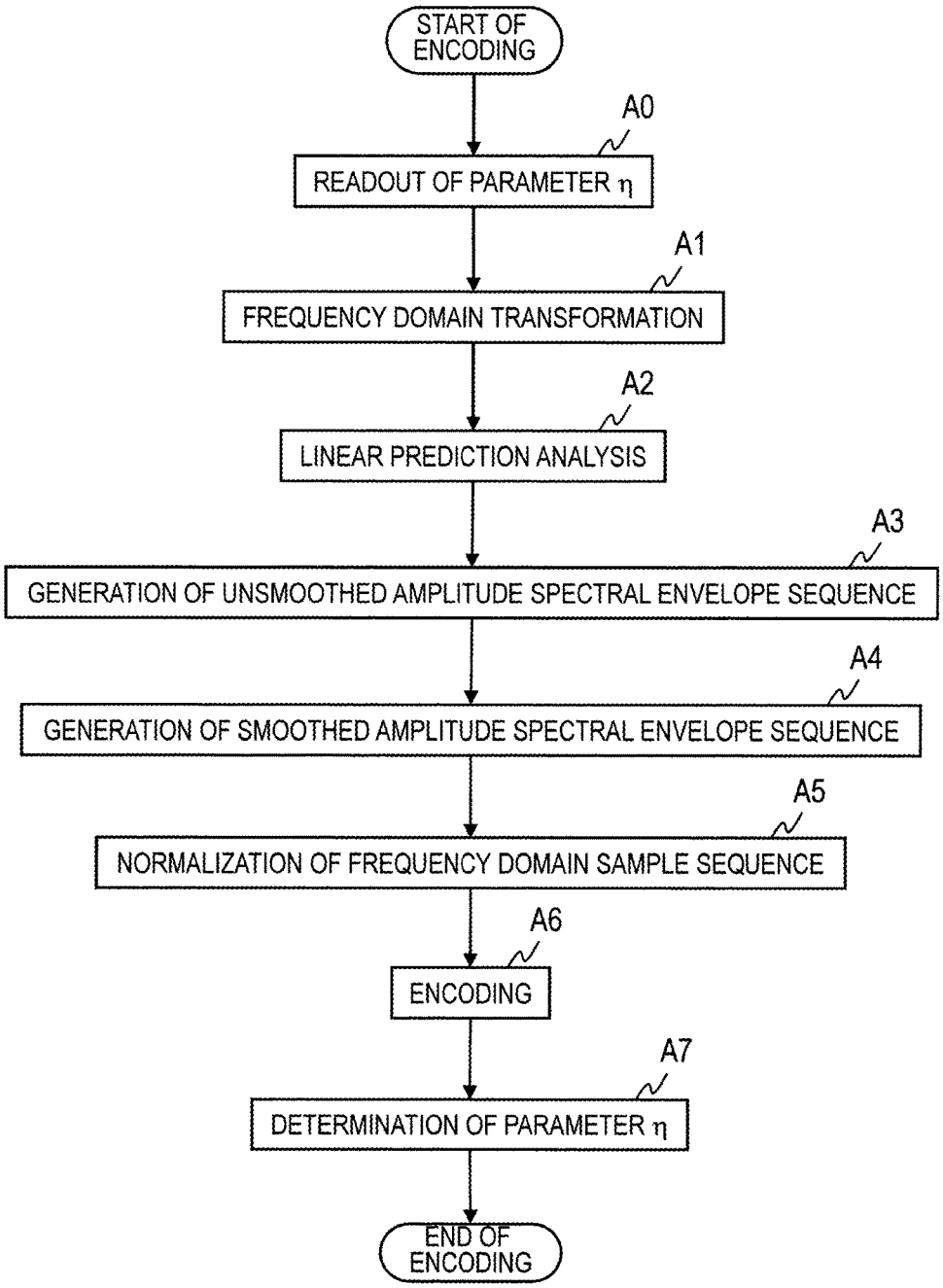
FIG. 5 is a flowchart for illustrating an example of an encoding method.

A configuration example of an encoding apparatus of the first embodiment is shown in FIG. 4. As shown in FIG. 4, the encoding apparatus of a first embodiment is, for example, provided with a frequency domain transforming portion 21, a linear prediction analyzing portion 22, an unsmoothed amplitude spectral envelope sequence generating portion 23, a smoothed amplitude spectral envelope sequence generating portion 24, an envelope normalizing portion 25, an encoding portion 26 and a parameter determining portion 27. An example of each process of an encoding method of the first embodiment realized by this encoding apparatus is shown in FIG. 5.

Each portion in FIG. 4 will be described below.

<Parameter Determining Portion 27>

In the first embodiment, any of a plurality of parameters η can be selected for each predetermined time section by the parameter determining portion 27.

It is assumed that the plurality of parameters η are stored in the parameter determining portion 27 as candidates for a parameter η. The parameter determining portion 27 sequentially reads out one parameter η from among the plurality of parameters and outputs it to the linear prediction analyzing portion 22, the unsmoothed amplitude spectral envelope sequence generating portion 23 and the encoding portion 26 (step A0).

The frequency domain transforming portion 21, the linear prediction analyzing portion 22, the unsmoothed amplitude spectral envelope sequence generating portion 23, the smoothed amplitude spectral envelope sequence generating portion 24, the envelope normalizing portion 25 and the encoding portion 26 perform, for example, processes of steps A1 to A6 described below based on each parameter η sequentially read by the parameter determining portion 27 to generate a code for a frequency domain sample sequence corresponding to a time-series signal in the same predetermined time section. In general, there may be a case where two or more codes are obtained for a frequency domain sample sequence corresponding to a time-series signal in the same predetermined time section, when a parameter η is a given. In this case, the code for the frequency domain sample sequence corresponding to the time-series signal in the same predetermined time section is a combination of the obtained two or more codes. In this example, the code is a combination of a linear prediction coefficient code, a gain code and an integer signal code. Thereby, a code for each parameter η for the frequency domain sample sequence corresponding to the time-series signal in the same predetermined time section is obtained.

After the process of step A6, the parameter determining portion 27 selects one code from among codes each of which has been obtained for each parameter η for the frequency domain sample sequence corresponding to the time-series signal in the same predetermined time section and decides a parameter corresponding to the selected code (step A7). The determined parameter η becomes a parameter η for the frequency domain sample sequence corresponding to the time-series signal in the same predetermined time section. Then, the parameter determining portion 27 outputs the selected code and a code indicating the determined parameter η to a decoding apparatus. Details of the process of step A7 by the parameter determining portion 27 will be described later.

It is assumed below that one parameter η has been read out by the parameter determining portion 27, and a process is performed for the read-out one parameter η.

<Frequency Domain Transforming Portion 21>

A sound signal, which is a time-domain time-series signal, is inputted to the frequency domain transforming portion 21. An example of the sound signal is a voice digital signal or an acoustic digital signal.

The frequency domain transforming portion 21 transforms the inputted time domain sound signal to an MDCT coefficient sequence X(0),X(1), . . . ,X(N−1) at a point N in a frequency domain for each frame with a predetermined time length (step A1). Here, N is a positive integer.

The obtained MDCT coefficient sequence X(0),X(1), . . . ,X(N−1) is outputted to the linear prediction analyzing portion 22 and the envelope normalizing portion 25.

It is assumed that subsequent processes are performed for each frame unless otherwise stated.

In this way, the frequency domain transforming portion 21 determines a frequency domain sample sequence, which is, for example, an MDCT coefficient sequence, corresponding to the sound signal.

<Linear Prediction Analyzing Portion 22>

The MDCT coefficient sequence X(0),X(1), . . . ,X(N−1) obtained by the frequency domain transforming portion 21 is inputted to the linear prediction analyzing portion 22.

The linear prediction analyzing portion 22 generates linear prediction coefficients $\beta_1,\beta_2, \ldots ,\beta_p$ by performing linear prediction analysis of ~R(0),~R(1), . . . ,~R(N−1) defined by the following expression (A7) using the MDCT coefficient sequence X(0),X(1), . . . ,X(N−1), and encodes the generated linear prediction coefficients $\beta_1,\beta_2, \ldots ,\beta_p$ to generate linear prediction coefficient codes and quantized linear prediction coefficients $\hat{\beta}_1,\hat{\beta}_2, \ldots ,\hat{\beta}_p$, which are quantized linear prediction coefficients corresponding to the linear prediction coefficient codes (step A2).

[Expression 12]

$$\tilde{R}(k) = \sum_{n=0}^{N-1} |X(k)|^{\eta} \exp\left(-j\frac{2\pi kn}{N}\right), \quad k = 0, 1, \ldots , N-1 \tag{A7}$$

The generated quantized linear prediction coefficients $\hat{\beta}_1,\hat{\beta}_2, \ldots ,\hat{\beta}_p$ are outputted to the unsmoothed amplitude spectral envelope sequence generating portion 23 and the smoothed amplitude spectral envelope sequence generating portion 24. During the linear prediction analysis process, predictive residual energy $\sigma^2$ is calculated. In this case, the calculated predictive residual energy $\sigma^2$ is outputted to a variance parameter determining portion 268 of the encoding portion 26.

Further, the generated linear prediction coefficient codes are transmitted to the parameter determining portion 27.

Specifically, by performing operation corresponding to inverse Fourier transform regarding the η-th power of absolute values of the MDCT coefficient sequence X(0),X(1), . . . ,X(N−1) as a power spectrum, that is, the operation of the expression (A7) first, the linear prediction analyzing portion 22 determines a pseudo correlation function signal sequence ~R(0),~R(1), . . . ,~R(N−1), which is a time domain signal sequence corresponding to the η-th power of the absolute values of the MDCT coefficient sequence X(0),X(1), . . . ,X(N−1). Then, the linear prediction analyzing portion 22 performs linear prediction analysis using the determined pseudo correlation function signal sequence ~R(0),~R(1), . . . ,~R(N−1) to generate linear prediction coefficients $\beta_1,\beta_2, \ldots ,\beta_p$. Then, by encoding the generated linear prediction coefficients $\beta_1,\beta_2, \ldots ,\beta_p$, the linear prediction analyzing portion 22 obtains linear prediction coefficient codes and quantized linear prediction coefficients $\hat{\beta}_1,\hat{\beta}_2, \ldots ,\hat{\beta}_p$ corresponding the linear prediction coefficient codes.

The linear prediction coefficients $\beta_1,\beta_2, \ldots ,\beta_p$ are linear prediction coefficients corresponding to a time domain signal when the η-th power of the absolute values of the MDCT coefficient sequence X(0),X(1), . . . ,X(N−1) are regarded as a power spectrum.

Generation of the linear prediction coefficient codes by the linear prediction analyzing portion 22 is performed, for example, by a conventional encoding technique. An example of the conventional encoding technique is, for example, an encoding technique in which a code corresponding to a linear prediction coefficient itself is caused to be a linear prediction coefficient code, an encoding technique in which a linear prediction coefficient is transformed to an LSP parameter, and a code corresponding to the LSP parameter is caused to be a linear prediction coefficient code, an encoding technique in which a linear prediction coefficient is transformed to a PARCOR coefficient, and a code corresponding to the PARCOR coefficient is caused to be a linear prediction code, or the like. For example, the encoding technique in which a code corresponding to a linear prediction coefficient itself is caused to be a linear prediction coefficient code is a technique in which a plurality of quantized linear prediction coefficient candidates are specified in advance; each candidates is stored being associated with a linear prediction coefficient code in advance; any of the candidates is determined as a quantized linear prediction coefficient corresponding to a generated linear prediction coefficient; and, thereby, the quantized linear prediction coefficient and the linear prediction coefficient code are obtained. For example, the encoding technique in which a code corresponding to a linear prediction coefficient itself is caused to be a linear prediction coefficient code is a technique in which a plurality of quantized linear prediction coefficient candidates are specified in advance; each candidates is stored being associated with a linear prediction coefficient code in advance; any of the candidates is determined as a quantized linear prediction coefficient corresponding to a generated linear prediction coefficient; and, thereby, the quantized linear prediction coefficient and the linear prediction coefficient code are obtained.

In this way, the linear prediction analyzing portion 22 performs linear prediction analysis using a pseudo correlation function signal sequence obtained by performing inverse Fourier transform regarding the η-th power of absolute values of a frequency domain sample sequence, which is, for example, an MDCT coefficient sequence, as a power spectrum, and generates coefficients transformable to linear prediction coefficients.

<Unsmoothed Amplitude Spectral Envelope Sequence Generating Portion 23>

The quantized linear prediction coefficients $\hat{\beta}_1, \hat{\beta}_2, \ldots, \hat{\beta}_p$ generated by the linear prediction analyzing portion 22 are inputted to the unsmoothed amplitude spectral envelope sequence generating portion 23.

The unsmoothed amplitude spectral envelope sequence generating portion 23 generates an unsmoothed amplitude spectral envelope sequence $\hat{H}(\mathbf{0}), \hat{H}(\mathbf{1}), \ldots, \hat{H}(N-1)$, which is an amplitude spectral envelope sequence corresponding to the quantized linear prediction coefficients $\hat{\beta}_1, \hat{\beta}_2, \ldots, \hat{\beta}_p$ (step A3).

The generated unsmoothed amplitude spectral envelope sequence $\hat{H}(\mathbf{0}), \hat{H}(\mathbf{1}), \ldots, \hat{H}(N-1)$ is outputted to the encoding portion 26.

The unsmoothed amplitude spectral envelope sequence generating portion 23 generates an unsmoothed amplitude spectral envelope sequence $\hat{H}(\mathbf{0}), \hat{H}(\mathbf{1}), \ldots, \hat{H}(N-1)$ defined by the following expression (A2) as the unsmoothed amplitude spectral envelope sequence $\hat{H}(\mathbf{0}), \hat{H}(\mathbf{1}), \ldots, \hat{H}(N-1)$ using the quantized linear prediction coefficients $\hat{\beta}_1, \hat{\beta}_2, \ldots, \hat{\beta}_p$.

[Expression 13]

$$\hat{H}(k) = \left( \frac{1}{2\pi} \frac{1}{\left| 1 + \sum_{n=1}^{P} \hat{\beta}_n \exp(-j2\pi kn/N) \right|^2} \right)^{1/\eta} \tag{A2}$$

In this way, the unsmoothed amplitude spectral envelope sequence generating portion 23 performs estimation of a spectral envelope by obtaining an unsmoothed spectral envelope sequence, which is a sequence obtained by raising a sequence of an amplitude spectral envelope corresponding to coefficients transformable to linear prediction coefficients generated by the linear prediction analyzing portion 22 to the power of 1/η. Here, when it is assumed that c is an arbitrary number, a sequence obtained by raising a sequence constituted by a plurality of values to the power of c refers to a sequence constituted by values obtained by raising the plurality of values to the power of c, respectively. For example, a sequence obtained by raising a sequence of an amplitude spectral envelope to the power of 1/η refers to a sequence constituted by values obtained by raising coefficients of the amplitude spectral envelope to the power of 1/η, respectively.

The process of raise to the power of 1/η by the unsmoothed amplitude spectral envelope sequence generating portion 23 is due to the process performed by the linear prediction analyzing portion 22 in which the η-th power of absolute values of a frequency domain sample sequence are regarded as a power spectrum. That is, the process of raise to the power of 1/η by the unsmoothed amplitude spectral envelope sequence generating portion 23 is performed in order to return values raised to the power of η by the process performed by the linear prediction analyzing portion 22 in which the η-th power of absolute values of a frequency domain sample sequence are regarded as a power spectrum, to the original values.

<Smoothed Amplitude Spectral Envelope Sequence Generating Portion 24>

The quantized linear prediction coefficients $\hat{\beta}_1, \hat{\beta}_2, \ldots, \hat{\beta}_p$ generated by the linear prediction analyzing portion 22 are inputted to the smoothed amplitude spectral envelope sequence generating portion 24.

The smoothed amplitude spectral envelope sequence generating portion 24 generates a smoothed amplitude spectral envelope sequence $\hat{H}_\gamma(\mathbf{0}), \hat{H}_\gamma(\mathbf{1}), \ldots, \hat{H}_\gamma(N-1)$, which is a sequence obtained by reducing amplitude unevenness of a sequence of an amplitude spectral envelope corresponding to the quantized linear prediction coefficients $\hat{\beta}_1, \hat{\beta}_2, \ldots, \hat{\beta}_p$ (step A4).

The generated smoothed amplitude spectral envelope sequence $\hat{H}_\gamma(\mathbf{0}), \hat{H}_\gamma(\mathbf{1}), \ldots, \hat{H}_\gamma(N-1)$ is outputted to the envelope normalizing portion 25 and the encoding portion 26.

The smoothed amplitude spectral envelope sequence generating portion 24 generates a smoothed amplitude spectral envelope sequence $\hat{H}_\gamma(\mathbf{0}), \hat{H}_\gamma(\mathbf{1}), \ldots, \hat{H}_\gamma(N-1)$ defined by an expression (A3) as the smoothed amplitude spectral envelope sequence $\hat{H}_\gamma(\mathbf{0}), \hat{H}_\gamma(\mathbf{1}), \ldots, \hat{H}_\gamma(N-1)$ using the quantized linear prediction coefficients $\hat{\beta}_1, \hat{\beta}_2, \ldots, \hat{\beta}_p$ and a correction coefficient γ.

[Expression 14]

$$\hat{H}_\gamma(k) = \left( \frac{1}{2\pi} \frac{1}{\left| 1 + \sum_{n=1}^{p} \hat{\beta}_n \gamma^n \exp(-j2\pi kn/N) \right|^2} \right)^{1/\eta} \quad \text{(A3)}$$

Here, the correction coefficient γ is a constant smaller than 1 specified in advance and a coefficient that reduces amplitude unevenness of the unsmoothed amplitude spectral envelope sequence $\hat{}H(\mathbf{0}),\hat{}H(\mathbf{1}), \ldots, \hat{}H(N-1)$, in other words, a coefficient that smoothes the unsmoothed amplitude spectral envelope sequence $\hat{}H(\mathbf{0}),\hat{}H(\mathbf{1}), \ldots, \hat{}H(N-1)$.

<Envelope Normalizing Portion 25>

The MDCT coefficient sequence $X(\mathbf{0}),X(\mathbf{1}), \ldots, X(N-1)$ obtained by the frequency domain transforming portion 21 and the smoothed amplitude spectral envelope sequence $\hat{}H_\gamma(\mathbf{0}),\hat{}H_\gamma(\mathbf{1}), \ldots, \hat{}H_\gamma(N-1)$ generated by the smoothed amplitude spectral envelope generating portion 24 are inputted to the envelope normalizing portion 25.

The envelope normalizing portion 25 generates a normalized MDCT coefficient sequence $X_N(\mathbf{0}),X_N(\mathbf{1}), \ldots, X_N(N-1)$ by normalizing each coefficient of the MDCT coefficient sequence $X(\mathbf{0}),X(\mathbf{1}), \ldots, X(N-1)$ by a corresponding value of the smoothed amplitude spectral envelope sequence $\hat{}H_\gamma(\mathbf{0}),\hat{}H_\gamma(\mathbf{1}), \ldots, \hat{}H_\gamma(N-1)$ (step A5).

The generated normalized MDCT coefficient sequence is outputted to the encoding portion 26.

The envelope normalizing portion 25 generates each coefficient $X_N(k)$ of the normalized MDCT coefficient sequence $X_N(\mathbf{0}),X_N(\mathbf{1}), \ldots, X_N(N-1)$ by dividing each coefficient $X(k)$ of the MDCT coefficient sequence $X(\mathbf{0}),X(\mathbf{1}), \ldots, X(N-1)$ by values of the smoothed amplitude spectral envelope sequence $\hat{}H_\gamma(\mathbf{0}),\hat{}H_\gamma(\mathbf{1}), \ldots, \hat{}H_\gamma(N-1)$, for example, on the assumption of $k=0, 1, \ldots, N-1$. That is, $X_N(k)=X(k)/\hat{}H_\gamma(k)$ is satisfied on the assumption of $k=0, 1, \ldots, N-1$.

<Encoding Portion 26>

The normalized MDCT coefficient sequence $X_N(\mathbf{0}),X_N(\mathbf{1}), \ldots, X_N(N-1)$ generated by the envelope normalizing portion 25, the unsmoothed amplitude spectral envelope sequence $\hat{}H(\mathbf{0}),\hat{}H(\mathbf{1}), \ldots, \hat{}H(N-1)$ generated by the unsmoothed amplitude spectral envelope generating portion 23, the smoothed amplitude spectral envelope sequence $\hat{}H_\gamma(\mathbf{0}),\hat{}H_\gamma(\mathbf{1}), \ldots, \hat{}H_\gamma(N-1)$ generated by the smoothed amplitude spectral envelope generating portion 24 and average residual energy $\sigma^2$ calculated by the linear prediction analyzing portion 22 are inputted to the encoding portion 26.

Figure 8:
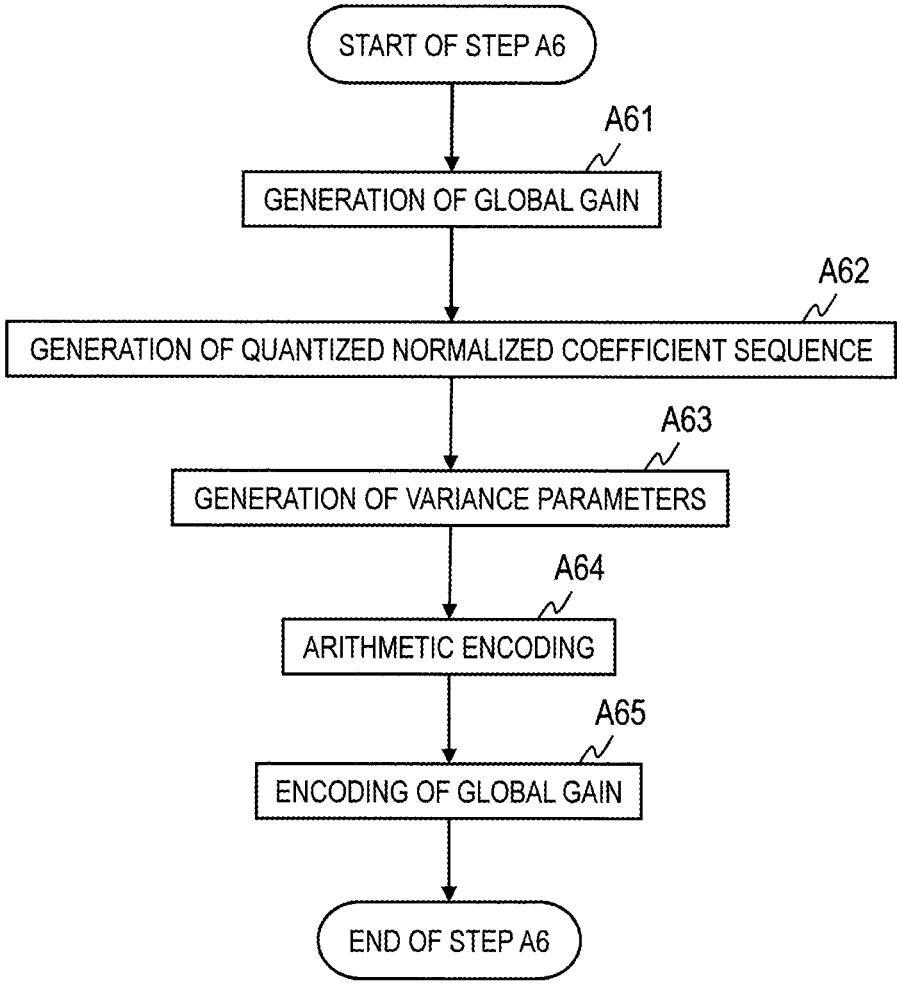
FIG. 8 is a flowchart for illustrating an example of a process of the encoding portion.

The encoding portion 26 performs encoding, for example, by performing processes of steps A61 to A65 shown in FIG. 8 (step A6).

The encoding portion 26 determines a global gain g corresponding to the normalized MDCT coefficient sequence $X_N(\mathbf{0}),X_N(\mathbf{1}), \ldots, X_N(N-1)$ (step A61), determines a quantized normalized coefficient sequence $X_Q(\mathbf{0}),X_Q(\mathbf{1}), \ldots, X_Q(N-1)$, which is a sequence of integer values obtained by quantizing a result of dividing each coefficient of the normalized MDCT coefficient sequence $X_N(\mathbf{0}),X_N(\mathbf{1}), \ldots, X_N(N-1)$ by the global gain g (step A62), determines variance parameters $\varphi(\mathbf{0}),\varphi(\mathbf{1}), \ldots, \varphi(N-1)$ corresponding to coefficients of the quantized normalized coefficient sequence $X_Q(\mathbf{0}),X_Q(\mathbf{1}), \ldots, X_Q(N-1)$, respectively, from the global gain g, the unsmoothed amplitude spectral envelope sequence $\hat{}H(\mathbf{0}),\hat{}H(\mathbf{1}), \ldots, \hat{}H(N-1)$, the smoothed amplitude spectral envelope sequence $\hat{}H_\gamma(\mathbf{0}),\hat{}H_\gamma(\mathbf{1}), \ldots, \hat{}H_\gamma(N-1)$ and the average residual energy $\sigma^2$ by an expression (A1) (step A63), performs arithmetic encoding of the quantized normalized coefficient sequence $X_Q(\mathbf{0}),X_Q(\mathbf{1}), \ldots, X_Q(N-1)$ using the variance parameters $\varphi(\mathbf{0}),\varphi(\mathbf{1}), \ldots, \varphi(N-1)$ to obtain integer signal codes (step A64) and obtains a gain code corresponding to the global gain g (step A65).

[Expression 15]

$$\phi(k) = \eta^{1/\eta} B(\eta) \hat{H}_N(k) \frac{\sigma^{2/\eta}}{g} \quad \text{(A1)}$$

Here, a normalized amplitude spectral envelope sequence $\hat{}H_N(\mathbf{0}),\hat{}H_N(\mathbf{1}), \ldots, \hat{}H_N$ in the above expression (A1) is what is obtained by dividing each value of the unsmoothed amplitude spectral envelope sequence $\hat{}H(\mathbf{0}),\hat{}H(\mathbf{1}), \ldots, \hat{}H(N-1)$ by a corresponding value of the smoothed amplitude spectral envelope sequence $\hat{}H_\gamma(\mathbf{0}),\hat{}H_\gamma(\mathbf{1}), \ldots, \hat{}H_7(N-1)$, that is, what is determined by the following expression (A8).

[Expression 16]

$$\hat{H}_N(k) = \frac{\hat{H}(k)}{\hat{H}_\gamma(k)}, k = 0, 1, \ldots, N-1 \quad \text{(A8)}$$

The generated integer signal codes and gain code are outputted to the parameter determining portion 27 as codes corresponding to the normalized MDCT coefficient sequence.

The encoding portion 26 realizes a function of determining such a global gain g that the number of bits of the integer signal codes is equal to or smaller than the number of allocated bits B, which is the number of bits allocated in advance, and is as large as possible and generating a gain code corresponding to the determined global gain g and integer signal codes corresponding to the determined global gain g by the above steps A61 to A65.

Among steps A61 to A65 performed by the encoding portion 26, it is step A63 that comprises a characteristic process. As for the encoding process itself which is for obtaining the codes corresponding to the normalized MDCT coefficient sequence by encoding each of the global gain g and the quantized normalized coefficient sequence $X_Q(\mathbf{0}), X_Q(\mathbf{1}), \ldots, X_Q(N-1)$, various publicly-known techniques including the technique described in Non-patent literature 1 exist. Two specific examples of the encoding process performed by the encoding portion 26 will be described below.

[Specific Example 1 of Encoding Process Performed by Encoding Portion 26]

As a specific example 1 of the encoding process performed by the encoding portion 26, an example which does not comprise a loop process will be described.

Figure 6:
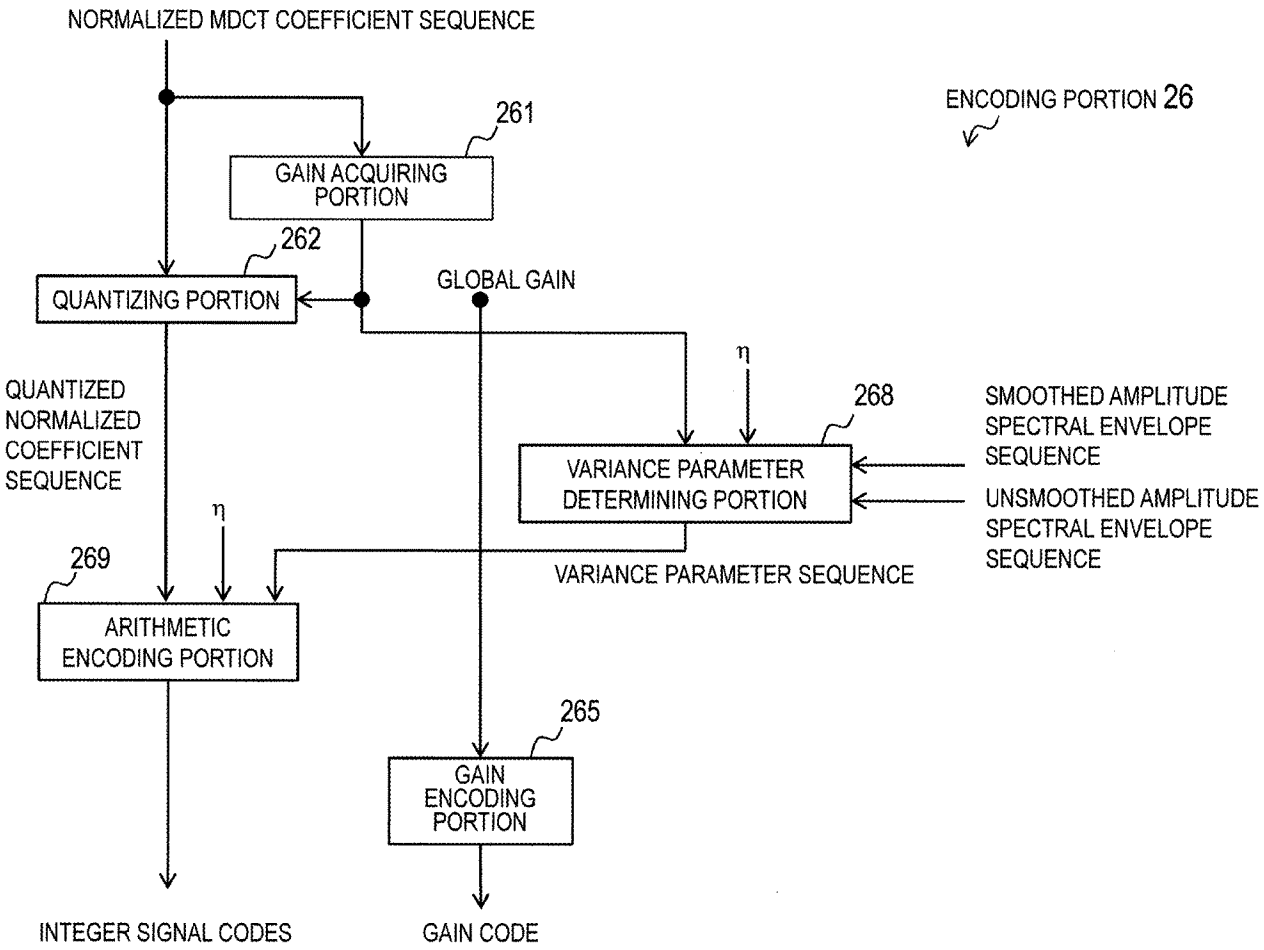
FIG. 6 is a block diagram for illustrating an example of an encoding portion.

FIG. 6 shows a configuration example of the encoding portion 26 of the specific example 1. As shown in FIG. 6, the encoding portion 26 of the specific example 1 is, for example, provided with a gain acquiring portion 261, a quantizing portion 262, a variance parameter determining portion 268, an arithmetic encoding portion 269 and a gain encoding portion 265. Each portion in FIG. 6 will be described below.

<Gain Acquiring Portion 261>

The normalized MDCT coefficient sequence $X_N(0),X_N(1), \ldots ,X_N(N-1)$ generated by the envelope normalizing portion 25 is inputted to the gain acquiring portion 261.

The gain acquiring portion 261 decides and outputs such a global gain g that the number of bits of integer signal codes is equal to or smaller than the number of allocated bits B, which is the number of bits allocated in advance, and is as large as possible, from the normalized MDCT coefficient sequence $X_N(0),X_N(1), \ldots ,X_N(N-1)$ (step S261). For example, the gain acquiring portion 261 acquires and outputs a value of multiplication of a square root of the total of energy of the normalized MDCT coefficient sequence $X_N(0), X_N(1), \ldots ,X_N(N-1)$ by a constant which is in negative correlation with the number of allocated bits B as the global gain g. Otherwise, the gain acquiring portion 261 may tabulate a relationship among the total of energy of the normalized MDCT coefficient sequence $X_N(0),X_N(1), \ldots ,X_N(N-1)$, the number of allocated bits B and the global gain g in advance, and obtain and output a global gain g by referring to the table.

In this way, the gain acquiring portion 261 obtains a gain for performing division of all samples of a normalized frequency domain sample sequence which is, for example, a normalized MDCT coefficient sequence.

The obtained global gain g is outputted to the quantizing portion 262 and the variance parameter determining portion 268.

<Quantizing Portion 262>

The normalized MDCT coefficient sequence $X_N(0),X_N(1), \ldots ,X_N(N-1)$ generated by the envelope normalizing portion 25 and the global gain g obtained by the gain acquiring portion 261 are inputted to the quantizing portion 262.

The quantizing portion 262 obtains and outputs a quantized normalized coefficient sequence $X_Q(0),X_Q(1), \ldots ,X_Q(N-1)$, which is a sequence of integer parts of a result of dividing each coefficient of the normalized MDCT coefficient sequence $X_N(0),X_N(1), \ldots ,X_N(N-1)$ by the global gain g (step S262).

In this way, the quantizing portion 262 determines a quantized normalized coefficient sequence by dividing each sample of a normalized frequency domain sample sequence which is, for example, a normalized MDCT coefficient sequence by a gain and quantizing the result.

The obtained quantized normalized coefficient sequence $X_Q(0),X_Q(1), \ldots ,X_Q(N-1)$ is outputted to the arithmetic encoding portion 269.

<Variance Parameter Determining Portion 268>

The parameter η read out by the parameter determining portion 27, the global gain g obtained by the gain acquiring portion 261, the unsmoothed amplitude spectral envelope sequence $\hat{H}(0),\hat{H}(1), \ldots ,\hat{H}(N-1)$ generated by the unsmoothed amplitude spectral envelope generating portion 23, the smoothed amplitude spectral envelope sequence $\hat{H}_\gamma(0),\hat{H}_\gamma(1), \ldots ,\hat{H}_\gamma(N-1)$ generated by the smoothed amplitude spectral envelope generating portion 24, and the predictive residual energy $\sigma^2$ obtained by the linear prediction analyzing portion 22 are inputted to the variance parameter determining portion 268.

The variance parameter determining portion 268 obtains each variance parameter of a variance parameter sequence $\varphi(0),\varphi(1), \ldots ,\varphi(N-1)$ from the global gain g, the unsmoothed amplitude spectral envelope sequence $\hat{H}(0),\hat{H}(1), \ldots ,\hat{H}(N-1)$, the smoothed amplitude spectral envelope sequence $\hat{H}_\gamma(0),\hat{H}_\gamma(1), \ldots ,\hat{H}_\gamma(N-1)$ and the predictive residual energy $\sigma^2$ by the above expressions (A1) and (A8) (step S268).

The obtained variance parameter sequence $\varphi(0),\varphi(1), \ldots ,\varphi(N-1)$ is outputted to the arithmetic encoding portion 269.

<Arithmetic Encoding Portion 269>

The parameter η read out by the parameter determining portion 27, the quantized normalized coefficient sequence $X_Q(0),X_Q(1), \ldots ,X_Q(N-1)$ obtained by the quantizing portion 262 and the variance parameter sequence $\varphi(0),\varphi(1), \ldots ,\varphi(N-1)$ obtained by the variance parameter determining portion 268 are inputted to the arithmetic encoding portion 269.

The arithmetic encoding portion 269 performs arithmetic encoding of the quantized normalized coefficient sequence $X_Q(0),X_Q(1), \ldots ,X_Q(N-1)$ using each variance parameter of the variance parameter sequence $\varphi(0),\varphi(1), \ldots ,\varphi(N-1)$ as a variance parameter corresponding to each coefficient of the quantized normalized coefficient sequence $X_Q(0),X_Q(1), \ldots ,X_Q(N-1)$ to obtain and output integer signal codes (step S269).

At the time of performing arithmetic encoding, the arithmetic encoding portion 269 performs such bit allocation that each coefficient of the quantized normalized coefficient sequence $X_Q(0),X_Q(1), \ldots ,X_Q(N-1)$ becomes optimal when being in accordance with the generalized Gaussian distribution $f_{GG}(X|\varphi(k),\eta)$, by arithmetic coding, and performs encoding with arithmetic codes based on the performed bit allocation.

The obtained integer signal codes are outputted to the parameter determining portion 27.

Arithmetic encoding may be performed over a plurality of coefficients in the quantized normalized coefficient sequence $X_Q(0),X_Q(1), \ldots ,X_Q(N-1)$. In this case, since each variance parameter of the variance parameter sequence $\varphi(0),\varphi(1), \ldots ,\varphi(N-1)$ is based on the unsmoothed amplitude spectral envelope sequence $\hat{H}(0),\hat{H}(1), \ldots ,\hat{H}(N-1)$ as seen from the expressions (A1) and (A8), it can be said that the arithmetic encoding portion 269 performs such encoding that bit allocation substantially changes based on an estimated spectral envelope (an unsmoothed amplitude spectral envelope).

<Gain Encoding Portion 265>

The global gain g obtained by the gain acquiring portion 261 is inputted to the gain encoding portion 265.

The gain encoding portion 265 encodes the global gain g to obtain and output a gain code (step S265).

The generated integer signal codes and gain code are outputted to the parameter determining portion 27 as codes corresponding to the normalized MDCT coefficient sequence.

Steps S261, S262, S268, S269 and S265 of the present specific example 1 correspond to the above steps A61, A62, A63, A64 and A65, respectively.

[Specific Example 2 of Encoding Process Performed by Encoding Portion 26]

As a specific example 2 of the encoding process performed by the encoding portion 26, an example which comprises a loop process will be described.

Figure 7:
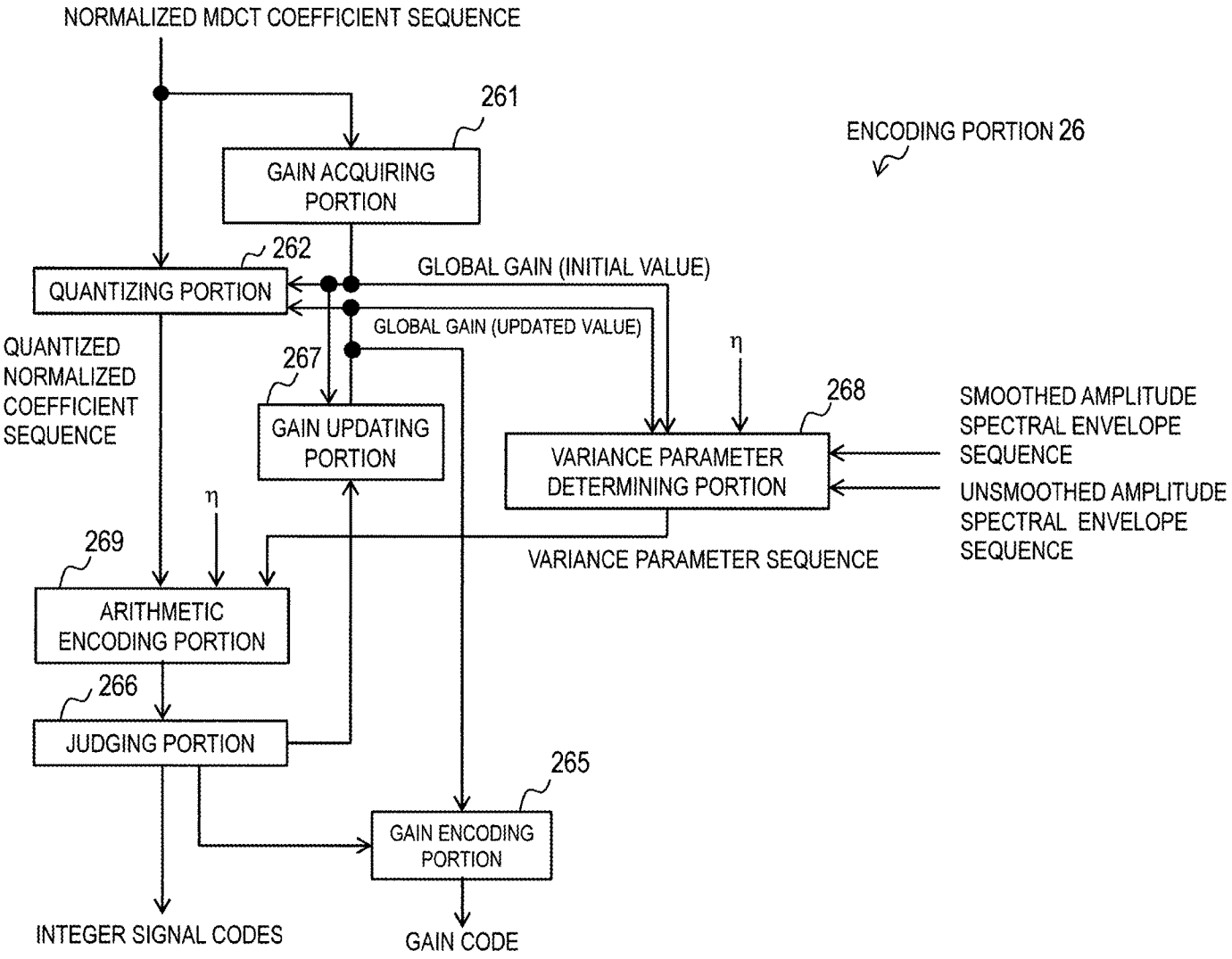
FIG. 7 is a block diagram for illustrating an example of the encoding portion.

FIG. 7 shows a configuration example of the encoding portion 26 of the specific example 2. As shown in FIG. 7, the encoding portion 26 of the specific example 2 is, for example, provided with a gain acquiring portion 261, a quantizing portion 262, a variance parameter determining portion 268, an arithmetic encoding portion 269, a gain encoding portion 265, a judging portion 266 and a gain updating portion 267. Each portion in FIG. 7 will be described below.

<Gain Acquiring Portion 261>

The normalized MDCT coefficient sequence $X_N(0),X_N(1), \ldots ,X_N(N-1)$ generated by the envelope normalizing portion 25 is inputted to the gain acquiring portion 261.

The gain acquiring portion 261 decides and outputs such a global gain g that the number of bits of integer signal codes is equal to or smaller than the number of allocated bits B, which is the number of bits allocated in advance, and is as large as possible, from the normalized MDCT coefficient sequence $X_N(0),X_N(1), \ldots ,X_N(N-1)$ (step S261). For example, the gain acquiring portion 261 acquires and outputs a value of multiplication of a square root of the total of energy of the normalized MDCT coefficient sequence $X_N(0), X_N(1), \ldots ,X_N(N-1)$ by a constant which is in negative correlation with the number of allocated bits B as the global gain g.

The obtained global gain g is outputted to the quantizing portion 262 and the variance parameter determining portion 268.

The global gain g obtained by the gain acquiring portion 261 becomes an initial value of a global gain used by the quantizing portion 262 and the variance parameter determining portion 268.

<Quantizing Portion 262>

The normalized MDCT coefficient sequence $X_N(0),X_N(1), \ldots ,X_N(N-1)$ generated by the envelope normalizing portion 25 and the global gain g obtained by the gain acquiring portion 261 or the gain updating portion 267 are inputted to the quantizing portion 262.

The quantizing portion 262 obtains and outputs a quantized normalized coefficient sequence $X_Q(0),X_Q(1), \ldots ,X_Q(N-1)$, which is a sequence of integer parts of a result of dividing each coefficient of the normalized MDCT coefficient sequence $X_N(0),X_N(1), \ldots ,X_N(N-1)$ by the global gain g (step S262).

Here, a global gain g used when the quantizing portion 262 is executed for the first time is the global gain g obtained by the gain acquiring portion 261, that is, the initial value of the global gain. Further, a global gain g used when the quantizing portion 262 is executed at and after the second time is the global gain g obtained by the gain updating portion 267, that is, an updated value of the global gain.

The obtained quantized normalized coefficient sequence $X_Q(0),X_Q(1), \ldots ,X_Q(N-1)$ is outputted to the arithmetic encoding portion 269.

<Variance Parameter Determining Portion 268>

The parameter η read out by the parameter determining portion 27, the global gain g obtained by the gain acquiring portion 261 or the gain updating portion 267, the unsmoothed amplitude spectral envelope sequence $\hat{H}(0),\hat{H}(1), \ldots ,\hat{H}(N-1)$ generated by the unsmoothed amplitude spectral envelope generating portion 23, the smoothed amplitude spectral envelope sequence $\hat{H}_\gamma(0),\hat{H}_\gamma(1), \ldots ,\hat{H}_\gamma(N-1)$ generated by the smoothed amplitude spectral envelope generating portion 24, and the predictive residual energy $\sigma^2$ obtained by the linear prediction analyzing portion 22 are inputted to the variance parameter determining portion 268.

The variance parameter determining portion 268 obtains each variance parameter of a variance parameter sequence $\varphi(0),\varphi(1), \ldots ,\varphi(N-1)$ from the global gain g, the unsmoothed amplitude spectral envelope sequence $\hat{H}(0),\hat{H}(1), \ldots ,\hat{H}(N-1)$, the smoothed amplitude spectral envelope sequence $\hat{H}_\gamma(0),\hat{H}_\gamma(1), \ldots ,\hat{H}_\gamma(N-1)$ and the predictive residual energy $\sigma^2$ by the above expressions (A1) and (A8) (step S268).

Here, a global gain g used when the variance parameter determining portion 268 is executed for the first time is the global gain g obtained by the gain acquiring portion 261, that is, the initial value of the global gain. Further, a global gain g used when the variance parameter determining portion 268 is executed at and after the second time is the global gain g obtained by the gain updating portion 267, that is, an updated value of the global gain.

The obtained variance parameter sequence $\varphi(0),\varphi(1), \ldots ,\varphi(N-1)$ is outputted to the arithmetic encoding portion 269.

<Arithmetic Encoding Portion 269>

The parameter η read out by the parameter determining portion 27, the quantized normalized coefficient sequence $X_Q(0),X_Q(1), \ldots ,X_Q(N-1)$ obtained by the quantizing portion 262 and the variance parameter sequence $\varphi(0),\varphi(1), \ldots ,\varphi(N-1)$ obtained by the variance parameter determining portion 268 are inputted to the arithmetic encoding portion 269.

The arithmetic encoding portion 269 performs arithmetic encoding of the quantized normalized coefficient sequence $X_Q(0),X_Q(1), \ldots ,X_Q(N-1)$ using each variance parameter of the variance parameter sequence $\varphi(0),\varphi(1), \ldots ,\varphi(N-1)$ as a variance parameter corresponding to each coefficient of the quantized normalized coefficient sequence $X_Q(0),X_Q(1), \ldots ,X_Q(N-1)$ to obtain and output integer signal codes and the number of consumed bits C, which is the number of bits of the integer signal codes (step S269).

At the time of performing arithmetic encoding, the arithmetic encoding portion 269 configures such arithmetic codes that each coefficient of the quantized normalized coefficient sequence $X_Q(0),X_Q(1), \ldots ,X_Q(N-1)$ becomes optimal when being in accordance with generalized Gaussian distribution $f_{GG}(X|\varphi(k),\eta)$ and performs encoding with the arithmetic codes based on this configuration. As a result, an expected value of bit allocation to each coefficient of the quantized normalized coefficient sequence $X_Q(0),X_Q(1), \ldots ,X_Q(N-1)$ is determined with the variance parameter sequence $\varphi(0),\varphi(1), \ldots ,\varphi(N-1)$.

The obtained integer signal codes and the number of consumed bits C are outputted to the judging portion 266.

Arithmetic encoding may be performed over a plurality of coefficients in the quantized normalized coefficient sequence $X_Q(0),X_Q(1), \ldots ,X_Q(N-1)$. In this case, since each variance parameter of the variance parameter sequence $\varphi(0),\varphi(1), \ldots ,\varphi(N-1)$ is based on the unsmoothed amplitude spectral envelope sequence $\hat{H}(0),\hat{H}(1), \ldots ,\hat{H}(N-1)$ as seen from the expressions (A1) and (A8), it can be said that the arithmetic encoding portion 269 performs such encoding that bit allocation substantially changes based on an estimated spectral envelope (an unsmoothed amplitude spectral envelope).

<Judging Portion 266>

The integer signal codes obtained by the arithmetic encoding portion 269 are inputted to the judging portion 266.

When the number of times of updating the gain is a predetermined number of times, the judging portion 266 outputs the integer signal codes as well as outputting an instruction signal to encode the global gain g obtained by the gain updating portion 267 to the gain encoding portion 265. When the number of times of updating the gain is smaller than the predetermined number of times, the judging portion 266 outputs the number of consumed bits C measured by the arithmetic encoding portion 264 to the gain updating portion 267 (step S266).

<Gain Updating Portion 267>

The number of consumed bits C measured by the arithmetic encoding portion 269 is inputted to the gain updating portion 267.

When the number of consumed bits C is larger than the number of allocated bits B, the gain updating portion 267 updates the value of the global gain g to be a larger value and outputs the value. When the number of consumed bits C is smaller than the number of allocated bits B, the gain updating portion 267 updates the value of the global gain g to be a smaller value and outputs the updated value of the global gain g (step S267).

The updated global gain g obtained by the gain updating portion 267 is outputted to the quantizing portion 262 and the gain encoding portion 265.

<Gain Encoding Portion 265>

An output instruction from the judging portion 266 and the global gain g obtained by the gain updating portion 267 are inputted to the gain encoding portion 265.

The gain encoding portion 265 encodes the global gain g to obtain and output a gain code in accordance with an instruction signal (step 265).

The integer signal codes outputted by the judging portion 266 and the gain code outputted by the gain encoding portion 265 are outputted to the parameter determining portion 27 as codes corresponding to the normalized MDCT coefficient sequence.

That is, in the present specific example 2, step S267 performed last corresponds to the above step A61, and steps S262, S263, S264 and S265 correspond to the above steps A62, A63, A64, and A65, respectively.

The specific example 2 of the encoding process performed by the encoding portion 26 is described in more detail in International Publication No. WO2014/054556 and the like.

[Modification of Encoding Portion 26]

The encoding portion 26 may perform such encoding that bit allocation is changed based on an estimated spectral envelope (an unsmoothed amplitude spectral envelope), for example, by performing the following process.

The encoding portion 26 determines a global gain g corresponding to the normalized MDCT coefficient sequence $X_N(0), X_N(1), \ldots, X_N(N-1)$ first, and determines a quantized normalized coefficient sequence $X_Q(0), X_Q(1), \ldots, X_Q(N-1)$, which is a sequence of integer values obtained by quantizing a result of dividing each coefficient of the normalized MDCT coefficient sequence $X_N(0), X_N(1), \ldots, X_N(N-1)$ by the global gain g.

As for quantized bits corresponding to each coefficient of this quantized normalized coefficient sequence $X_Q(0), X_Q(1), \ldots, X_Q(N-1)$, it is possible to, on the assumption that distribution of $X_Q(k)$ is uniform in a certain range, decide the range based on estimated values of an envelope. Though it is also possible to encode an envelope estimation value for each of a plurality of samples, the encoding portion 26 can decide the range of $X_Q(k)$ using values $\hat{H}_N(k)$ of a normalized amplitude spectral envelope sequence based on linear prediction, for example, like the following expression (A9).

[Expression 17]

$$\phi(k) = \frac{\hat{H}(k)}{\hat{H}_\gamma(k)} = \hat{H}_N(k), \ (k = 0, \ldots, N-1) \tag{A9}$$

In order to minimize a square error of $X_Q(k)$ at the time of quantizing $X_Q(k)$ for a certain k, it is possible to set the number of bits b(k) to be allocated, under the restriction of the following expression:

[Expression 18]

$$\phi(k) = \frac{\hat{H}(k)}{\hat{H}_\gamma(k)} = \hat{H}_N(k), \ (k = 0, \ldots, N-1) \tag{A9}$$

The number of bits b(k) to be allocated can be represented by the following expression (A10):

[Expression 19]

$$b(k) = \frac{B}{N} + \frac{1}{2}\log_2(\phi(k)^2) - \frac{1}{2}\sum_{j=0}^{j=N-1}\log_2(\phi(j)^2), \quad (k = 0, \ldots, N-1) \tag{A10}$$

Here, B is a positive integer specified in advance. At this time, the encoding portion 26 may perform a process for readjustment of b(k) by performing rounding off so that b(k) becomes an integer, setting b(k)=0 when b(k) is smaller than 0, or the like.

Further, it is also possible to for the encoding portion 26 to decide the number of allocated bits not for allocation for each sample but for allocation for a plurality of collected samples and, as for quantization, perform not scalar quantization for each sample but quantization for each vector of a plurality of collected samples.

When the number of quantized bits b(k) of $X_Q(k)$ of a sample k is given as described above, and encoding is performed for each sample, $X_Q(k)$ can take $2^{b(k)}$ kinds of integers from $-2^{b(k)-1}$ to $2^{b(k)-1}$. The encoding portion 26 encodes each sample with b(k) bits to obtain an integer signal code.

Generated integer signal codes are outputted to the decoding apparatus. For example, the generated b(k)-bit integer signal codes corresponding to $X_Q(k)$ are sequentially outputted to the decoding apparatus, with k=0 first.

If $X_Q(k)$ exceeds the range from $-2^{b(k)-1}$ to $2^{b(k)-1}$ described above, it is replaced with a maximum value or a minimum value.

When g is too small, quantization distortion is caused by the replacement. When g is too large, a quantization error increases, and it is not possible to effectively utilize information because the range that $X_Q(k)$ can take is too small in comparison with b(k). Therefore, optimization of g may be performed.

The encoding portion 26 encodes the global gain g to obtain and output a gain code.

The encoding portion 26 may perform encoding other than arithmetic encoding as done in this modification of the encoding portion 26.

<Parameter Determining Portion 27>

The code generated for each parameter η for the frequency domain sample sequence corresponding to the time-series signal in the same predetermined time section (in this example, a linear prediction coefficient code, a gain code and an integer signal code) by the process from steps A1 to A6 is inputted to the parameter determining portion 27.

The parameter determining portion 27 selects one code from among codes each of which has been obtained for each parameter η for the frequency domain sample sequence corresponding to the time-series signal in the same predetermined time section and decides a parameter η corresponding to the selected code (step A7). The determined parameter η becomes a parameter η for the frequency domain sample sequence corresponding to the time-series signal in the same predetermined time section. Then, the parameter determining portion 27 outputs the selected code and a parameter code indicating the determined parameter η to the decoding apparatus. Selection of a code is performed based on at least one of code amounts of codes and encoding distortions corresponding to the codes. For example, a code with the smallest code amount or a code with the smallest encoding distortion is selected.

Here, the encoding distortion refers to an error between a frequency domain sample sequence obtained from an input signal and a frequency domain sample sequence obtained by locally decoding generated codes. The encoding apparatus may be provided with an encoding distortion calculating portion for calculating the encoding distortion. This encoding distortion calculating portion is provided with a decoding portion which performs a process similar to a process of the decoding apparatus described below, and this decoding portion locally decodes generated codes. After that, the encoding distortion calculating portion calculates an error between a frequency domain sample sequence obtained from an input signal and a frequency domain sample sequence obtained by performing local decoding and regards it as encoding distortion.

(Decoding)

Figure 9:
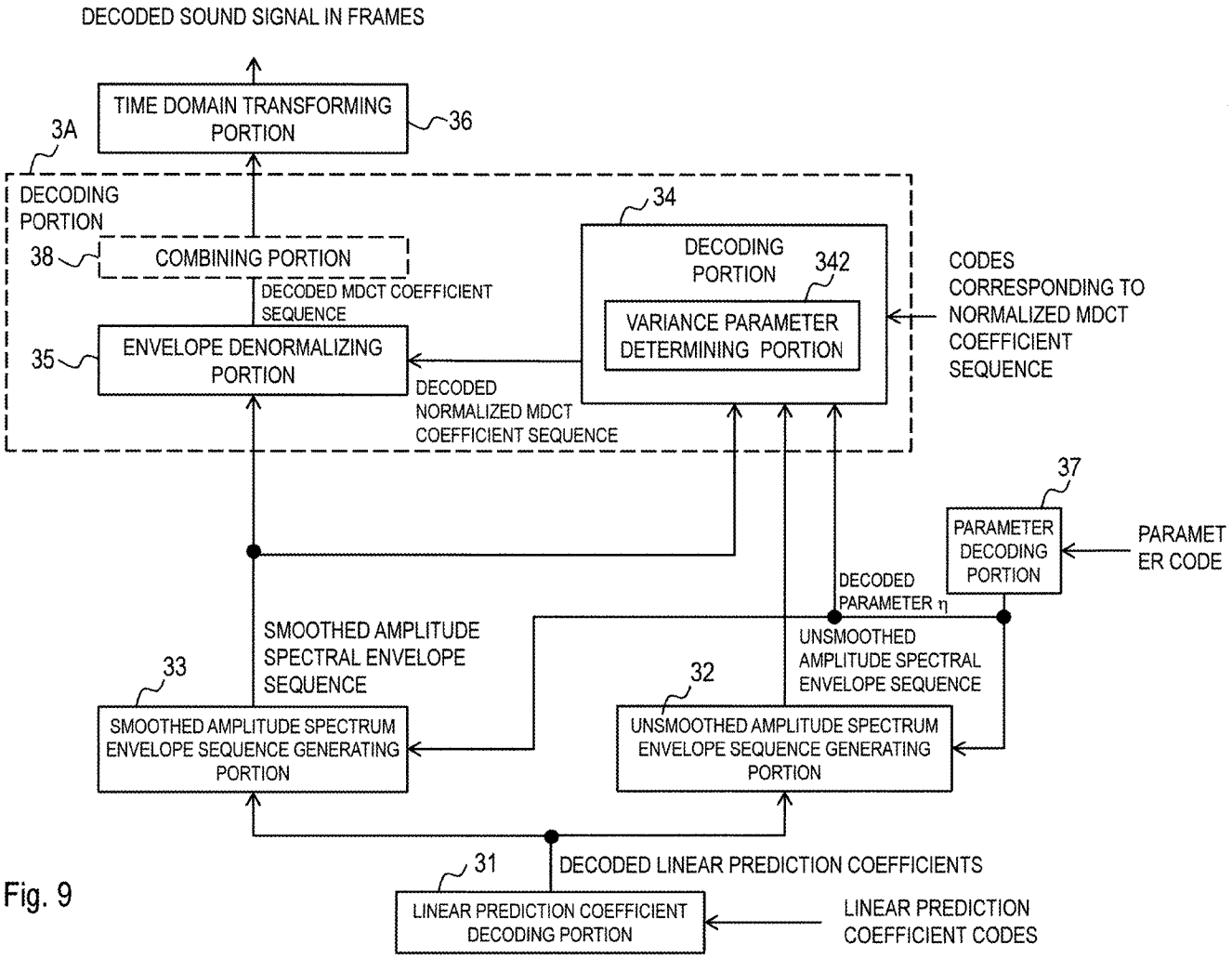
FIG. 9 is a block diagram for illustrating an example of a decoding apparatus.
Figure 10:
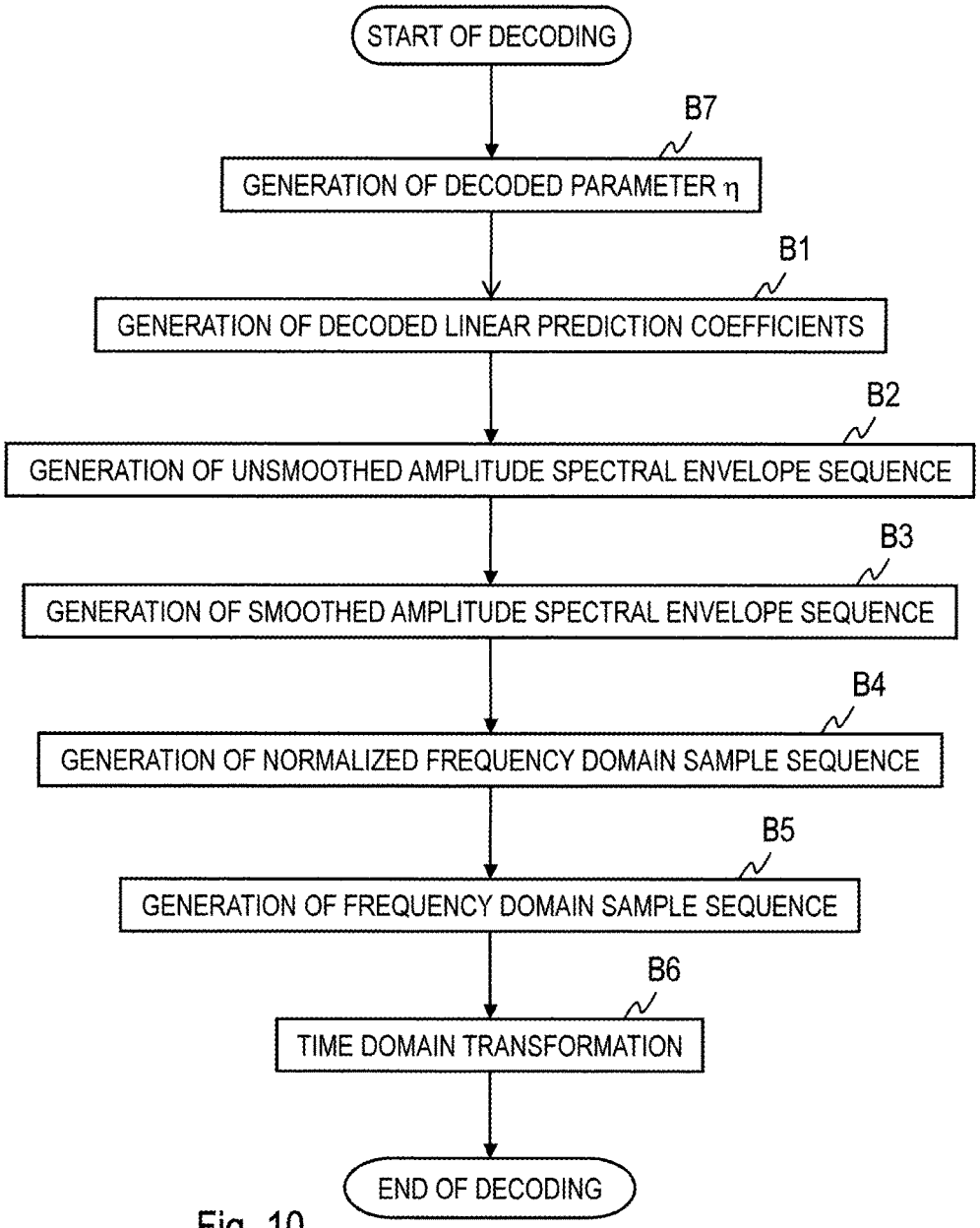
FIG. 10 is a flowchart for illustrating an example of a decoding method.

FIG. 9 shows a configuration example of the decoding apparatus corresponding to the encoding apparatus. As shown in FIG. 9, the decoding apparatus of the first embodiment is, for example, provided with a linear prediction coefficient decoding portion 31, an unsmoothed amplitude spectral envelope sequence generating portion 32, a smoothed amplitude spectral envelope sequence generating portion 33, a decoding portion 34, an envelope denormalizing portion 35, a time domain transforming portion 36 and a parameter decoding portion 37. FIG. 10 shows an example of each process of a decoding method of the first embodiment realized by this decoding apparatus.

At least a parameter code, codes corresponding to a normalized MDCT coefficient sequence and linear prediction coefficient codes outputted by the encoding apparatus are inputted to the decoding apparatus.

Each portion in FIG. 9 will be described below.

<Parameter Decoding Portion 37>

The parameter code outputted by the encoding apparatus is inputted to the parameter decoding portion 37.

The parameter decoding portion 37 determines a decoded parameter η by decoding the parameter code. The decoded parameter η which has been determined is outputted to the unsmoothed amplitude spectrum envelope sequence generating portion 32, the smoothed amplitude spectrum envelope sequence generating portion 33 and the decoding portion 34. A plurality of decoded parameters η are stored in the parameter decoding portion 37 as candidates. The parameter decoding portion 37 determines a decoded parameter η candidate corresponding to a parameter code as a decoded parameter η. The plurality of decoded parameters η stored in the parameter decoding portion 37 are the same as the plurality of parameters η stored in the parameter determining portion 27 of the encoding apparatus.

<Linear Prediction Coefficient Decoding Portion 31>

The linear prediction coefficient codes outputted by the encoding apparatus are inputted to the linear prediction coefficient decoding portion 31.

For each frame, the linear prediction coefficient decoding portion 31 decodes the inputted linear prediction coefficient codes, for example, by a conventional decoding technique to obtain decoded linear prediction coefficients $\hat{\beta}_1, \hat{\beta}_2, \ldots, \hat{\beta}_p$ (step B1).

The obtained decoded linear prediction coefficients $\hat{\beta}_1, \hat{\beta}_2, \ldots, \hat{\beta}_p$ are outputted to the unsmoothed amplitude spectral envelope sequence generating portion 32 and the unsmoothed amplitude spectral envelope sequence generating portion 33.

Here, the conventional decoding technique is, for example, a technique in which, when the linear prediction coefficient codes are codes corresponding to quantized linear prediction coefficients, the linear prediction coefficient codes are decoded to obtain decoded linear prediction coefficients which are the same as the quantized linear prediction coefficients, a technique in which, when the linear prediction coefficient codes are codes corresponding to quantized LSP parameters, the linear prediction coefficient codes are decoded to obtain decoded LSP parameters which are the same as the quantized LSP parameters, or the like. Further, the linear prediction coefficients and the LSP parameters are mutually transformable, and it is well known that a transformation process can be performed between the decoded linear prediction coefficients and the decoded LSP parameters according to inputted linear prediction coefficient codes and information required for subsequent processes. From the above, it can be said that what comprises the above linear prediction coefficient code decoding process and the above transformation process performed as necessary is "decoding by the conventional decoding technique".

In this way, the linear prediction coefficient decoding portion 31 generates coefficients transformable to linear prediction coefficients corresponding to a pseudo correlation function signal sequence obtained by performing inverse Fourier transform regarding the η-th power of absolute values of a frequency domain sample sequence corresponding to a time-series signal as a power spectrum, by decoding inputted linear prediction codes.

<Unsmoothed Amplitude Spectral Envelope Sequence Generating Portion 32>

The decoded parameter η determined by the parameter decoding portion 37 and the decoded linear prediction coefficients $\hat{\beta}_1, \hat{\beta}_2, \ldots, \hat{\beta}_p$ obtained by the linear prediction coefficient decoding portion 31 are inputted to the unsmoothed amplitude spectral envelope sequence generating portion 32.

The unsmoothed amplitude spectral envelope sequence generating portion 32 generates an unsmoothed amplitude spectral envelope sequence $\hat{H}(0), \hat{H}(1), \ldots, \hat{H}(N-1)$, which is a sequence of an amplitude spectral envelope corresponding to the decoded linear prediction coefficients $\hat{\beta}_1, \hat{\beta}_2, \ldots, \hat{\beta}_p$ by the above expression (A2) (step B2).

The generated unsmoothed amplitude spectral envelope sequence $\hat{H}(0), \hat{H}(1), \ldots, \hat{H}(N-1)$ is outputted to the decoding portion 34.

In this way, the unsmoothed amplitude spectral envelope sequence generating portion 32 obtains an unsmoothed spectral envelope sequence, which is a sequence obtained by raising a sequence of an amplitude spectral envelope corresponding to coefficients transformable to linear prediction coefficients generated by the linear prediction coefficient decoding portion 31 to the power of $1/\eta$.

<Smoothed Amplitude Spectral Envelope Sequence Generating Portion 33>

The decoded parameter $\eta$ determined by the parameter decoding portion 37 and the decoded linear prediction coefficients $\hat{\beta}_1, \hat{\beta}_2, \ldots, \hat{\beta}_p$ obtained by the linear prediction coefficient decoding portion 31 are inputted to the smoothed amplitude spectral envelope sequence generating portion 33.

The smoothed amplitude spectral envelope sequence generating portion 33 generates a smoothed amplitude spectral envelope sequence $\hat{H}_\gamma(\mathbf{0}), \hat{H}_\gamma(\mathbf{1}), \ldots, \hat{H}_\gamma(N-1)$, which is a sequence obtained by reducing amplitude unevenness of a sequence of an amplitude spectral envelope corresponding to the decoded linear prediction coefficients $\hat{\beta}_1, \hat{\beta}_2, \ldots, \hat{\beta}_p$, by the above expression A(3) (step B3).

The generated smoothed amplitude spectral envelope sequence $\hat{H}_\gamma(\mathbf{0}), \hat{H}_\gamma(\mathbf{1}), \ldots, \hat{H}_\gamma(N)$ is outputted to the decoding portion 34 and the envelope denormalizing portion 35.

<Decoding Portion 34>

The decoded parameter $\eta$ determined by the parameter decoding portion 37, codes corresponding to the normalized MDCT coefficient sequence outputted by the encoding apparatus, the unsmoothed amplitude spectral envelope sequence $\hat{H}(\mathbf{0}), \hat{H}(\mathbf{1}), \ldots, \hat{H}(N-1)$ generated by the unsmoothed amplitude spectral envelope generating portion 32 and the smoothed amplitude spectral envelope sequence $\hat{H}_\gamma(\mathbf{0}), \hat{H}_\gamma(\mathbf{1}), \ldots, \hat{H}_\gamma(N-1)$ generated by the smoothed amplitude spectral envelope generating portion 33 are inputted to the decoding portion 34.

The decoding portion 34 is provided with a variance parameter determining portion 342.

Figure 11:
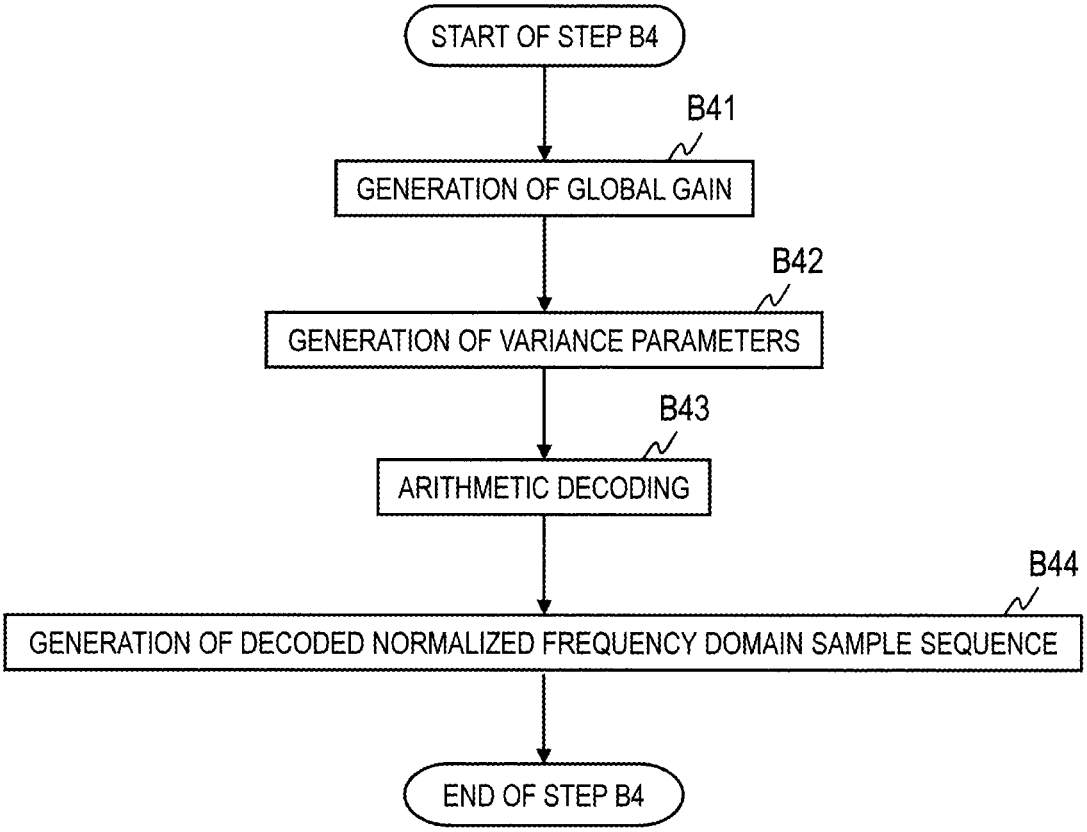
FIG. 11 is a flowchart for illustrating an example of a process of a decoding portion.

The decoding portion 34 performs decoding, for example, by performing processes of steps B41 to B44 shown in FIG. 11 (step B4). That is, for each frame, the decoding portion 34 decodes a gain code comprised in the codes corresponding to the inputted normalized MDCT coefficient sequence to obtain a global gain g (step B41). The variance parameter determining portion 342 of the decoding portion 34 determines each variance parameter of a variance parameter sequence $\varphi(\mathbf{0}), \varphi(\mathbf{1}), \ldots, \varphi(N-1)$ from the global gain g, the unsmoothed amplitude spectral envelope sequence $\hat{H}(\mathbf{0}), \hat{H}(\mathbf{1}), \ldots, \hat{H}(N-1)$ and the smoothed amplitude spectral envelope sequence $\hat{H}_\gamma(\mathbf{0}), \hat{H}_\gamma(\mathbf{1}), \ldots, \hat{H}_\gamma(N-1)$ by the above expression (A1) (step B42). The decoding portion 34 obtains a decoded normalized coefficient sequence $\hat{X}_Q(\mathbf{0}), \hat{X}_Q(\mathbf{1}), \ldots, \hat{X}_Q(N-1)$ by performing arithmetic decoding of integer signal codes comprised in the codes corresponding to the normalized MDCT coefficient sequence in accordance with an arithmetic decoding configuration corresponding to the variance parameters of the variance parameter sequence $\varphi(\mathbf{0}), \varphi(\mathbf{1}), \ldots, \varphi(N-1)$ (step B43) and generates a decoded normalized MDCT coefficient sequence $\hat{X}_N(\mathbf{0}), \hat{X}_N(\mathbf{1}), \ldots, \hat{X}_N(N-1)$ by multiplying each coefficient of the decoded normalized coefficient sequence $\hat{X}_Q(\mathbf{0}), \hat{X}_Q(\mathbf{1}), \ldots, \hat{X}_Q(N-1)$ by the global gain g (step B44). Thus, the decoding portion 34 may decode inputted integer signal codes in accordance with bit allocation which substantially changes based on an unsmoothed spectral envelope sequence.

When encoding is performed by the process described in [Modification of encoding portion 26], the decoding portion 34 performs, for example, the following process. For each frame, the decoding portion 34 decodes a gain code comprised in the codes corresponding to an inputted normalized MDCT coefficient sequence to obtain a global gain g. The variance parameter determining portion 342 of the decoding portion 34 determines each variance parameter of a variance parameter sequence $\varphi(\mathbf{0}), \varphi(\mathbf{1}), \ldots, \varphi(N-1)$ from an unsmoothed amplitude spectral envelope sequence $\hat{H}(\mathbf{0}), \hat{H}(\mathbf{1}), \ldots, \hat{H}(N-1)$ and a smoothed amplitude spectral envelope sequence $\hat{H}_\gamma(\mathbf{0}), \hat{H}_\gamma(\mathbf{1}), \ldots, \hat{H}_\gamma(N-1)$ by the above expression (A9). The decoding portion 34 can determine b(k) by the expression (A10) based on each variance parameter $\varphi(k)$ of the variance parameter sequence $\varphi(\mathbf{0}), \varphi(\mathbf{1}), \ldots, \varphi(N-1)$. The decoding portion 34 obtains a decoded normalized coefficient sequence $\hat{X}_Q(\mathbf{0}), \hat{X}_Q(\mathbf{1}), \ldots, \hat{X}_Q(N-1)$ by sequentially decoding values of $\hat{X}_Q(k)$ with the number of bits b(k), and generates a decoded normalized MDCT coefficient sequence $\hat{X}_N(\mathbf{0}), \hat{X}_N(\mathbf{1}), \ldots, \hat{X}_N(N-1)$ by multiplying each coefficient of the decoded normalized coefficient sequence $\hat{X}_Q(\mathbf{0}), \hat{X}_Q(\mathbf{1}), \ldots, \hat{X}_Q(N-1)$ by the global gain g. Thus, the decoding portion 34 may decode inputted integer signal codes in accordance with bit allocation which changes based on an unsmoothed spectral envelope sequence.

The decoded normalized MDCT coefficient sequence $\hat{X}_N(\mathbf{0}), \hat{X}_N(\mathbf{1}), \ldots, \hat{X}_N(N-1)$ which has been generated is outputted to the envelope denormalizing portion 35.

<Envelope Denormalizing Portion 35>

The smoothed amplitude spectral envelope sequence $\hat{H}_\gamma(\mathbf{0}), \hat{H}_\gamma(\mathbf{1}), \ldots, \hat{H}_\gamma(N-1)$ generated by the smoothed amplitude spectral envelope generating portion 33 and the decoded normalized MDCT coefficient sequence $\hat{X}_N(\mathbf{0}), \hat{X}_N(\mathbf{1}), \ldots, \hat{X}_N(N-1)$ generated by the decoding portion 34 are inputted to the envelope denormalizing portion 35.

The envelope denormalizing portion 35 generates a decoded MDCT coefficient sequence $\hat{X}(\mathbf{0}), \hat{X}(\mathbf{1}), \ldots, \hat{X}(N-1)$ by denormalizing the decoded normalized MDCT coefficient sequence $\hat{X}_N(\mathbf{0}), \hat{X}_N(\mathbf{1}), \ldots, \hat{X}_N(N-1)$ using the smoothed amplitude spectral envelope sequence $\hat{H}_\gamma(\mathbf{0}), \hat{H}_\gamma(\mathbf{1}), \ldots, \hat{H}_\gamma(N-1)$ (step B5).

The generated decoded MDCT coefficient sequence $\hat{X}(\mathbf{0}), \hat{X}(\mathbf{1}), \ldots, \hat{X}(N-1)$ is outputted to the time domain transforming portion 36.

For example, the envelope denormalizing portion 35 generates the decoded MDCT coefficient sequence $\hat{X}(\mathbf{0}), \hat{X}(\mathbf{1}), \ldots, \hat{X}(N-1)$ by multiplying coefficients $\hat{X}_N(k)$ of the decoded normalized MDCT coefficient sequence $\hat{X}_N(\mathbf{0}), \hat{X}_N(\mathbf{1}), \ldots, \hat{X}_N(N-1)$ by envelope values $\hat{H}_\gamma(k)$ of the smoothed amplitude spectral envelope sequence $\hat{H}_\gamma(\mathbf{0}), \hat{H}_\gamma(\mathbf{1}), \ldots, \hat{H}_\gamma(N-1)$, respectively, on the assumption of k=0, 1, . . . ,N−1. That is, $\hat{X}(k)=\hat{X}_N(k)\times\hat{H}_\gamma(k)$ is satisfied on the assumption of k=0, 1, . . . ,N−1.

<Time Domain Transforming Portion 36>

The MDCT coefficient sequence $\hat{X}(\mathbf{0}), \hat{X}(\mathbf{1}), \ldots, \hat{X}(N-1)$ generated by the envelope denormalizing portion 35 is inputted to the time domain transforming portion 36.

For each frame, the time domain transforming portion 36 transforms the decoded MDCT coefficient sequence $\hat{X}(\mathbf{0}), \hat{X}(\mathbf{1}), \ldots, \hat{X}(N-1)$ obtained by the envelope denormalizing portion 35 to a time domain and obtains a sound signal (a decoded sound signal) for each frame (step B6).

In this way, the decoding apparatus obtains a time-series signal by decoding in the frequency domain.

Second Embodiment

In the encoding apparatus and method of the first embodiment, encoding is performed for each of a plurality of parameters η to generate a code, an optimal code is selected from among the codes generated for the parameters η, and a selected code and a parameter code corresponding to the selected code are outputted.

In comparison, in an encoding apparatus and method of a second embodiment, a parameter determining portion 27 decides a parameter η first, and encoding is performed based on the determined parameter η to generate and output codes. In the second embodiment, the parameter η is changeable for each predetermined time section by the parameter determining portion 27. Here, that the parameter η is changeable for each predetermined time section means that the parameter η can change when the predetermined time section changes, and it is assumed that the value of the parameter η does not change in the same time section.

Description will be made below mainly on parts different from the first embodiment. As for parts similar to the first embodiment, redundant description will be omitted.

(Encoding)

Figure 12:
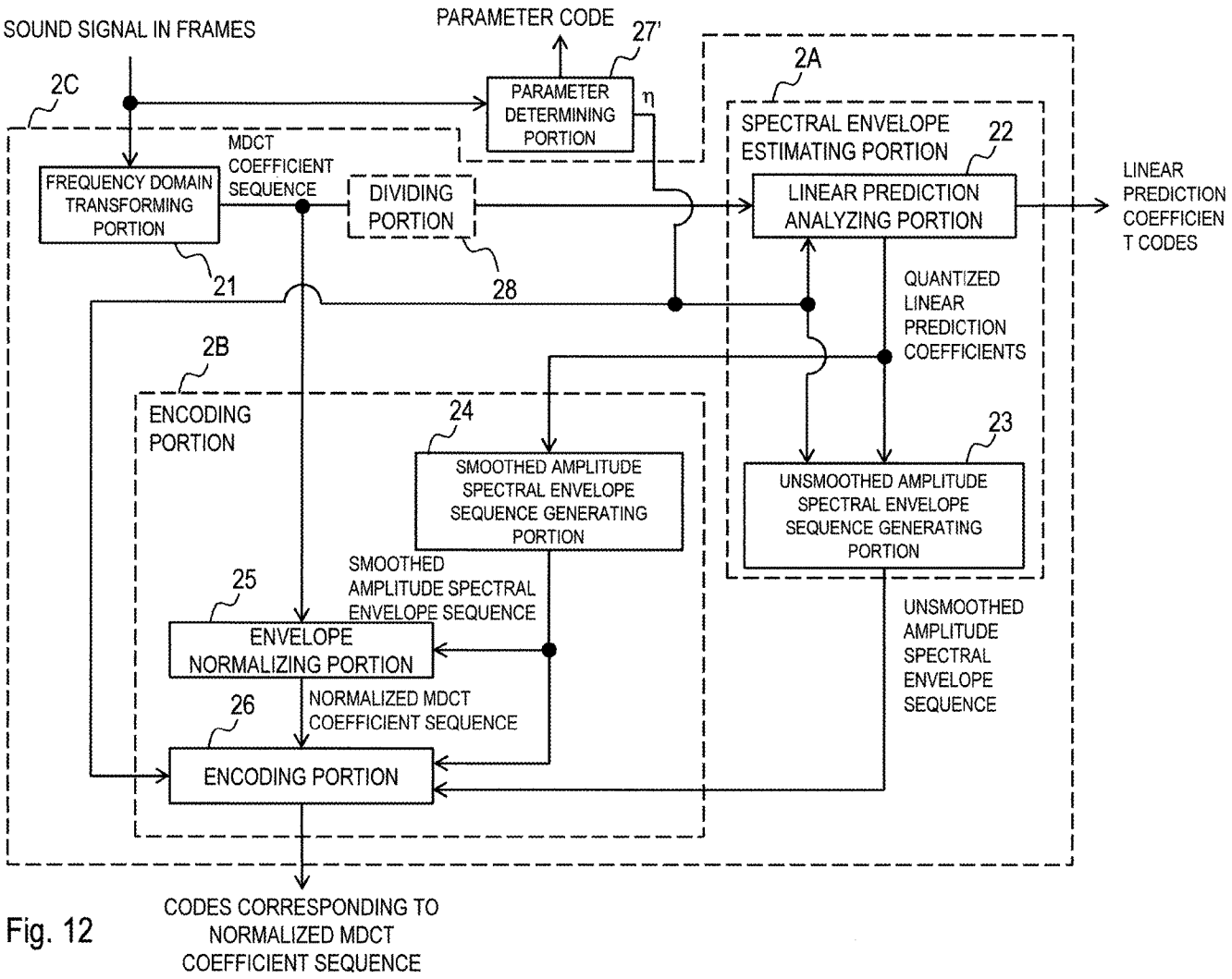
FIG. 12 is a block diagram for illustrating an example of the encoding apparatus.
Figure 13:
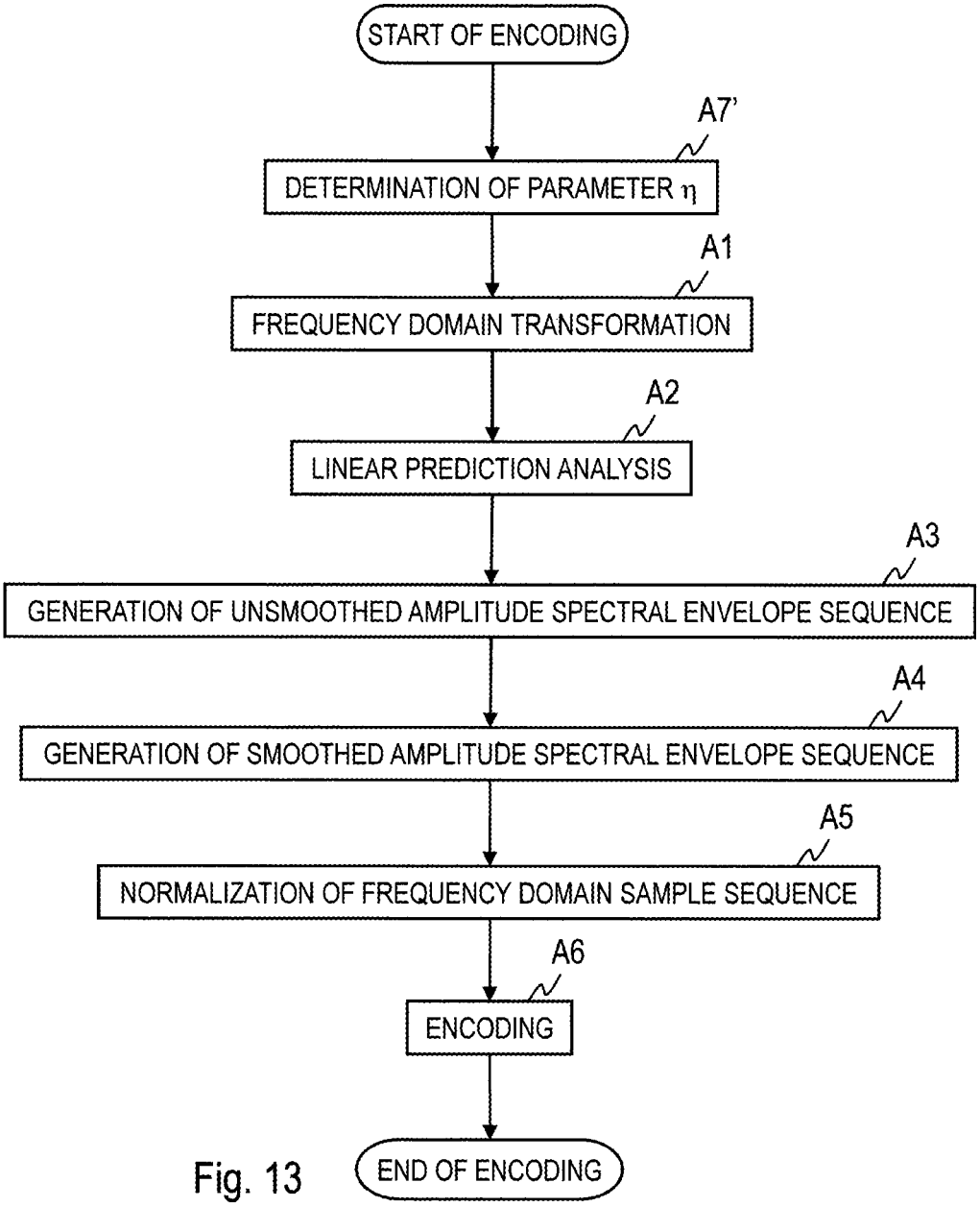
FIG. 13 is a flowchart for illustrating an example of the encoding method.

A configuration example of the encoding apparatus of the second embodiment is shown in FIG. 12. As shown in FIG. 12, the encoding apparatus is provided with, for example, a frequency domain transforming portion 21, a linear prediction analyzing portion 22, an unsmoothed amplitude spectral envelope sequence generating portion 23, a smoothed amplitude spectral envelope sequence generating portion 24, an envelope normalizing portion 25, an encoding portion 26 and a parameter determining portion 27'. An example of each process of an encoding method realized by this encoding apparatus is shown in FIG. 13.

Each portion in FIG. 12 will be described below.

<Parameter Determining Portion 27'>

A time domain sound signal, which is a time-series signal, is inputted to the parameter determining portion 27'. An example of the sound signal is a voice digital signal or an acoustic digital signal.

The parameter determining portion 27' decides a parameter η based on the inputted time-series signal by the process to be described later (step A7').

The η determined by the parameter determining portion 27' is outputted to the linear prediction analyzing portion 22, the unsmoothed amplitude spectral envelope estimating portion 23, the smoothed amplitude spectral envelope estimating portion 24 and the encoding portion 26.

Further, the parameter determining portion 27' generates a parameter code by encoding the determined η. The generated parameter code is transmitted to a decoding apparatus.

Details of the parameter determining portion 27' will be described later.

The frequency domain transforming portion 21, the linear prediction analyzing portion 22, the unsmoothed amplitude spectral envelope sequence generating portion 23, the smoothed amplitude spectral envelope sequence generating portion 24, the envelope normalizing portion 25 and the encoding portion 26 generate codes by a process similar to that of the first embodiment based on the parameter η determined by the parameter determining portion 27' (steps A1 to A6). In this example, the code is a combination of a linear prediction coefficient code, a gain code and an integer signal code. The generated code is transmitted to the decoding apparatus.

Figure 14:
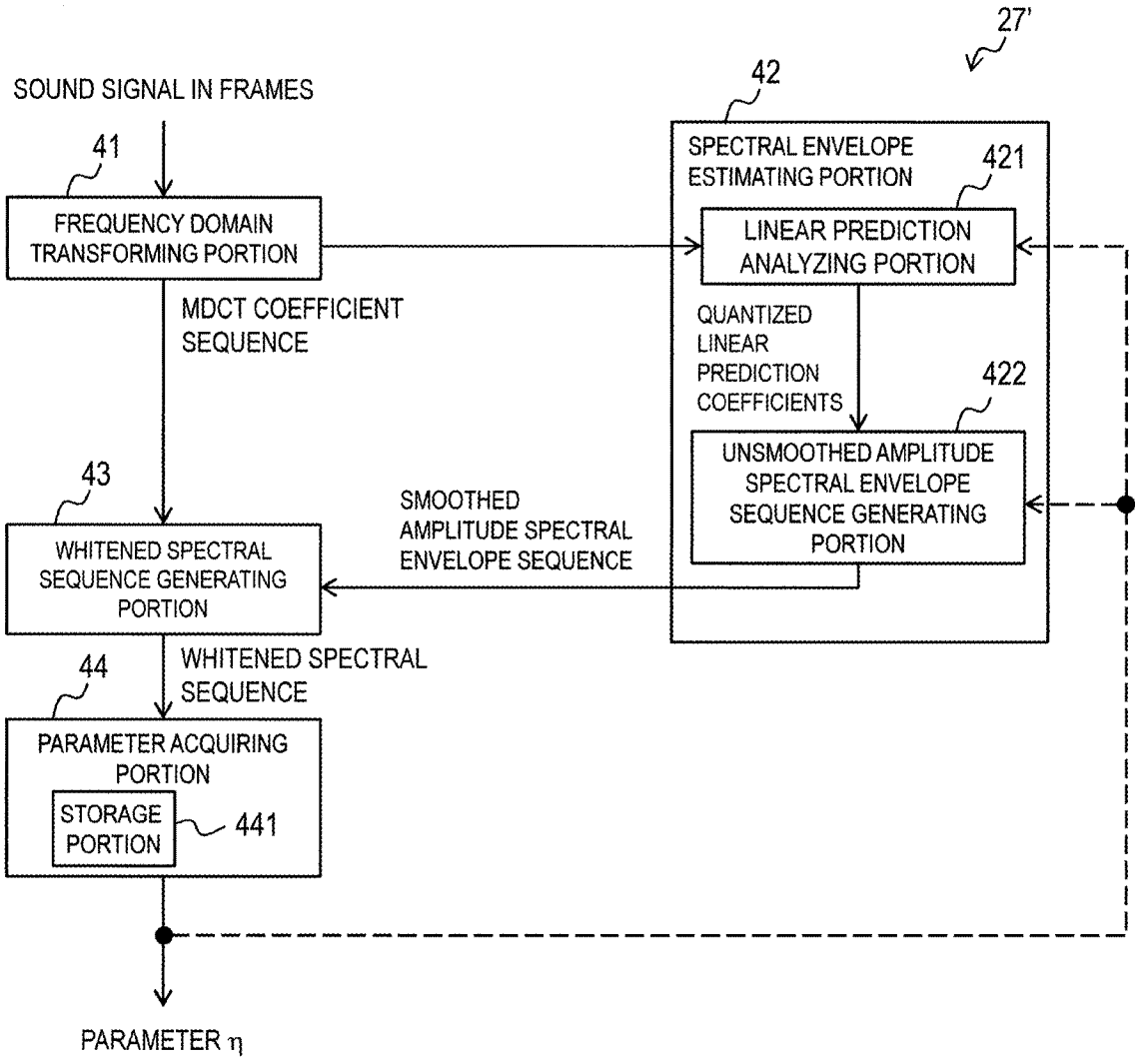
FIG. 14 is a block diagram for illustrating an example of a parameter determining portion.
Figure 15:
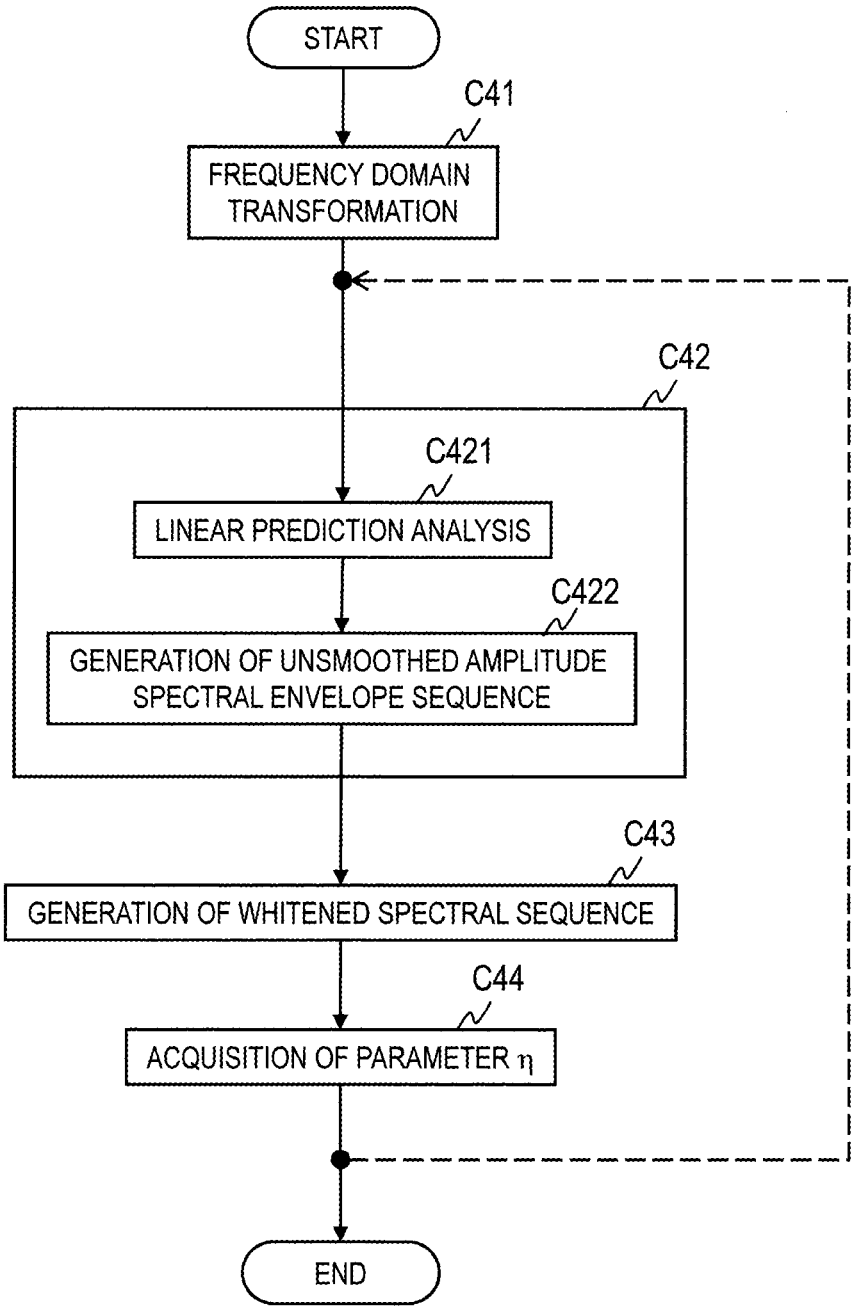
FIG. 15 is a flowchart for illustrating an example of a parameter decision method.

A configuration example of the parameter determining portion 27' is shown in FIG. 14. As shown in FIG. 14, the parameter determining portion 27' is provided with, for example, a frequency domain transforming portion 41, a spectral envelope estimating portion 42, a whitened spectral sequence generating portion 43 and a parameter acquiring portion 44. The spectral envelope estimating portion 42 is provided with, for example, a linear prediction analyzing portion 421 and an unsmoothed amplitude spectral envelope sequence generating portion 422. For example, an example of each process of a parameter decision method realized by this parameter determining portion 27' is shown in FIG. 2.

Each portion in FIG. 14 will be described below.

<Frequency Domain Transforming Portion 41>

A time domain sound signal, which is a time-series signal, is inputted to the frequency domain transforming portion 41. An example of the sound signal is a voice digital signal or an acoustic digital signal.

The frequency domain transforming portion 41 transforms the inputted time domain sound signal to an MDCT coefficient sequence $X(\mathbf{0}),X(\mathbf{1}), \ldots ,X(N-1)$ at an N point in a frequency domain for each frame with a predetermined time length. Here, N indicates a positive integer.

The obtained MDCT coefficient sequence $X(\mathbf{0}),X(\mathbf{1}), \ldots ,X(N-1)$ is outputted to the spectral envelope estimating portion 42 and the whitened spectral sequence generating portion 43.

It is assumed that subsequent processes are performed for each frame unless otherwise stated.

In this way, the frequency domain transforming portion 41 determines a frequency domain sample sequence, which is, for example, an MDCT coefficient sequence, corresponding to the sound signal (step C41).

<Spectral Envelope Estimating Portion 42>

The MDCT coefficient sequence $X(\mathbf{0}),X(\mathbf{1}), \ldots ,X(N-1)$ obtained by the frequency domain transforming portion 41 is inputted to the spectral envelope estimating portion 42.

The spectral envelope estimating portion 42 performs estimation of a spectral envelope using the $\eta_0$-th power of absolute values of the frequency domain sample sequence corresponding to the time-series signal as a power spectrum, based on a parameter $\eta_0$ specified in a predetermined method (step C42).

The estimated spectral envelope is outputted to the whitened spectral sequence generating portion 43.

The spectral envelope estimating portion 42 performs the estimation of the spectral envelope, for example, by generating an unsmoothed amplitude spectral envelope sequence by processes of the linear prediction analyzing portion 421 and the unsmoothed amplitude spectral envelope sequence generating portion 422 described below.

It is assumed that the parameter $\eta_0$ is specified in a predetermined method. For example, it is assumed that $\eta_0$ is a predetermined number larger than 0. For example, $\eta_0=1$ is assumed. Further, η determined for a frame before a frame for which the parameter η is to be determined currently may be used. The frame before the frame for which the parameter η is to be determined currently (hereinafter referred to as a current frame) is, for example, a frame before the current frame and in the vicinity of the current frame. The frame in the vicinity of the current frame is, for example, a frame immediately before the current frame.

<Linear Prediction Analyzing Portion 421>

The MDCT coefficient sequence $X(\mathbf{0}),X(\mathbf{1}), \ldots ,X(N-1)$ obtained by the frequency domain transforming portion 41 is inputted to the linear prediction analyzing portion 421.

The linear prediction analyzing portion 421 generates linear prediction coefficients $\beta_1,\beta_2, \ldots ,\beta_p$ by performing linear prediction analysis of $\tilde{R}(\mathbf{0}),\tilde{R}(\mathbf{1}), \ldots ,\tilde{R}(N-1)$ defined by the following expression (C1) using the MDCT coefficient sequence X(0),X(1), . . . ,X(N−1), and encodes the generated linear prediction coefficients $\beta_1,\beta_2, \ldots ,\beta_p$ to generate linear prediction coefficient codes and quantized linear prediction coefficients $\hat{\beta}_1,\hat{\beta}_2, \ldots ,\hat{\beta}_p$, which are quantized linear prediction coefficients corresponding to the linear prediction coefficient codes.

[Expression 20]

$$\tilde{R}(k) = \sum_{n=0}^{N-1} |X(n)|^{\eta_0} \exp\left(-j\frac{2\pi kn}{N}\right), \quad k = 0, 1, \ldots , N-1 \tag{C1}$$

The generated quantized linear prediction coefficients $\hat{\beta}_1,\hat{\beta}_2, \ldots ,\hat{\beta}_p$ are outputted to the unsmoothed amplitude spectral envelope sequence generating portion 422.

Specifically, by performing operation corresponding to inverse Fourier transform regarding the $\eta_0$-th power of absolute values of the MDCT coefficient sequence X(0),X(1), . . . ,X(N−1) as a power spectrum, that is, the operation of the expression (C1) first, the linear prediction analyzing portion 421 determines a pseudo correlation function signal sequence $\tilde{R}(0),\tilde{R}(1), \ldots ,\tilde{R}(N-1)$, which is a time domain signal sequence corresponding to the η-th power of the absolute values of the MDCT coefficient sequence X(0),X(1), . . . ,X(N−1). Then, the linear prediction analyzing portion 421 performs linear prediction analysis using the determined pseudo correlation function signal sequence $\tilde{R}(0),\tilde{R}(1), \ldots ,\tilde{R}(N-1)$ to generate linear prediction coefficients $\beta_1,\beta_2, \ldots ,\beta_p$. Then, by encoding the generated linear prediction coefficients $\beta_1,\beta_2, \ldots ,\beta_p$, the linear prediction analyzing portion 421 obtains linear prediction coefficient codes and quantized linear prediction coefficients $\hat{\beta}_1,\hat{\beta}_2, \ldots ,\hat{\beta}_p$ corresponding to the linear prediction coefficient codes.

The linear prediction coefficients $\beta_1,\beta_2, \ldots ,\beta_p$ are linear prediction coefficients corresponding to a time domain signal when the $\eta_0$-th power of the absolute values of the MDCT coefficient sequence X(0),X(1), . . . ,X(N−1) are regarded as a power spectrum.

Generation of the linear prediction coefficient codes by the linear prediction analyzing portion 421 is performed, for example, by a conventional encoding technique. The conventional encoding technique is, for example, an encoding technique in which a code corresponding to a linear prediction coefficient itself is caused to be a linear prediction coefficient code, an encoding technique in which a linear prediction coefficient is transformed to an LSP parameter, and a code corresponding to the LSP parameter is caused to be a linear prediction coefficient code, an encoding technique in which a linear prediction coefficient is transformed to a PARCOR coefficient, and a code corresponding to the PARCOR coefficient is caused to be a linear prediction code, or the like.

In this way, the linear prediction analyzing portion 421 performs linear prediction analysis using a pseudo correlation function signal sequence obtained by performing inverse Fourier transform regarding the η-th power of absolute values of a frequency domain sample sequence, which is, for example, an MDCT coefficient sequence, as a power spectrum, and generates coefficients transformable to linear prediction coefficients (step C421).

<Unsmoothed Amplitude Spectral Envelope Sequence Generating Portion 422>

The quantized linear prediction coefficients $\hat{\beta}_1,\hat{\beta}_2, \ldots ,\hat{\beta}_p$ generated by the linear prediction analyzing portion 421 are inputted to the unsmoothed amplitude spectral envelope sequence generating portion 422.

The unsmoothed amplitude spectral envelope sequence generating portion 422 generates an unsmoothed amplitude spectral envelope sequence $\hat{H}(0),\hat{H}(1), \ldots ,\hat{H}(N-1)$, which is a sequence of an amplitude spectral envelope corresponding to the quantized linear prediction coefficients $\hat{\beta}_1,\hat{\beta}_2, \ldots ,\hat{\beta}_p$.

The generated unsmoothed amplitude spectral envelope sequence $\hat{H}(0),\hat{H}(1), \ldots ,\hat{H}(N-1)$ is outputted to the whitened spectral sequence generating portion 43.

The unsmoothed amplitude spectral envelope sequence generating portion 422 generates an unsmoothed amplitude spectral envelope sequence $\hat{H}(0),\hat{H}(1), \ldots ,\hat{H}(N-1)$ defined by the following expression (C2) as the unsmoothed amplitude spectral envelope sequence $\hat{H}(0),\hat{H}(1), \ldots ,\hat{H}(N-1)$ using the quantized linear prediction coefficients $\hat{\beta}_1,\hat{\beta}_2, \ldots ,\hat{\beta}_p$.

[Expression 21]

$$\hat{H}(k) = \left(\frac{1}{2\pi}\frac{1}{\left|1+\sum_{n=1}^{p}\hat{\beta}_n \exp(-j2\pi kn/N)\right|^2}\right)^{1/\eta_0} \tag{C2}$$

In this way, the unsmoothed amplitude spectral envelope sequence generating portion 422 performs estimation of a spectral envelope by obtaining an unsmoothed spectral envelope sequence, which is a sequence of an amplitude spectral envelope corresponding to a pseudo correlation function signal sequence raised to the power of $1/\eta_0$, based on coefficients transformable to linear prediction coefficients generated by the linear prediction analyzing portion 421 (step C422).

<Whitened Spectral Sequence Generating Portion 43>

The MDCT coefficient sequence X(0),X(1), . . . ,X(N−1) obtained by the frequency domain transforming portion 41 and the unsmoothed amplitude spectral envelope sequence $\hat{H}(0),\hat{H}(1), \ldots ,\hat{H}(N-1)$ generated by the unsmoothed amplitude spectral envelope sequence generating portion 422 are inputted to the whitened spectral sequence generating portion 43.

The whitened spectral sequence generating portion 43 generates a whitened spectral sequence $X_W(0),X_W(1), \ldots ,X_W(N-1)$ by dividing coefficients of the MDCT coefficient sequence X(0),X(1), . . . ,X(N−1) by corresponding values of the unsmoothed amplitude spectral envelope sequence $\hat{H}(0),\hat{H}(1), \ldots ,\hat{H}(N-1)$, respectively.

The generated whitened spectral sequence $X_W(0),X_W(1), \ldots ,X_W(N-1)$ is outputted to the parameter acquiring portion 44.

The whitened spectral sequence generating portion 43 generates each of values $X_W(k)$ of the whitened spectral sequence $X_W(0),X_W(1), \ldots ,X_W(N-1)$ by dividing coefficients X(k) of the MDCT coefficient sequence X(0),X(1), . . . ,X(N−1) by values $\hat{H}(k)$ of the unsmoothed amplitude spectral envelope sequence $\hat{H}(0),\hat{H}(1), \ldots ,\hat{H}(N-1)$, respectively, for example, on the assumption of k=0, 1, . . . ,N−1. That is, $X_W(k)=X(k)/\hat{H}(k)$ is satisfied on the assumption of k=0, 1, . . . ,N−1.

In this way, the whitened spectral sequence generating portion 43 obtains a whitened spectral sequence which is a sequence obtained by dividing a frequency domain sample sequence which is, for example, an MDCT coefficient sequence by a spectral envelope which is, for example, an unsmoothed amplitude spectral envelope sequence (step C43).

<Parameter Acquiring Portion 44>

The whitened spectral sequence $X_W(0), X_W(1), \ldots, X_W(N-1)$ generated by the whitened spectral sequence generating portion 43 is inputted to the parameter acquiring portion 44.

The parameter acquiring portion 44 determines such a parameter η that generalized Gaussian distribution with the parameter as a shape parameter approximates a histogram of the whitened spectral sequence $X_W(0), X_W(1), \ldots, X_W(N-1)$ (step C44). In other words, the parameter acquiring portion 44 decides such a parameter η that generalized Gaussian distribution with the parameter η as a shape parameter is close to distribution of the histogram of the whitened spectral sequence $X_W(0), X_W(1), \ldots, X_W(N-1)$.

The generalized Gaussian distribution with the parameter η as a shape parameter is defined, for example, as shown below. Here, Γ indicates a gamma function.

[Expression 22]

$$f_{GG}(X \mid \phi, \eta) = \frac{A(\eta)}{\phi}\exp\left(-\left|B(\eta)\frac{X}{\phi}\right|^{\eta}\right),$$

$$A(\eta) = \frac{\eta B(\eta)}{2\Gamma(1/\eta)},$$

$$B(\eta) = \sqrt{\frac{\Gamma(3/\eta)}{\Gamma(1/\eta)}},$$

$$\Gamma(x) = \int_0^{\infty} e^{-t}t^{x-1}\,dt$$

The generalized Gaussian distribution is such that makes it possible to express various distributions by changing η which is a shape parameter. For example, Laplace distribution and Gaussian distribution are expressed at the time of η=1 and at the time of η=2, respectively, as shown in FIG. 3. Here, φ is a parameter corresponding to variance.

Here, η determined by the parameter acquiring portion 44 is defined, for example, by an expression (C3) below. Here, $F^{-1}$ is an inverse function of a function F. This expression is derived from a so-called moment method.

[Expression 23]

$$\eta = F^{-1}\left(\frac{m_1}{\sqrt{m_2}}\right) \tag{C3}$$

$$F(\eta) = \frac{\Gamma(2/\eta)}{\sqrt{\Gamma(1/\eta)\Gamma(3/\eta)}}$$

$$m_1 = \frac{1}{N}\sum_{k=0}^{N-1}|X_W(k)|,$$

$$m_2 = \frac{1}{N}\sum_{k=0}^{N-1}|X_W(k)|^2$$

When the inverse function $F^{-1}$ is explicitly defined, the parameter acquiring portion 44 can determine the parameter η by calculating an output value when a value of $m_1/((m_2)^{1/2})$ is inputted to the explicitly defined inverse function $F^{-1}$.

When the inverse function $F^{-1}$ is not explicitly defined, the parameter acquiring portion 44 may determine the parameter η by a first method or a second method described below, in order to calculate a value of η defined by the expression (C3).

The first method for determining the parameter η will be described. In the first method, the parameter acquiring portion 44 calculates $m_1/((m_2)^{1/2})$ based on a whitened spectral sequence and, by referring to a plurality of different pairs of η and F(η) corresponding to η prepared in advance, obtains η corresponding to F(η) which is the closest to the calculated $m_1/((m_2)^{1/2})$.

The plurality of different pairs of η and F(η) corresponding to η prepared in advance are stored in a storage portion 441 of the parameter acquiring portion 44 in advance. The parameter acquiring portion 44 finds F(η) closest to the calculated $m_1/((m_2)^{1/2})$ by referring to the storage portion 441, and reads η corresponding to the found F(η) from the storage portion 441 and outputs it.

Here, F(η) closest to the calculated $m_1/((m_2)^{1/2})$ refers to such F(η) that an absolute value of a difference from the calculated $m_1/((m_2)^{1/2})$ is the smallest.

The second method for determining the parameter η will be described. In the second method, on the assumption that an approximate curve function of the inverse function $F^{-1}$ is, for example, $\tilde{F}^{-1}$ indicated by an expression (C3') below, the parameter acquiring portion 44 calculates $m_1/((m_2)^{1/2})$ based on a whitened spectral sequence and determines η by calculating an output value when the calculated $m_1/((m_2)^{1/2})$ is inputted to the approximate curve function $\tilde{F}^{-1}$.

Note that η determined by the parameter acquiring portion 44 may be defined not by the expression (C3) but by an expression obtained by generalizing the expression (C3) using positive integers q1 and q2 specified in advance (q1<q2) like an expression (C3").

[Expression 24]

$$\eta = F'^{-1}\left(\frac{m_{q_1}}{(m_{q_2})^{q_1/q_2}}\right) \tag{C3''}$$

$$F'(\eta) = \frac{\Gamma((q_1+1)/\eta)}{(\Gamma(1/\eta))^{1-q_1/q_2}(\Gamma((q_2+1)/\eta))^{q_1/q_2}}$$

$$m_{q_1} = \frac{1}{N}\sum_{k=0}^{N-1}|X_W(k)|^{q_1},$$

$$m_{q_2} = \frac{1}{N}\sum_{k=0}^{N-1}|X_W(k)|^{q_2}$$

In the case where η is defined by the expression (C3") also, η can be determined in a method similar to the method in the case where is defined by the expression (C3). That is, after calculating a value $m_{q1}/((m_{q2})^{q1/q2})$ based on $m_{q1}$ which is the q1-th order moment of a whitened spectral sequence, and $m_{q2}$ which is the q2-th order moment of the whitened spectral sequence, based on the whitened spectral sequence, for example, the parameter acquiring portion 44 can, by referring to a plurality of different pairs of η and F'(η) corresponding to η prepared in advance, acquirer η corresponding to F'(η) closest to the calculated $m_{q1}/((m_{q0})^{q1/q2})$ or can determine by calculating, on the assumption that an approximate curve function of the inverse function $F'^{-1}$ is $\tilde{F}'^{-1}$, an output value when the calculated $m_{q1}/((m_{q2})^{q1/q2})$ is inputted to the approximate curve function $\tilde{F}^{-1}$, similarly to the first and second methods described above.

As described above, $\eta$ can be said to be a value based on two different moments $m_{q1}$ and $m_{q2}$ in different orders. For example, $\eta$ may be determined based on a value of a ratio between a value of a moment in a lower order between the two different moments $m_{q1}$ and $m_{q2}$ in different orders or a value based on the value of the moment (hereinafter referred to as the former) and a value of a moment in a higher order or a value based on the value of the moment (hereinafter referred to as the latter), or a value based on the value of the ratio, or a value obtained by dividing the former by the latter. The value based on a moment refers to, for example, $m^Q$ when the moment is indicated by m, and a predetermined real number is indicated by Q. Further, $\eta$ may be determined by inputting these values to the approximate curve function $\tilde{F}^{-1}$. It is only necessary that this approximate curve function $\tilde{F}'^{-1}$ is such a monotonically increasing function that an output is a positive value in a used domain similarly as described above.

The parameter determining portion 27' may determine the parameter $\eta$ by a loop process. That is, the parameter determining portion 27' may further perform the processes of the spectral envelope estimating portion 42, the whitened spectral sequence generating portion 43 and the parameter acquiring portion 44 in which the parameter $\eta$ determined by the parameter acquiring portion 44 is a parameter $\eta_0$ specified by a predetermined method once or more times.

In this case, for example, as indicated by a broken line in FIG. 14, the parameter $\eta$ determined by the parameter acquiring portion 44 is outputted to the spectral envelope estimating portion 42. The spectral envelope estimating portion 42 performs a process similar to the process described above to perform estimation of a spectral envelope, using $\eta$ determined by the parameter acquiring portion 44 as the parameter $\eta_0$. The whitened spectral sequence generating portion 43 performs a process similar to the process described above to generate a whitened spectral sequence, based on the newly estimated spectral envelope. The parameter acquiring portion 44 performs a process similar to the process described above to determine a parameter $\eta$, based on the newly generated whitened spectral sequence.

For example, the processes of the spectral envelope estimating portion 42, the whitened spectral sequence generating portion 43 and the parameter acquiring portion 44 may be further performed $\tau$ times, which is a predetermined number of times. Here, $\tau$ is a predetermined positive integer, for example, $\tau=1$ or $\tau=2$.

Further, the spectral envelope estimating portion 42 may repeat the processes of the spectral envelope estimating portion 42, the whitened spectral sequence generating portion 43 and the parameter acquiring portion 44 until an absolute value of a difference between the parameter $\eta$ determined this time and a parameter $\eta$ determined last becomes a predetermined threshold or smaller.

(Decoding)

Since the decoding apparatus and method of the second embodiment are similar to those of the first embodiment, redundant description will be omitted.

Modification of Second Embodiment

Any encoding process is possible if a configuration of the encoding process can be identified at least based on the parameter $\eta$. An encoding process other than the encoding process of the encoding portion 26 may be used.

A modification of the second embodiment in which an encoding process is not limited to the encoding process by the encoding portion 26 will be described below.

(Encoding)

An example of the encoding apparatus and method of the modification of the second embodiment will be described.

Figure 17:
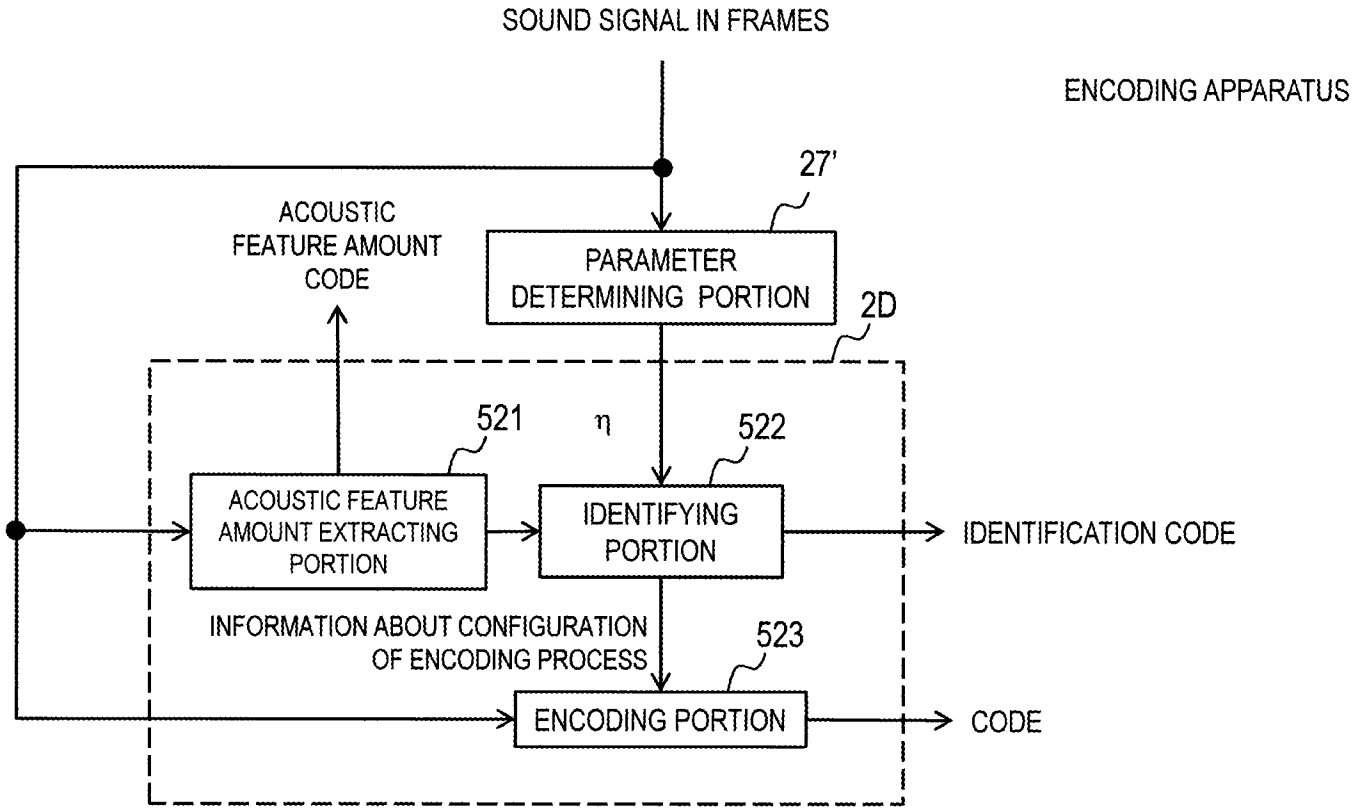
FIG. 17 is a block diagram for illustrating an example of the encoding apparatus.
Figure 18:
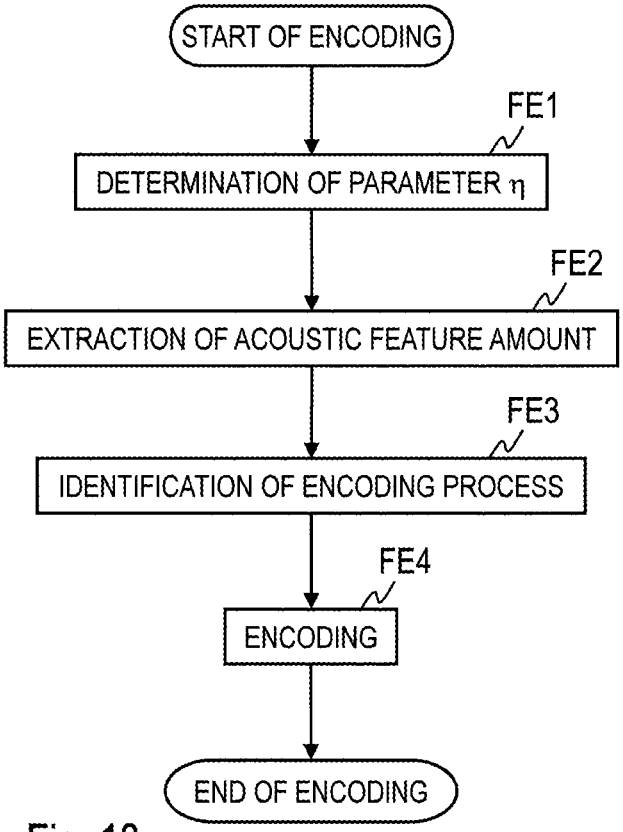
FIG. 18 is a flowchart for illustrating an example of the encoding method.

As shown in FIG. 17, the encoding apparatus of the modification of the second embodiment is, for example, provided with the parameter determining portion 27', an acoustic feature amount extracting portion 521, an identifying portion 522 and an encoding portion 523. The encoding method is realized by each portion of the encoding apparatus performing each process illustrated in FIG. 18.

Each portion of the encoding apparatus will be described below.

<Parameter Determining Portion 27'>

A time domain sound signal in frames, which is a time-series signal, is inputted to the parameter determining portion 27'. An example of the sound signal is a voice digital signal or an acoustic digital signal.

The parameter determining portion 27' decides a parameter $\eta$ based on the inputted time-series signal by a process to be described later (step FE1). The parameter determining portion 27' performs the process for each frame with a predetermined time length. That is, the parameter $\eta$ is determined for each frame.

The parameter $\eta$ determined by the parameter determining portion 27' is outputted to the identifying portion 522.

Figure 21:
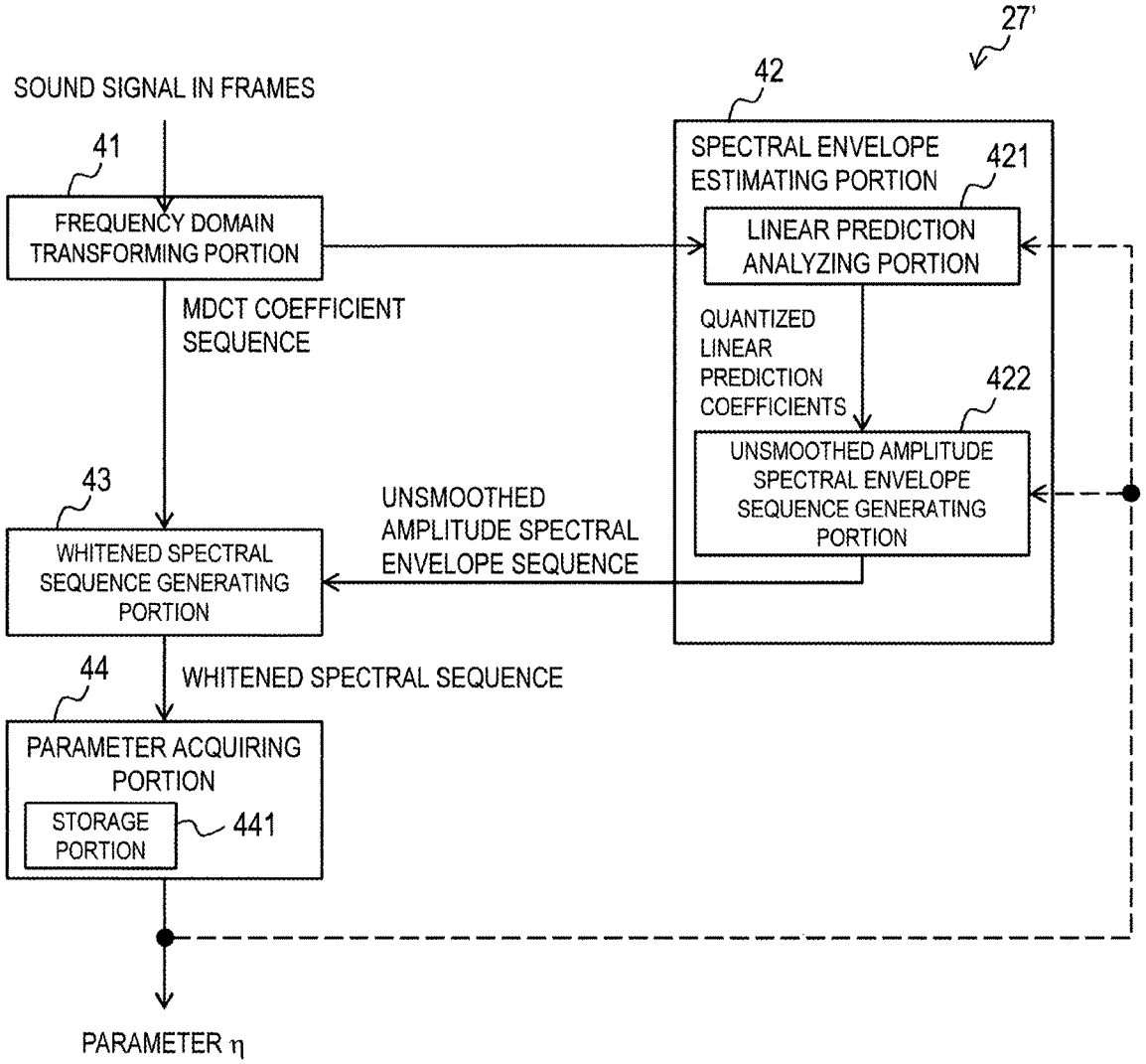
FIG. 21 is a block diagram for illustrating an example of a parameter determining portion.
Figure 22:
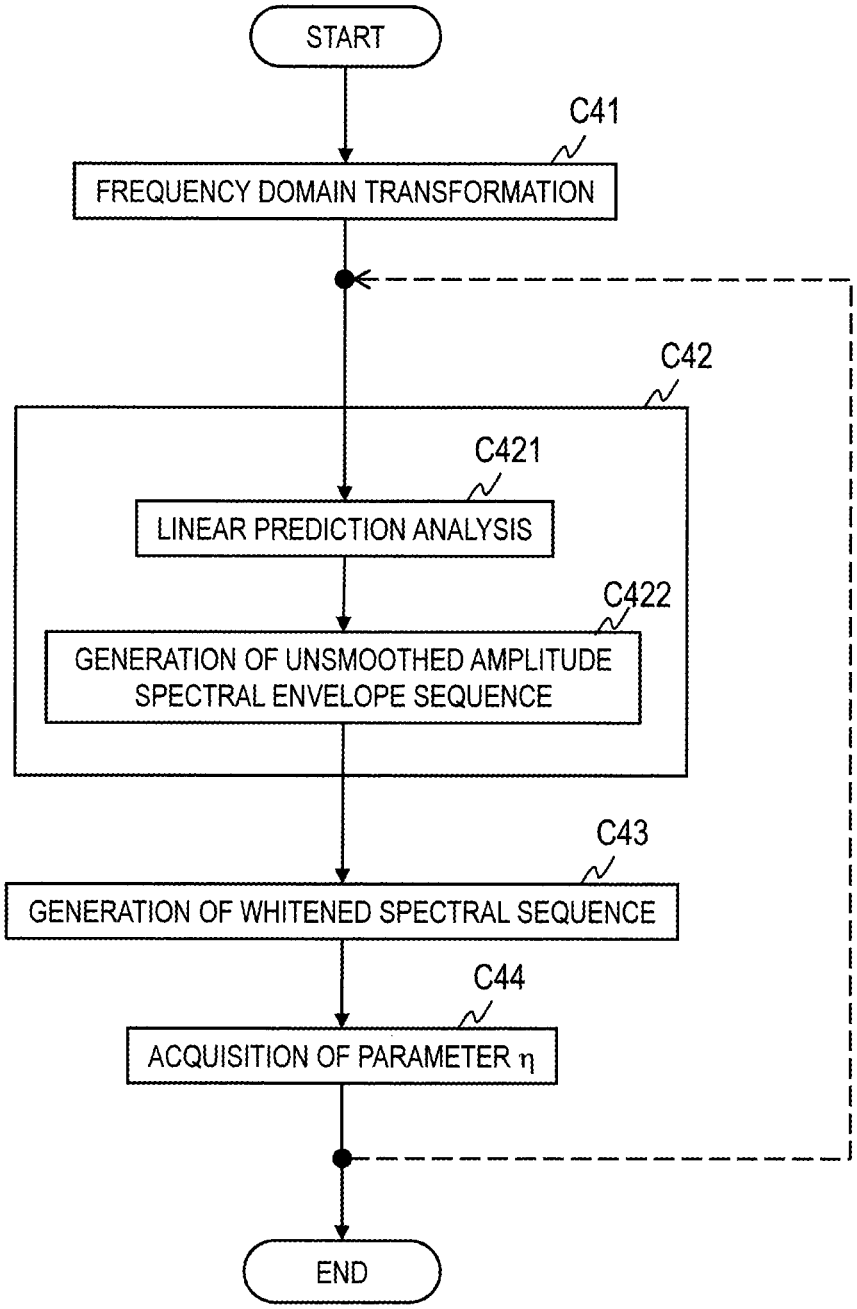
FIG. 22 is a flowchart for illustrating an example of the parameter decision method.

A configuration example of the parameter determining portion 27' is shown in FIG. 21. As shown in FIG. 21, the parameter determining portion 27' is provided with, for example, a frequency domain transforming portion 41, a spectral envelope estimating portion 42, a whitened spectral sequence generating portion 43 and a parameter acquiring portion 44. The spectral envelope estimating portion 42 is provided with, for example, a linear prediction analyzing portion 421 and an unsmoothed amplitude spectral envelope sequence generating portion 422. For example, each process of a parameter decision method realized by this parameter determining portion 27' is shown in FIG. 22.

Each portion in FIG. 21 will be described below.

<Frequency Domain Transforming Portion 41>

A time domain sound signal, which is a time-series signal, is inputted to the frequency domain transforming portion 41.

The frequency domain transforming portion 41 transforms the inputted time domain sound signal to an MDCT coefficient sequence X(0),X(1), . . . ,X(N−1) at an N point in a frequency domain for each frame with a predetermined time length. Here, N indicates a positive integer.

The obtained MDCT coefficient sequence X(0),X(1), . . . ,X(N−1) is outputted to the spectral envelope estimating portion 42 and the whitened spectral sequence generating portion 43.

It is assumed that subsequent processes are performed for each frame unless otherwise stated.

In this way, the frequency domain transforming portion 41 determines a frequency domain sample sequence, which is, for example, an MDCT coefficient sequence, corresponding to the time-series signal (step C41).

<Spectral Envelope Estimating Portion 42>

The MDCT coefficient sequence X(0),X(1), . . . ,X(N−1) obtained by the frequency domain transforming portion 41 is inputted to the spectral envelope estimating portion 42.

The spectral envelope estimating portion 42 performs estimation of a spectral envelope using the $\eta_0$-th power of absolute values of the frequency domain sample sequence corresponding to the time-series signal as a power spectrum, based on a parameter $\eta_0$ specified in a predetermined method (step C42).

The estimated spectral envelope is outputted to the whitened spectral sequence generating portion 43.

The spectral envelope estimating portion 42 performs the estimation of the spectral envelope, for example, by generating an unsmoothed amplitude spectral envelope sequence by processes of the linear prediction analyzing portion 421 and the unsmoothed amplitude spectral envelope sequence generating portion 422 described below.

It is assumed that the parameter $\eta_0$ is specified in a predetermined method. For example, it is assumed that $\eta_0$ is a predetermined number larger than 0. For example, $\eta_0=1$ is assumed. Further, $\eta$ determined for a frame before a frame for which the parameter $\eta$ is to be determined currently may be used. The frame before the frame for which the parameter $\eta$ is to be determined currently (hereinafter referred to as a current frame) is, for example, a frame before the current frame and in the vicinity of the current frame. The frame in the vicinity of the current frame is, for example, a frame immediately before the current frame.

<Linear Prediction Analyzing Portion 421>

The MDCT coefficient sequence X(0),X(1), . . . ,X(N−1) obtained by the frequency domain transforming portion 41 is inputted to the linear prediction analyzing portion 421.

The linear prediction analyzing portion 421 generates linear prediction coefficients $\beta_1,\beta_2, \ldots ,\beta_p$ by performing linear prediction analysis of ~R(0),~R(1), . . . ,~R(N−1) defined by the following expression (C1) using the MDCT coefficient sequence X(0),X(1), . . . ,X(N−1), and encodes the generated linear prediction coefficients $\beta_1,\beta_2, \ldots ,\beta_p$ to generate linear prediction coefficient codes and quantized linear prediction coefficients $\hat{\beta}_1,\hat{\beta}_2, \ldots ,\hat{\beta}_p$, which are quantized linear prediction coefficients corresponding to the linear prediction coefficient codes.

[Expression 25]

$$\tilde{R}(k) = \sum_{n=0}^{N-1} |X(n)|^{\eta_0} \exp\left(-j\frac{2\pi kn}{N}\right), \quad k = 0, 1, \ldots, N-1 \tag{C1}$$

The generated quantized linear prediction coefficients $\hat{\beta}_1,\hat{\beta}_2, \ldots ,\hat{\beta}_p$ are outputted to the unsmoothed amplitude spectral envelope sequence generating portion 422.

Specifically, by performing operation corresponding to inverse Fourier transform regarding the $\eta_0$-th power of absolute values of the MDCT coefficient sequence X(0),X(1), . . . ,X(N−1) as a power spectrum, that is, the operation of the expression (C1) first, the linear prediction analyzing portion 421 determines a pseudo correlation function signal sequence ~R(0),~R(1), . . . ,~R(N−1), which is a time domain signal sequence corresponding to the $\eta_0$-th power of the absolute values of the MDCT coefficient sequence X(0),X(1), . . . ,X(N−1). Then, the linear prediction analyzing portion 421 performs linear prediction analysis using the determined pseudo correlation function signal sequence ~R(0),~R(1), . . . ,~R(N−1) to generate linear prediction coefficients $\beta_1,\beta_2, \ldots ,\beta_p$. Then, by encoding the generated linear prediction coefficients $\beta_1,\beta_2, \ldots ,\beta_p$, the linear prediction analyzing portion 421 obtains linear prediction coefficient codes and quantized linear prediction coefficients $\hat{\beta}_1,\hat{\beta}_2, \ldots ,\hat{\beta}_p$ corresponding to the linear prediction coefficient codes.

The linear prediction coefficients $\beta_1,\beta_2, \ldots ,\beta_p$ are linear prediction coefficients corresponding to a time domain signal when the $\eta_0$-th power of the absolute values of the MDCT coefficient sequence X(0),X(1), . . . ,X(N−1) are regarded as a power spectrum.

Generation of the linear prediction coefficient codes by the linear prediction analyzing portion 421 is performed, for example, by a conventional encoding technique. The conventional encoding technique is, for example, an encoding technique in which a code corresponding to a linear prediction coefficient itself is caused to be a linear prediction coefficient code, an encoding technique in which a linear prediction coefficient is transformed to an LSP parameter, and a code corresponding to the LSP parameter is caused to be a linear prediction coefficient code, an encoding technique in which a linear prediction coefficient is transformed to a PARCOR coefficient, and a code corresponding to the PARCOR coefficient is caused to be a linear prediction coefficient code, or the like.

In this way, the linear prediction analyzing portion 421 performs linear prediction analysis using a pseudo correlation function signal sequence obtained by performing inverse Fourier transform regarding the $\eta$-th power of absolute values of a frequency domain sample sequence, which is, for example, an MDCT coefficient sequence, as a power spectrum, and generates linear prediction coefficients (step C421).

<Unsmoothed Amplitude Spectral Envelope Sequence Generating Portion 422>

The quantized linear prediction coefficients $\hat{\beta}_1,\hat{\beta}_2, \ldots ,\hat{\beta}_p$ generated by the linear prediction analyzing portion 421 are inputted to the unsmoothed amplitude spectral envelope sequence generating portion 422.

The unsmoothed amplitude spectral envelope sequence generating portion 422 generates an unsmoothed amplitude spectral envelope sequence $\hat{H}$(0),$\hat{H}$(1), . . . ,$\hat{H}$(N−1), which is a sequence of an amplitude spectral envelope corresponding to the quantized linear prediction coefficients $\hat{\beta}_1,\hat{\beta}_2, \ldots ,\hat{\beta}_p$.

The generated unsmoothed amplitude spectral envelope sequence $\hat{H}$(0),$\hat{H}$(1), . . . ,$\hat{H}$(N−1) is outputted to the whitened spectral sequence generating portion 43.

The unsmoothed amplitude spectral envelope sequence generating portion 422 generates an unsmoothed amplitude spectral envelope sequence $\hat{H}$(0),$\hat{H}$(1), . . . ,$\hat{H}$(N−1) defined by the following expression (C2) as the unsmoothed amplitude spectral envelope sequence $\hat{H}$(0),$\hat{H}$(1), . . . ,$\hat{H}$(N−1) using the quantized linear prediction coefficients $\hat{\beta}_1,\hat{\beta}_2, \ldots ,\hat{\beta}_p$.

[Expression 26]

$$\hat{H}(k) = \left(\frac{1}{2\pi}\frac{1}{\left|1+\sum_{n=1}^{p}\hat{\beta}_n \exp(-j2\pi kn/N)\right|^2}\right)^{1/\eta_0} \tag{C2}$$

In this way, the unsmoothed amplitude spectral envelope sequence generating portion 422 performs estimation of a spectral envelope by obtaining an unsmoothed spectral envelope sequence, which is a sequence of an amplitude spectral envelope corresponding to a pseudo correlation function signal sequence raised to the power of $1/\eta_0$, based on coefficients transformable to linear prediction coefficients generated by the linear prediction analyzing portion 421 (step C422).

The unsmoothed amplitude spectral envelope sequence generating portion 422 may obtain the unsmoothed amplitude spectral envelope sequence $\hat{H}$(0),$\hat{H}$(1), . . . ,$\hat{H}$(N−1)

by using the linear prediction coefficients $\beta_1, \beta_2, \ldots, \beta_p$ generated by the linear prediction analyzing portion 421 instead of the quantized linear prediction coefficients $\hat{\beta}_1, \hat{\beta}_2, \ldots, \hat{\beta}_p$. In this case, the linear prediction analyzing portion 421 may not perform the process for obtaining the quantized linear prediction coefficients $\hat{\beta}_1, \hat{\beta}_2, \ldots, \hat{\beta}_p$.

<Whitened Spectral Sequence Generating Portion 43>

The MDCT coefficient sequence X(0),X(1), . . . ,X(N−1) obtained by the frequency domain transforming portion 41 and the unsmoothed amplitude spectral envelope sequence $\hat{H}$(0),$\hat{H}$(1), . . . ,$\hat{H}$(N−1) generated by the unsmoothed amplitude spectral envelope sequence generating portion 422 are inputted to the whitened spectral sequence generating portion 43.

The whitened spectral sequence generating portion 43 generates a whitened spectral sequence $X_W$(0),$X_W$(1), . . . ,$X_W$(N−1) by dividing coefficients of the MDCT coefficient sequence X(0),X(1), . . . ,X(N−1) by corresponding values of the unsmoothed amplitude spectral envelope sequence $\hat{H}$(0),$\hat{H}$(1), . . . ,$\hat{H}$(N−1), respectively.

The generated whitened spectral sequence $X_W$(0),$X_W$(1), . . . ,$X_W$(N−1) is outputted to the parameter acquiring portion 44.

The whitened spectral sequence generating portion 43 generates each of values $X_W$(k) of the whitened spectral sequence $X_W$(0),$X_W$(1), . . . ,$X_W$(N−1) by dividing coefficients X(k) of the MDCT COEFFICIENT SEQUENCE X(0),X(1), . . . ,X(N−1) by values $\hat{H}$(k) of the unsmoothed amplitude spectral envelope sequence $\hat{H}$(0),$\hat{H}$(1), . . . ,$\hat{H}$(N−1), respectively, for example, on the assumption of k=0, 1, . . . ,N−1. That is, $X_W(k)=X(k)/\hat{H}(k)$ is satisfied on the assumption of k=0, 1, . . . ,N−1.

In this way, the whitened spectral sequence generating portion 43 obtains a whitened spectral sequence which is a sequence obtained by dividing a frequency domain sample sequence which is, for example, an MDCT coefficient sequence by a spectral envelope which is, for example, an unsmoothed amplitude spectral envelope sequence (step C43).

<Parameter Acquiring Portion 44>

The whitened spectral sequence $X_W$(0),$X_W$(1), . . . ,$X_W$(N−1) generated by the whitened spectral sequence generating portion 43 is inputted to the parameter acquiring portion 44.

The parameter acquiring portion 44 determines such a parameter η that generalized Gaussian distribution with the parameter η as a shape parameter approximates a histogram of the whitened spectral sequence $X_W$(0),$X_W$(1), . . . ,$X_W$(N−1) (step C44). In other words, the parameter acquiring portion 44 decides such a parameter η that generalized Gaussian distribution with the parameter η as a shape parameter is close to distribution of the histogram of the whitened spectral sequence $X_W$(0),$X_W$(1), . . . ,$X_W$(N−1).

The generalized Gaussian distribution with the parameter η as a shape parameter is defined, for example, as shown below. Here, Γ indicates a gamma function.

[Expression 27]

$$f_{GG}(X \mid \phi, \eta) = \frac{A(\eta)}{\phi}\exp\left(-\left|B(\eta)\frac{X}{\phi}\right|^{\eta}\right),$$

$$A(\eta) = \frac{\eta B(\eta)}{2\Gamma(1/\eta)},$$

$$B(\eta) = \sqrt{\frac{\Gamma(3/\eta)}{(1/\eta)}},$$

$$\Gamma(x) = \int_0^{\infty} e^{-t} t^{x-1}\, dt$$

Figure 23:
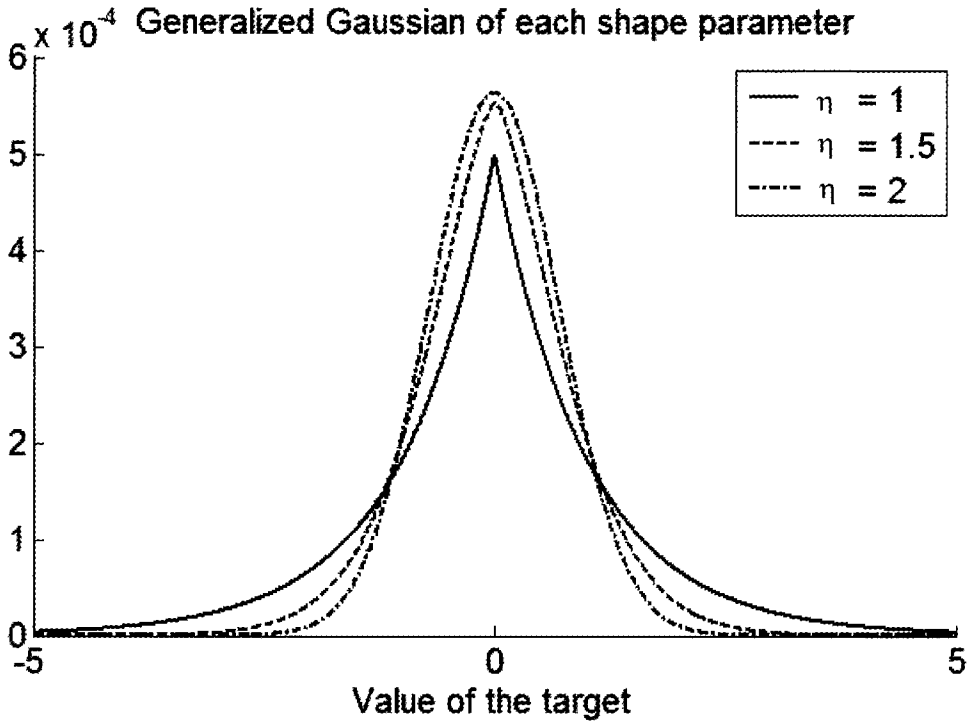
FIG. 23 is a diagram for illustrating the generalized Gaussian distribution.

The generalized Gaussian distribution is such that makes it possible to express various distributions by changing η which is a shape parameter. For example, Laplace distribution and Gaussian distribution are expressed at the time of η=1 and at the time of η=2, respectively, as shown in FIG. 23. Here, φ is a parameter corresponding to variance.

Here, η determined by the parameter acquiring portion 44 is defined, for example, by an expression (C3) below. Here, $F^{-1}$ is an inverse function of a function F. This expression is derived from a so-called moment method.

[Expression 28]

$$\eta = F^{-1}\left(\frac{m_1}{\sqrt{m_2}}\right) \tag{C3}$$

$$F(\eta) = \frac{\Gamma(2/\eta)}{\sqrt{\Gamma(1/\eta)\Gamma(3/\eta)}}$$

$$m_1 = \frac{1}{N}\sum_{k=0}^{N-1}|X_W(k)|,$$

$$m_2 = \frac{1}{N}\sum_{k=0}^{N-1}|X_W(k)|^2$$

When the inverse function $F^{-1}$ is explicitly defined, the parameter acquiring portion 44 can determine the parameter η by calculating an output value when a value of $m_1/((m_2)^{1/2})$ is inputted to the explicitly defined inverse function $F^{-1}$.

When the inverse function $F^{-1}$ is not explicitly defined, the parameter acquiring portion 44 may determine the parameter η by a first method or a second method described below, in order to calculate a value of η defined by the expression (C3).

The first method for determining the parameter η will be described. In the first method, the parameter acquiring portion 44 calculates $m_1/((m_2)^{1/2})$ based on a whitened spectral sequence and, by referring to a plurality of different pairs of η and F(η) corresponding to η prepared in advance, obtains η corresponding to F(η) which is the closest to the calculated $m_1/((m_2)^{1/2})$.

The plurality of different pairs of η and F(η) corresponding to η prepared in advance are stored in a storage portion 441 of the parameter acquiring portion 44 in advance. The parameter acquiring portion 44 finds F(η) closest to the calculated $m_1/((m_2)^{1/2})$ by referring to the storage portion 441, and reads η corresponding to the found F(η) from the storage portion 441 and outputs it.

Here, F(η) closest to the calculated $m_1/((m_2)^{1/2})$ refers to such F(η) that an absolute value of a difference from the calculated $m_1/((m_2)^{1/2})$ the smallest.

The second method for determining the parameter η will be described. In the second method, on the assumption that an approximate curve function of the inverse function $F^{-1}$ is, for example, $\tilde{F}^{-1}$ indicated by an expression (C3') below, the parameter acquiring portion 44 calculates $m_1/((m_2)^{1/2})$ based on a whitened spectral sequence and determines η by calculating an output value when the calculated $m_1/((m_2)^{1/2})$ is inputted to the approximate curve function $\tilde{F}^{-1}$.

Note that η determined by the parameter acquiring portion 44 may be defined not by the expression (C3) but by an expression obtained by generalizing the expression (C3) using positive integers q1 and q2 specified in advance (q1<q2) like an expression (C3").

[Expression 29]

$$\eta = F'^{-1}\left(\frac{m_{q_1}}{(m_{q_2})^{q_1/q_2}}\right) \tag{C3''}$$

$$F'(\eta) = \frac{\Gamma((q_1+1)/\eta)}{(\Gamma(1/\eta))^{1-q_1/q_2}(\Gamma((q_2+1)/\eta))^{q_1/q_2}}$$

$$m_{q_1} = \frac{1}{N}\sum_{k=0}^{N-1}|X_W(k)|^{q_1},$$

$$m_{q_2} = \frac{1}{N}\sum_{k=0}^{N-1}|X_W(k)|^{q_2}$$

In the case where η is defined by the expression (C3") also, η can be determined in a method similar to the method in the case where η is defined by the expression (C3). That is, after calculating a value $m_{q1}/((m_{q2})^{q1/q2})$ based on $m_{q1}$ which is the q1-th order moment of a whitened spectral sequence, and $m_{q2}$ which is the q2-th order moment of the whitened spectral sequence, based on the whitened spectral sequence, for example, the parameter acquiring portion 44 can, by referring to a plurality of different pairs of η and F'(η) corresponding to η prepared in advance, acquire η corresponding to F'(η) closest to the calculated $m_{q1}/((m_{q2})^{q1/q2})$ or can determine η by calculating, on the assumption that an approximate curve function of the inverse function $F'^{-1}$ is $\tilde{F}'^{-1}$, an output value when the calculated $m_{q1}/((m_{q2})^{q1/q2})$ is inputted to the approximate curve function $\tilde{F}^{-1}$, similarly to the first and second methods described above.

As described above, η can be said to be a value based on two different moments $m_{q1}$ and $m_{q2}$ in different orders. For example, η may be determined based on a value of a ratio between a value of a moment in a lower order between the two different moments $m_{q1}$ and $m_{q2}$ in different orders or a value based on the value of the moment (hereinafter referred to as the former) and a value of a moment in a higher order or a value based on the value of the moment (hereinafter referred to as the latter), or a value based on the value of the ratio, or a value obtained by dividing the former by the latter. The value based on a moment refers to, for example, $m^Q$ when the moment is indicated by in, and a predetermined real number is indicated by Q. Further, η may be determined by inputting these values to the approximate curve function $\tilde{F}^{-1}$. It is only necessary that this approximate curve function $\tilde{F}'^{-1}$ is such a monotonically increasing function that an output is a positive value in a used domain similarly as described above.

The parameter determining portion 27' may determine the parameter η by a loop process. That is, the parameter determining portion 27' may further perform the processes of the spectral envelope estimating portion 42, the whitened spectral sequence generating portion 43 and the parameter acquiring portion 44 in which the parameter η determined by the parameter acquiring portion 44 is a parameter $\eta_0$ specified by a predetermined method once or more times.

In this case, for example, as indicated by a broken line in FIG. 21, the parameter η determined by the parameter acquiring portion 44 is outputted to the spectral envelope estimating portion 42. The spectral envelope estimating portion 42 performs a process similar to the process described above to perform estimation of a spectral envelope, using η determined by the parameter acquiring portion 44 as the parameter $\eta_0$. The whitened spectral sequence generating portion 43 performs a process similar to the process described above to generate a whitened spectral sequence, based on the newly estimated spectral envelope. The parameter acquiring portion 44 performs a process similar to the process described above to determine a parameter η, based on the newly generated whitened spectral sequence.

For example, the processes of the spectral envelope estimating portion 42, the whitened spectral sequence generating portion 43 and the parameter acquiring portion 44 may be further performed τ times, which is a predetermined number of times. Here, τ is a predetermined positive integer, for example, τ=1 or τ=2.

Further, the spectral envelope estimating portion 42 may repeat the processes of the spectral envelope estimating portion 42, the whitened spectral sequence generating portion 43 and the parameter acquiring portion 44 until an absolute value of a difference between the parameter η determined this time and a parameter η determined last becomes a predetermined threshold or smaller.

<Acoustic Feature Amount Extracting Portion 521>

The time domain sound signal in frames, which is a time-series signal, is inputted to the acoustic feature amount extracting portion 521.

The acoustic feature amount extracting portion 521 calculates an index indicating a magnitude of a sound of the time-series signal as an acoustic feature amount (step FE2). The calculated index indicating the magnitude of the sound is outputted to the identifying portion 522. Further, the acoustic feature amount extracting portion 521 generates an acoustic feature amount code corresponding to the acoustic feature amount and outputs it to the decoding apparatus.

The index indicating the magnitude of the sound of the time-series signal may be anything if it is an index indicating the magnitude of the sound of the time-series signal. The index indicating the magnitude of the sound of the time-series signal is, for example, energy of the time-series signal.

In this example, since the identifying portion 522 to be described below identifies a configuration of an encoding process based on not only a parameter η but also an index indicating the magnitude of the sound, the acoustic feature amount extracting portion 521 calculates the index indicating the magnitude of the sound. However, in a case where the identifying portion 522 identifies a configuration of an encoding process using only the parameter η without using the index indicating the magnitude of the sound, the acoustic feature amount extracting portion 521 may not calculate the index indicating the magnitude of the sound.

<Identifying Portion 522>

The parameter η determined by the parameter determining portion 27' and the index indicating the magnitude of the sound of the time-series signal calculated by the acoustic feature amount extracting portion 521 are inputted to the identifying portion 522. Further, the sound signal in frames, which is the time-series signal, is inputted as necessary.

The identifying portion 522 identifies a configuration of an encoding process at least based on the parameter η (step FE3), generates an identification code capable of identifying the configuration of the encoding process and outputs it to the decoding apparatus. Further, information about the configuration of the encoding process identified by the identifying portion 522 is outputted to the encoding portion 523.

The identifying portion 522 may identify the configuration of the encoding process based on the parameter η only and may identify the configuration of the encoding process based on the parameter η and parameters other than the parameter η.

The configuration of an encoding process may be an encoding method such as TCX (Transform Coded Excitation) and ACELP (Algebraic Code Excited Linear Prediction) or may be a frame length which is a unit of temporal processing, the number of bits allocated to a code, a degree of a coefficient transformable to a linear prediction coefficient, or any parameter value used in the encoding process, in a certain encoding method. That is, it may be possible to appropriately specify a frame length which is a unit of temporal processing, the number of bits to be allocated to a code, a degree of a coefficient transformable to a linear prediction coefficient, any parameter value used in the encoding process, in a certain encoding method according to the parameter η.

In the encoding apparatus and method of the second embodiment described above with reference to FIGS. 12 and 13, a value of a parameter used in an encoding process is specified according to the parameter η. Therefore, the encoding apparatus and method of the second embodiment described above with reference to FIGS. 12 and 13 can be said to be an example of the modification of the second embodiment in which a configuration of an encoding process is identified based on the parameter η.

The identification code capable of identifying a configuration of an encoding process may be any code if the code is capable of identifying the configuration of the encoding process. For example, the identification code capable of identifying a configuration of an encoding process is a flag by a predetermined bit string, such as "11" when TCX with a long frame length is identified as a configuration of an encoding process, "100" when TCX with a short frame length is identified, "101" when ACELP is identified, and "0" when a low-bit encoding process in which, for example, only a noise level, identification and the like are transmitted is identified. The identification code capable of identifying a configuration of an encoding process may be a parameter code indicating, for example, the parameter η.

The identification code capable of identifying a configuration of an encoding process can be also said to be an identification code capable of identifying a configuration of a decoding process because, if a configuration of an encoding process is identified by the identification code, a configuration of a corresponding decoding process is also identified.

Description will be made below first on a case of identifying an encoding process based on the parameter η and the index indicating a magnitude of a sound of a time-series signal as an example.

The identifying portion 522 compares the index indicating the magnitude of the sound of the time-series signal and a predetermined threshold $C_e$ and also compares the parameter η and a predetermined threshold $C_\eta$. When, for example, an average amplitude (a square root of average energy per sample) is used as the index indicating the magnitude of the sound of the time-series signal, $C_e$=maximum amplitude value*(1/128) is assumed. For example, in a case of 16-bit precision, the maximum amplitude value is 32768, and, therefore, $C_e$=256 is assumed. Further, for example, $C_\eta$=1 is assumed.

If the index indicating the magnitude of the sound of the time-series signal≥the predetermined threshold $C_e$, and the parameter η<the predetermined threshold $C_\eta$ are satisfied, there is a strong possibility that the time-series signal is music mainly by wind instruments and stringed instruments which mainly includes a continuous sound (hereinafter referred to as continuous music), and, therefore, the identifying portion 522 decides to perform an encoding process suitable for continuous music. The encoding process suitable for continuous music is, for example, a TCX encoding process in which the frame length is long, specifically, a TCX encoding process for 1024 frames.

If the index indicating the magnitude of the sound of the time-series signal≥the predetermined threshold $C_e$, and the parameter η≥the predetermined threshold $C_\eta$ are satisfied, there is a strong possibility that the time-series signal is voice or music mainly by percussion instruments and the like the temporal fluctuation of which is large.

In this case, the identifying portion 522 divides a time-series signal inputted as necessary, for example, into four to create four subframes and measures energy of the time-series signal for each subframe. If a value obtained by dividing an arithmetic mean of the energy of the four subframes by a geometrical mean, a value of $F=((1/4)/\Sigma \text{ energy of four subframes})/((\Pi \text{ energy of subframes})^{1/4})$ is equal to or larger than a predetermined threshold $C_F$, there is a strong possibility that the time-series signal is music the temporal fluctuation of which is large. In this case, the identifying portion 522 decides to perform an encoding process suitable for music the temporal fluctuation of which is large. The encoding process suitable for music the temporal fluctuation of which is large is, for example, a TCX encoding process in which the frame length is short, specifically, a TCX encoding process for 256 frames. For example, $C_E$=1.5 is assumed.

If the value F is smaller than the threshold $C_F$, there is a strong possibility that the time-series signal is voice. In this case, the identifying portion 522 decides to perform an encoding process suitable for voice. The encoding process suitable for voice is, for example, a voice encoding process such as ACELP and CELP (Code Excited Linear Prediction).

If the index indicating the magnitude of the sound of the time-series signal<the predetermined threshold $C_e$, and the parameter η≥the predetermined threshold $C_\eta$ are satisfied, there is a strong possibility that the time-series signal is a silent section. Here, the silent section does not mean a section in which no sound exists but means a section in which a target sound does not exist but a background sound and ambient noises exist. In this case, the identifying portion 522 decides that the time-series signal is a silent section.

If the index indicating the magnitude of the sound of the time-series signal<the predetermined threshold $C_e$, and the parameter η<the predetermined threshold $C_\eta$ are satisfied, there is a strong possibility that the time-series signal is background music which is small-volume continuous music (hereinafter referred to as a background sound with characteristics like those of BGM). In this case, the identifying portion 522 decides to perform an encoding process suitable for a background sound with characteristics like those of BGM. The encoding process suitable for a background sound with characteristics like those of BGM is, for example, a TCX encoding process in which the frame length is short, specifically, the TCX encoding process for 256 frames.

The identifying portion 522 may identify a configuration of an encoding process not only based on the parameter η but also further based on at least one of temporal fluctuation of an index indicating a magnitude of a sound of an inputted time-series signal, a spectral shape, temporal fluctuation of the spectral shape, and a degree of pitch periodicity. In the case of further using at least one of the temporal fluctuation of the index indicating magnitude of the sound of the inputted time-series signal, the spectral shape, the temporal fluctuation of the spectral shape, and the degree of the pitch periodicity, the acoustic feature amount extracting portion 521 calculates an acoustic feature amount to be used by the identifying portion 522 among the temporal fluctuation of the index indicating magnitude of the sound of the inputted time-series signal, the spectral shape, the temporal fluctuation of the spectral shape, and the degree of the pitch periodicity and outputs the acoustic feature amount to the identifying portion 522. Further, the acoustic feature amount extracting portion 521 generates an acoustic feature amount code corresponding to the calculated acoustic feature amount and outputs it to the decoding apparatus.

Description will be made below on each of (1) a case of identifying a configuration of an encoding process based on the parameter η and temporal fluctuation of an index indicating a magnitude of a sound of a time-series signal; (2) a case of identifying a configuration of an encoding process based on the parameter η and a spectral shape of a time-series signal; (3) a case of identifying a configuration of an encoding process based on the parameter η and temporal fluctuation of a spectral shape of a time-series signal; and (4) a case of identifying a configuration of an encoding process based on the parameter η and pitch periodicity of a time-series signal.

(1) In the case of identifying a configuration of an encoding process based on the parameter η and temporal fluctuation of an index indicating a magnitude of a sound of a time-series signal, the identifying portion 522 judges whether the temporal fluctuation of the index indicating the magnitude of the sound of the time-series signal is large or not and judges whether the parameter η is large or not.

Whether the temporal fluctuation of the index indicating the magnitude of the sound of the time-series signal is large or not can be judged, for example, based on a predetermined threshold $C_E'$. That is, if the temporal fluctuation of the index indicating the magnitude of the sound of the time-series signal≥the predetermined threshold $C_E'$ is satisfied, it can be judged that the temporal fluctuation of the index indicating the magnitude of the sound of the time-series signal is large, and, otherwise, it can be judged that the temporal fluctuation of the index indicating the magnitude of the sound of the time-series signal is small.

Whether the parameter η is large or not can be judged, for example, based on the predetermined threshold $C_\eta$. That is, if the parameter η≥the predetermined threshold $C_\eta$ is satisfied, it can be judged that the parameter η is large, and, otherwise, it can be judged that the parameter η is small.

If the temporal fluctuation of the index indicating the magnitude of the sound of the time-series signal is large, and the parameter is large, there is a strong possibility that the time-series signal is voice. In this case, the identifying portion 522 decides to perform the encoding process suitable for voice. For example, if the value obtained by dividing an arithmetic mean of energy of four subframes constituting the time-series signal by a geometrical mean, a value of $F=((1/4)/\Sigma \text{ energy of four subframes})/((\Pi \text{ energy of subframes})^{1/4})$ is used, $C_E'=1.5$ is assumed.

If the temporal fluctuation of the index indicating the magnitude of the sound of the time-series signal is large, and the parameter is small, there is a strong possibility that the time-series signal is music the temporal fluctuation of which is large. In this case, the identifying portion 522 decides to perform the encoding process suitable for music the temporal fluctuation of which is large.

If the temporal fluctuation of the index indicating the magnitude of the sound of the time-series signal is small, and the parameter η is large, there is a strong possibility that the time-series signal is a silent section. In this case, the identifying portion 522 decides that the time-series signal is a silent section.

If the temporal fluctuation of the index indicating the magnitude of the sound of the time-series signal is small, and the parameter η is small, there is a strong possibility that the time-series signal is music mainly by wind instruments and stringed instruments which mainly includes a continuous sound. In this case, the identifying portion 522 decides to perform the encoding process suitable for continuous music.

(2) In the case of identifying a configuration of an encoding process based on the parameter η and a spectral shape of a time-series signal, the identifying portion 522 judges whether the spectral shape of the time-series signal is flat or not and judges whether the parameter η is large or not.

Whether the spectral shape of the time-series signal is flat or not can be judged based on a predetermined threshold $E_V$. For example, if an absolute value of a first order PARCOR coefficient corresponding to the time-series signal is smaller than the predetermined threshold $E_V$ (for example, $E_V=0.7$), it can be judged that the spectral shape of the time-series signal is flat, and, otherwise, it can be judged that the spectral shape of the time-series signal is not flat.

If the spectral shape of the time-series signal is flat, and the parameter η is large, there is a strong possibility that the time-series signal is a silent section. In this case, the identifying portion 522 decides that the time-series signal is a silent section.

If the spectral shape of the time-series signal is flat, and the parameter η is small, there is a strong possibility that the time-series signal is music the temporal fluctuation of which is large. In this case, the identifying portion 522 decides to perform the encoding process suitable for music the temporal fluctuation of which is large.

If the spectral shape of the time-series signal is not flat, and the parameter η is large, there is a strong possibility that the time-series signal is voice. In this case, the identifying portion 522 decides to perform the encoding process suitable for voice.

If the spectral shape of the time-series signal is not flat, and the parameter η is small, there is a strong possibility that the time-series signal is music mainly by wind instruments and stringed instruments which mainly includes a continuous sound. In this case, the identifying portion 522 decides to perform the encoding process suitable for continuous music.

(3) In the case of identifying a configuration of an encoding process based on the parameter η and temporal fluctuation of a spectral shape of a time-series signal, the identifying portion 522 judges whether the temporal fluctuation of the spectral shape of the time-series signal is large or not and judges whether the parameter η is large or not.

Whether the temporal fluctuation of the spectral shape of the time-series signal is flat or not can be judged based on a predetermined threshold $E_V'$. For example, if a value obtained by dividing an arithmetic mean of absolute values of a first order PARCOR coefficients of four subframes constituting the time-series signal by a geometrical mean, $F_V$=((¼)Σ absolute values of first PARCOR coefficients of four subframes)/((Π absolute values of first PARCOR coefficients)$^{1/4}$) is equal to or larger than the predetermined threshold $E_V'$ (for example, $E_V'$=1.2), it can be judged that the temporal fluctuation of the spectral shape of the time-series signal is large, and, otherwise, it can be judged that the temporal fluctuation of the spectral shape of the time-series signal is small.

If the temporal fluctuation of the spectral shape of the time-series signal is large, and the parameter η is large, there is a strong possibility that the time-series signal is voice. In this case, the identifying portion 522 decides to perform the encoding process suitable for voice.

If the temporal fluctuation of the spectral shape of the time-series signal is large, and the parameter η is small, there is a strong possibility that the time-series signal is music the temporal fluctuation of which is large. In this case, the identifying portion 522 decides to perform the encoding process suitable for music the temporal fluctuation of which is large.

If the temporal fluctuation of the spectral shape of the time-series signal is small, and the parameter η is large, there is a strong possibility that the time-series signal is a silent section. In this case, the identifying portion 522 decides that the time-series signal is a silent section.

If the temporal fluctuation of the spectral shape of the time-series signal is small, and the parameter η is small, there is a strong possibility that the time-series signal is music mainly by wind instruments and stringed instruments which mainly includes a continuous sound. In this case, the identifying portion 522 decides to perform the encoding process suitable for continuous music.

(4) In the case of identifying a configuration of an encoding process based on the parameter η and pitch periodicity of a time-series signal, the identifying portion 522 judges whether the pitch periodicity of the time-series signal is large or not and judges whether the parameter η is large or not.

Whether the pitch periodicity of the time-series signal is large or not can be judged, for example, based on a predetermined threshold $C_P$. That is, if the pitch periodicity of the time-series signal≥the predetermined threshold $C_P$ is satisfied, it can be judged that the pitch periodicity is large, and, otherwise, it can be judged that the pitch periodicity is small. For example, when a normalized correlation function with respect to a sequence separated by a pitch period of τ samples indicated by the following expression is used as the pitch periodicity, $C_P$=0.8 is assumed.

[Expression 30]

$$R(\tau) = \frac{\sum_{i=\tau}^{N} x(i)x(i-\tau)}{\sum_{i=\tau}^{N} x^2(i)}$$

(Here, x(i) indicates time-series sample values, and N indicates the number of samples per frame.)

If the pitch periodicity is large, and the parameter η is large, there is a strong possibility that the time-series signal is voice. In this case, the identifying portion 522 decides to perform the encoding process suitable for voice.

If the pitch periodicity is large, and the parameter η is small, there is a strong possibility that the time-series signal is music mainly by wind instruments and stringed instruments which mainly includes a continuous sound. In this case, the identifying portion 522 decides to perform the encoding process suitable for continuous music.

If the pitch periodicity is small, and the parameter η is large, there is a strong possibility that the time-series signal is a silent section. In this case, the identifying portion 522 decides that the time-series signal is a silent section.

If the pitch periodicity is small, and the parameter η is small, there is a strong possibility that the time-series signal is music the temporal fluctuation of which is large. In this case, the identifying portion 522 decides to perform the encoding process suitable for music the temporal fluctuation of which is large.

<Encoding Portion 523>

The sound signal in frames, which is a time-series signal, and information about the configuration of the encoding process identified by the identifying portion 522 are inputted to the encoding portion 523.

The encoding portion 523 encodes the inputted time-series signal to generate codes by the encoding process with the identified configuration (step FE4). The generated codes are transmitted to the decoding apparatus.

When the encoding process suitable for continuous music is identified, for example, a TCX (Transform Coded Excitation) encoding process in which the frame length is long, specifically, the TCX encoding process for 1024 frames is performed. In this case, instead of the parameter η determined by the parameter determining portion 27', a code indicating a fixed value η (for example, η=0.8) may be outputted to the decoding apparatus as a parameter code.

When the encoding process suitable for music the temporal fluctuation of which is large is identified, for example, a TCX encoding process in which the frame length is short, specifically, the TCX encoding process for 256 frames is performed.

When the encoding process suitable for a background sound with characteristics like those of BGM is identified, for example, a TCX encoding process in which the frame length is short, specifically, the TCX encoding process for 256 frames is performed. In this case, instead of the parameter η determined by the parameter determining portion 27', a code indicating a fixed value η (for example, η=0.8) may be outputted to the decoding apparatus as a parameter code.

When the encoding process suitable for voice is identified, for example, a voice encoding process such as ACELP (Algebraic Code Excited Linear Prediction) and CELP (Code Excited Linear Prediction) is performed.

When it is judged that the time-series signal is a silent section, the encoding portion 523 performs, for example, (i) a first method or (ii) a second method described below without encoding the inputted time-series signal.

(i) First Method

The encoding portion 523 transmits information showing that the time-series signal is a silent section to the decoding apparatus. The information showing that the time-series signal is a silent section is transmitted with a small number of bits, for example, with 1 bit. While, after the encoding portion 523 transmits the information indicating that the time-series signal is a silent section, it is determined by the identifying portion 522 that a processing target time-series signal is a silent section, the encoding portion 523 does not have to send information indicating that the time-series signal is a silent section again.

(ii) Second Method

The encoding portion 523 transmits the information showing that the time-series signal is a silent section, and information about a shape of a spectral envelope of the time-series signal and information about an amplitude of the time-series signal to the decoding apparatus.

(Decoding)

An example of the decoding apparatus and the method will be described.

Figure 19:
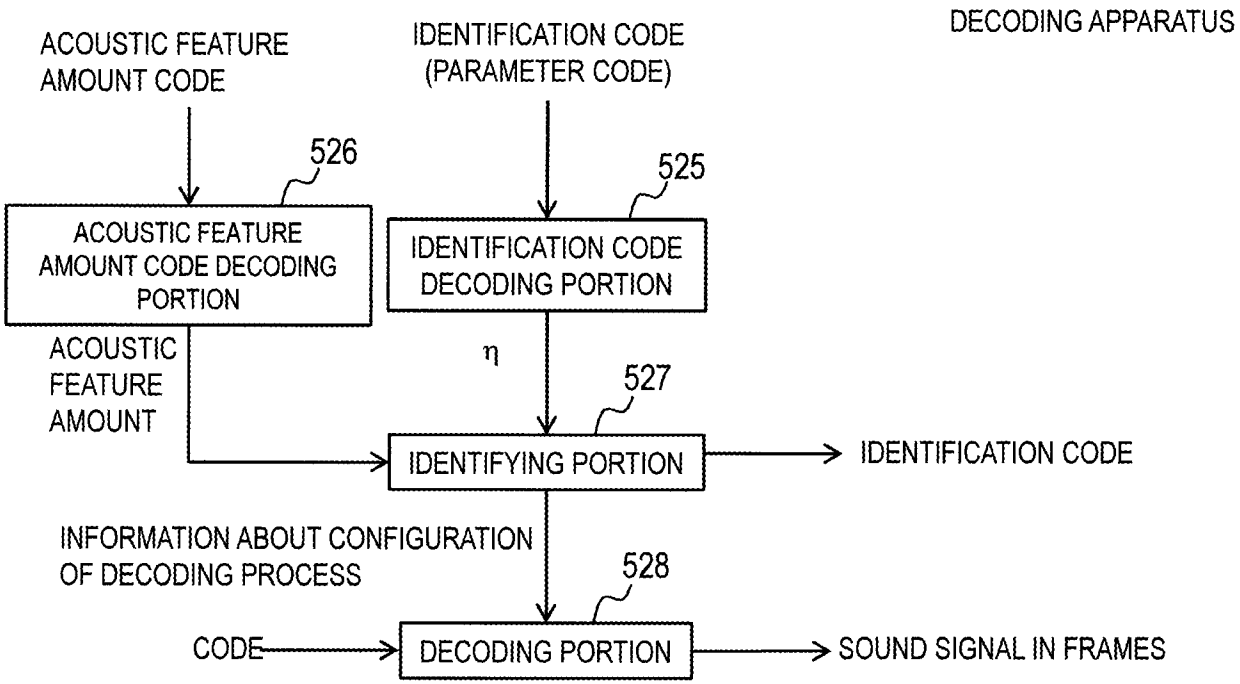
FIG. 19 is a block diagram for illustrating an example of the decoding apparatus.
Figure 20:
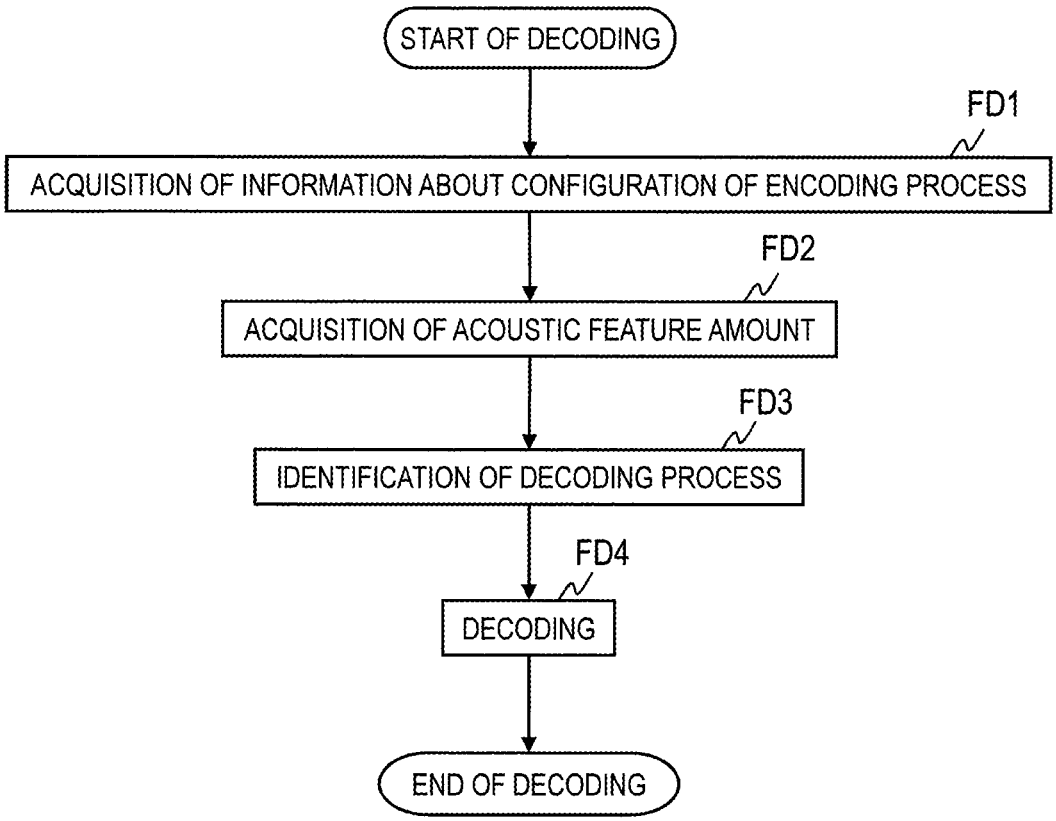
FIG. 20 is a flowchart for illustrating an example of the decoding method.

As shown in FIG. 19, the encoding apparatus is, for example, provided with an identification code decoding portion 525, an acoustic feature amount code decoding portion 526, an identifying portion 527 and a decoding portion 528. A decoding method is realized by each portion of the decoding apparatus performing each process illustrated in FIG. 20.

Each portion of the decoding apparatus will be described below.

<Identification Code Decoding Portion 525>

An identification code outputted by the encoding apparatus is inputted to the identification code decoding portion 525.

The identification code decoding portion 525 decodes the identification code and acquires information about a configuration of an encoding process (step FD1). The acquired information about the configuration of the encoding process is outputted to the identifying portion 527.

When the identification code is a parameter code, the identification code decoding portion 525 decodes the parameter code to obtain a parameter η, and outputs the obtained parameter η to the identifying portion 527 as the information about the configuration of the encoding process.

<Acoustic Feature Amount Code Decoding Portion 526>

An acoustic feature amount code outputted by the encoding apparatus is inputted to the acoustic feature amount code decoding portion 526.

The acoustic feature amount code decoding portion 526 decodes the acoustic feature amount code to obtain an acoustic feature amount which is at least one of an index indicating a magnitude of a sound of a time-series signal, temporal fluctuation of the index indicating the magnitude of the sound, a spectral shape, temporal fluctuation of the spectral shape, a degree of pitch periodicity (step FD2). The obtained acoustic feature amount is outputted to the identifying portion 527.

When the configuration of the encoding process is identified only based on the parameter η, and the acoustic feature amount and the acoustic feature amount code are not generated on the encoding side, the acoustic feature amount code decoding portion 526 does not perform the process.

<Identifying Portion 527>

The information about the configuration of the encoding process obtained by the identification code decoding portion 525 is inputted to the identifying portion 527. Further, the acoustic feature amount obtained by the acoustic feature amount code decoding portion 526 is inputted to the identifying portion 527 as necessary.

The identifying portion 527 identifies a configuration of a decoding process based on the information about the configuration of the encoding process (step FD3). For example, the identifying portion 527 identifies a configuration of a decoding process corresponding to the configuration of the encoding process identified by the information about the configuration of the encoding process. The identifying portion 527 may identify a configuration of a decoding process based on the information about the configuration of the encoding process and the acoustic feature amount. Information about the identified configuration of the decoding process is outputted to the decoding portion 528.

Description will be made below on a case where the parameter η has been inputted as the information about the configuration of the encoding process, and the acoustic feature amount which is at least one of an index indicating a magnitude of a sound of a time-series signal, temporal fluctuation of the index indicating a magnitude of the sound, a spectral shape, temporal fluctuation of the spectral shape, a degree of pitch periodicity has been inputted, as an example.

In this case, it is assumed that a judgment criterion similar to a predetermined judgment criterion for identifying a configuration of an encoding process by the identifying portion 522 is specified in advance in the identifying portion 527 of the decoding apparatus. The identifying portion 527 identifies a configuration of a decoding process corresponding to a configuration of an encoding process identified by the identifying portion 522, using the parameter η and the acoustic feature amount in accordance with the judgment criterion.

Since the judgment criterion for identifying a configuration of an encoding process by the identifying portion 522 of the encoding apparatus has been described in (Encoding), redundant description will be omitted here.

For example, as the configuration of the decoding process, any of a decoding process suitable for continuous music, a decoding process suitable for music the temporal fluctuation of which is large, a decoding process suitable for background sound with characteristics like those of BGM and a decoding process suitable for voice is identified, or the identifying portion 527 decides that a time-series signal is a silent section.

<Decoding Portion 528>

The code outputted by the encoding apparatus and the information about the configuration of the decoding process identified by the identifying portion 527 are inputted to the decoding portion 528.

The decoding portion 528 obtains a sound signal in frames, which is a time-series signal, by the decoding process with the identified configuration (step FD4).

When the decoding process suitable for continuous music is identified, for example, a TCX (Transform Coded Excitation) decoding process in which the frame length is long, specifically, a TCX decoding process for 1024 frames is performed.

When the decoding process suitable for music the temporal fluctuation of which is large is identified, for example, a TCX decoding process in which the frame length is short, specifically, a TCX decoding process for 256 frames is performed.

When the decoding process suitable for a background sound with characteristics like those of BGM is identified, for example, a TCX decoding process in which the frame length is short, specifically, the TCX decoding process for 256 frames is performed.

The decoding process suitable for voice is identified, for example, a voice decoding process such as ACELP (Algebraic Code Excited Linear Prediction) and CELP (Code Excited Linear Prediction) is performed.

When the decoding apparatus receives information indicating the time-series signal is a silent section or when it is determined by the identifying portion 527 that the time-series signal is a silent section, the decoding portion 528 performs, for example, a process of (i) a first method or (ii) a second method described below.

(i) First Method

A first method corresponds to (i) the first method on the encoding side.

The decoding portion 528 causes predetermined noise to be generated.

(ii) Second Method

The decoding portion 528 transforms and outputs the predetermined noise using information about a shape of a spectral envelope of the time-series signal and an amplitude of the time-series signal received together with the information indicating that the time-series signal is a silent section. As a method for transforming noise, an existing method used in EVS (Enhanced Voice Service) and the like can be used.

Thus, the decoding portion 528 may cause noise to be generated when receiving the information that a time-series signal is a silent section.

[Modifications and the Like]

When the linear prediction analyzing portion 22 and the unsmoothed amplitude spectral envelope sequence generating portion 23 are grasped as one spectral envelope estimating portion 2A, it can be said that this spectral envelope estimating portion 2A performs estimation of a spectral envelope regarding the η-th power of absolute values of a frequency domain sample sequence, which is, for example, an MDCT coefficient sequence, corresponding to a time-series signal, as a power spectrum (an unsmoothed amplitude spectral envelope sequence). Here, "regarding . . . as a power spectrum" means that a spectrum raised to the power of η is used where a power spectrum is usually used.

In this case, it can be said that, the linear prediction analyzing portion 22 of the spectral envelope estimating portion 2A performs linear prediction analysis using a pseudo correlation function signal sequence obtained by performing inverse Fourier transform regarding the η-th power of absolute values of a frequency domain sample sequence, which is, for example, an MDCT coefficient sequence, as a power spectrum, and obtains coefficients transformable to linear prediction coefficients. Further, it can be said that the unsmoothed amplitude spectral envelope sequence generating portion 23 of the spectral envelope estimating portion 2A performs estimation of a spectral envelope by obtaining an unsmoothed spectral envelope sequence, which is a sequence obtained by raising a sequence of an amplitude spectral envelope corresponding to coefficients transformable to linear prediction coefficients obtained by the linear prediction analyzing portion 22 to the power of 1/η.

Further, when the smoothed amplitude spectral envelope sequence generating portion 24, the envelope normalizing portion 25 and the encoding portion 26 are grasped as one encoding portion 2B, it can be said that this encoding portion 2B performs such encoding that changes bit allocation or that bit allocation substantially changes based on a spectral envelope (an unsmoothed amplitude spectral envelope sequence) estimated by the spectral envelope estimating portion 2A, for each coefficient of a frequency domain sample sequence which is, for example, an MDCT coefficient sequence corresponding to a time-series signal.

When the decoding portion 34 and the envelope denormalizing portion 35 are grasped as one decoding portion 3A, it can be said that this decoding portion 3A obtains a frequency domain sample sequence corresponding to a time-series sequence signal by performing decoding of inputted integer signal codes in accordance with such bit allocation that changes or substantially changes based on an unsmoothed spectral envelope sequence.

In the case of performing the encoding in which bit allocation is changed or bit allocation substantially changes based on a spectral envelope (an unsmoothed amplitude spectral envelope sequence), the encoding portion 2B may perform an encoding process other than the arithmetic encoding described above. In this case, the decoding portion 3A performs a decoding process corresponding to the encoding process performed by the encoding portion 2B.

For example, the encoding portion 2B may perform Golomb-Rice encoding for a frequency domain sample sequence using a Rice parameter determined based on a spectral envelope (an unsmoothed amplitude spectral envelope sequence). In this case, the decoding portion 3A may perform Golomb-Rice decoding using the Rice parameter determined based on the spectral envelope (the unsmoothed amplitude spectral envelope sequence).

In the first embodiment, at the time of determining a parameter the encoding apparatus may not perform an encoding process to the end. In other words, the parameter determining portion 27 may decide the parameter η based on an estimated code amount. In this case, the encoding portion 2B obtains estimated code amounts of codes obtained by an encoding process similar to the above encoding process, for a frequency domain sample sequence corresponding to a time-series signal in the same predetermined time section, using a plurality of parameters η. The parameter determining portion 27 selects any one of the plurality of parameters η based on the obtained estimated code amounts. For example, the parameter determining portion 27 selects a parameter η with the smallest estimated code amount. The encoding portion 2B obtains and outputs codes by performing an encoding process similar to the above encoding process using the selected parameter η.

The encoding apparatus may be further provided with a dividing portion 28 indicted by a broken line in FIG. 4 or 12. The dividing portion 28 generates, based on a frequency domain sample sequence generated by the frequency domain transforming portion 21 which is, for example, an MDCT coefficient sequence, a first frequency domain sample sequence constituted by samples corresponding to periodicity components of the frequency domain sample sequence and a second frequency domain sample sequence constituted by samples other than the samples corresponding to the periodicity components of the frequency domain sample sequence, and outputs information indicating the samples corresponding to the periodicity components to the decoding apparatus as auxiliary information.

In other words, the first frequency domain sample sequence is a sample sequence constituted by samples corresponding to a mountain part of the frequency domain sample sequence, and the second frequency domain sample sequence is a sample sequence constituted by samples corresponding to a valley part of the frequency domain sample sequence.

For example, a sample sequence constituted by all or a part of one or a plurality of consecutive samples including a sample corresponding to periodicity or fundamental frequency of a time-series signal corresponding to a frequency domain sample sequence in the frequency domain sample sequence and one or a plurality of consecutive samples including a sample corresponding to integer multiples of the periodicity or fundamental frequency of the time-series signal corresponding to the frequency domain sample sequence in the frequency domain sample sequence are generated as the first frequency domain sample sequence, and a sample sequence constituted by samples which are not included in the first frequency domain sample sequence in the frequency domain sample sequence are generated as the second frequency domain sample sequence. The generation of the first frequency domain sample sequence and the second frequency domain sample sequence can be performed with the use of a method described in International Publication No. WO2012/046685.

The linear prediction analyzing portion 22, the unsmoothed amplitude spectral envelope sequence generating portion 23, the smoothed amplitude spectral envelope sequence generating portion 24, the envelope normalizing portion 25, the encoding portion 26 and the parameter determining portion 27 perform an encoding process described in the first or second embodiment to generate codes for each of the first frequency domain sample sequence and the second frequency domain sample sequence. That is, for example, when arithmetic encoding is performed, parameter codes, linear prediction coefficient codes, integer signal codes and gain codes corresponding to the first frequency domain sample sequence are generated, and parameter codes, linear prediction coefficient codes, integer signal codes and gain codes corresponding to the second frequency domain sample sequence are generated.

Thus, by performing encoding for each of the first frequency domain sample sequence and the second frequency domain sample sequence, the encoding can be performed further efficiently.

In this case, the decoding apparatus may be further provided with a combining portion 38 indicated by a broken line in FIG. 9. The decoding apparatus performs a decoding process described in the first or second embodiment based on the codes (for example, the parameter codes, the linear prediction coefficient codes, integer signal codes and the gain codes) corresponding to the first frequency domain sample sequence to determine a decoded first frequency domain sample sequence. Further, the decoding apparatus performs a decoding process described in the first or second embodiment based on the codes (for example, the parameter codes, the linear prediction coefficient codes, integer signal codes and the gain codes) corresponding to the second frequency domain sample sequence to determine a decoded second frequency domain sample sequence. By appropriately combining the decoded first frequency domain sample sequence and the decoded second frequency domain sample sequence using the inputted auxiliary information, the combining portion 38 determines a decoded frequency domain sample sequence which is, for example, a decoded MDCT coefficient sequence $\hat{X}(\mathbf{0}),\hat{X}(\mathbf{1}), \ldots, \hat{X}(N-1)$. The time domain transforming portion transforms the decoded frequency domain sample sequence to a time domain to determine a time-series signal. The combination using the auxiliary information can be performed with the use of a method described in International Publication No. WO2012/046685.

When a bit rate is low or when it is desired to further reduce a code amount, it is also possible to encode only the first frequency domain sample sequence to generate only the codes corresponding to the first frequency domain sample sequence without generating the codes corresponding to the second frequency domain sample sequence in the encoding apparatus, and determine a decoded frequency domain sample sequence using the first frequency domain sample sequence obtained from the codes and the second frequency domain sample sequence the sample values of which are set to 0 in the decoding apparatus.

Further, the linear prediction analyzing portion 22, the unsmoothed amplitude spectral envelope sequence generating portion 23, the smoothed amplitude spectral envelope sequence generating portion 24, the envelope normalizing portion 25, the encoding portion 26 and the parameter determining portion 27 may perform an encoding process described in the first or second embodiment to generate codes for a rearranged sample sequence which is a sample sequence obtained by combining the first frequency domain sample sequence and the second frequency domain sample sequence. For example, in the case where arithmetic encoding is performed, parameter codes, linear prediction coefficient codes, integer signal codes and gain codes corresponding to the rearranged sample sequence are generated.

Thus, by performing encoding for the rearranged sample sequence, the encoding can be performed further efficiently.

In this case, the decoding apparatus performs a decoding process described in the first or second embodiment to determine a decoded rearranged sample sequence, and rearranges the decoded rearranged sample sequence using the inputted auxiliary information in accordance with a rule corresponding to a rule under which the first frequency domain sample sequence and the second frequency domain sample sequence have been generated in the encoding apparatus to determine a decoded frequency domain sample sequence which is, for example, a decoded MDCT coefficient sequence $\hat{X}(\mathbf{0}),\hat{X}(\mathbf{1}), \ldots, \hat{X}(N-1)$. The time domain transforming portion 36 transforms the decoded frequency domain sample sequence to a time domain to determine a time-series signal. The rearrangement using the auxiliary information can be performed with the use of a method described in International Publication No. WO2012/046685.

Further, the encoding apparatus may select any of the following methods for each frame: (1) a method of performing an encoding process for a frequency domain sample sequence to generate codes; (2) a method of performing an encoding process for each of the first frequency domain sample sequence and the second frequency domain sample sequence to generate codes; (3) a method of performing an encoding process only for the first frequency domain sample sequence to generate codes; and (4) a method of performing an encoding process for the rearranged sample sequence which is a sample sequence obtained by combining the first frequency domain sample sequence and the second frequency domain sample sequence to generate codes. In this case, the encoding apparatus also outputs a code indicating which of the methods (1) to (4) has been selected, and the decoding apparatus performs a decoding process corresponding to any of the above methods in accordance with the code inputted for each frame.

Candidates for the parameter $\eta$ corresponding to each of the above methods (1) to (4) may be stored in the parameter determining portion 27 of the encoding apparatus and the parameter decoding portion 37 of the decoding apparatus. Similarly, candidates for quantized linear prediction coefficients and candidates for decoded linear prediction coefficients corresponding to each of the above methods (1) to (4) may be stored in the linear prediction analyzing portion 22 of the encoding apparatus and the linear prediction coefficient decoding portion 31 of the decoding apparatus.

The unsmoothed amplitude spectral envelope sequence generating portion 23 and the unsmoothed amplitude spectral envelope sequence generating portion 422 may generate a periodicity integrated envelope sequence by transforming a spectral envelope sequence (an unsmoothed amplitude spectral envelope sequence) based on a periodicity component of a frequency domain sample sequence which is, for example, an MDCT coefficient sequence $\hat{X}(\mathbf{0}),\hat{X}(\mathbf{1}), \ldots, \hat{X}(N-1)$. Similarly, the unsmoothed amplitude spectral envelope sequence generating portion 32 may generate a periodicity integrated envelope sequence by transforming a spectral envelope sequence (an unsmoothed amplitude spectral envelope sequence) based on a periodicity component of a decoded frequency domain sample sequence which is, for example, an MDCT coefficient sequence $\hat{X}(0), \hat{X}(1), \ldots, \hat{X}(N-1)$. In this case, the variance parameter determining portion 268 of the encoding portion 26, the decoding portion 34 and the whitened spectral sequence generating portion 43 perform a process similar to the above process using the periodicity integrated envelope sequence instead of a spectral envelope sequence (an unsmoothed amplitude spectral envelope sequence). In the periodicity integrated envelope sequence, approximate accuracy near a peak due to a pitch period of a time-series signal is good. Therefore, it is possible to increase encoding efficiency by using the periodicity integrated envelope sequence.

For example, a sequence obtained by changing values of at least samples at and near integer multiples of a period of a frequency domain sample sequence in a spectral envelope sequence more largely as the period of the frequency domain sample sequence is larger is assumed to be the periodicity integrated envelope sequence. Further, a sequence obtained by changing values of at least samples at and near integer multiples of a period of a frequency domain sample sequence in a spectral envelope sequence more largely as a degree of periodicity of a time-series signal is larger may be assumed to be the periodicity integrated envelope sequence. Further, a sequence obtained by changing values of more samples near integer multiples of a period of a frequency domain sample sequence in a spectral envelope sequence as the period of the frequency domain sample sequence is larger may be assumed to be the periodicity integrated envelope sequence.

Furthermore, on the assumption that N and U are positive integers, T indicates an interval between components having periodicity in a frequency domain sample sequence, L indicates the number of decimal places of the interval T, v is an integer of 1 or larger, floor(•) is a function of discarding all numbers at and after the first decimal place and returning an integer value, Round(•) is a function of rounding off the first decimal place and returning an integer value, $T'=T\times 2^L$ is satisfied, $\hat{H}[0], \ldots, \hat{H}[N-1]$ is a spectral envelope sequence, and δ indicates a value determining a mixing ratio between a spectral envelope $\hat{H}[n]$ and a periodicity envelope P[k], a periodicity envelope sequence P[1], . . . ,P[N] is determined as shown by an expression below for an integer k within a range of: $(U\times T')/2^L-v-1\leq k\leq (U\times T')/2^L+v-1$

[Expression 31]

$$P[k]=\left\{h\cdot\exp\left(-\frac{(k-(\mathrm{floor}((U\times T')/2^L)\pm v))^2}{2PD^2}\right)\right\},\ \text{or}$$

$$P[k]=\left\{h\cdot\exp\left(-\frac{(k-(\mathrm{Round}(U\times T)\pm v))^2}{2PD^2}\right)\right\}$$

where, $$h=2.8\cdot(1.125-\exp(-0.07\cdot T'/2^L)),$$

$$PD=0.5\cdot(2.6-\exp(-0.05\cdot T'/2^L))$$

Then, a periodicity integrated envelope sequence $\hat{H}_M[1], \ldots, \hat{H}_M[N]$ defined by an expression below may be determined with the use of the determined periodicity envelope sequence P[1], . . . ,P[N]. Here, h and PD may be predetermined values other than the values in the above example.

$$\hat{H}_M[k]=\hat{H}[k]\cdot(1+\delta\cdot P[k]) \quad \text{[Expression 32]}$$

As for δ, which is a value determining the mixing ratio between the spectral envelope $\hat{H}[n]$ and the periodicity envelope P[k], the value may be specified in advance in the encoding apparatus and the decoding apparatus, or it is also possible to generate a code indicating information about δ specified by the encoding apparatus and output the code to the decoding apparatus. In the latter case, the decoding apparatus determines δ by decoding the inputted code indicating the information about δ. By using the determined δ, the unsmoothed amplitude spectral envelope sequence generating portion 32 of the decoding apparatus can determine the same periodicity integrated envelope sequence as the periodicity integrated envelope sequence generated by the encoding apparatus.

When the spectral envelope estimating portion 2A, the encoding portion 2B, the frequency domain transforming portion 21 and the dividing portion 28 in FIG. 12 are grasped as one encoding portion 2C, this encoding portion 2C can be said to encode a time-series signal for each predetermined time section by an encoding process with a configuration identified at least based on the parameter η for each predetermined time section.

Further, when the acoustic feature amount extracting portion 521, the identifying portion 522 and the encoding portion 523 in FIG. 17 are grasped as one encoding portion 2D, this encoding portion 2D can be said to encode a time-series signal for each predetermined time section by an encoding process with a configuration identified at least based on the parameter η for each predetermined time section.

Thus, the encoding portion 2C and the encoding portion 2D can be thought to perform similar processes.

The processes described above are not only executed in order of description sequentially but also may be executed in parallel or individually according to processing capacity of an apparatus to execute the processes or as necessary.

Further, various processes in each method or each apparatus may be realized by a computer. In that case, content of the processes of each method or each apparatus is written by a program. Then, by executing this program on the computer, the various processes in each method or each apparatus are realized on the computer.

The program in which the content of the processes is written can be recorded in a computer-readable recording medium. As the computer readable recording medium, any recording medium, such as a magnetic recording device, an optical disk, a magneto-optical recording medium and a semiconductor memory, is possible.

Further, distribution of this program is performed, for example, by sales, transfer, lending and the like of a portable recording medium such as a DVD and a CD-ROM in which the program is recorded. Furthermore, this program may be distributed by storing the program in a storage apparatus of a server computer and transferring the program from the server computer to other computers via a network.

For example, a computer which executes such a program stores the program recorded in the portable recording medium or transferred from the server computer into its storage portion once. Then, at the time of executing a process, the computer reads the program stored in its storage portion and executes the process in accordance with the read program. Further, as another embodiment of this program, the computer may read the program directly from the portable recording medium and execute the process in accordance with the program. Furthermore, it is also possible for the computer to, each time the program is transferred from the server computer to the computer, execute a process in accordance with the received program one by one. Further, a configuration is also possible in which the processes described above are executed by a so-called ASP (Application Service Provider) type service for realizing a processing function only by an instruction to execute the program and acquisition of a result without transferring the program from the server computer to the computer. It is assumed that the program includes information which is provided for processing by an electronic calculator and is equivalent to a program (such as data which is not a direct instruction to a computer but has properties defining processing of the computer).

Further, though it is assumed that each apparatus is configured by executing a predetermined program on a computer, at least a part of content of processes of the apparatus may be realized by hardware.

What is claimed is:

1. An encoding apparatus for encoding an inputted time-series sound signal for each of predetermined time sections in a frequency domain, the encoding apparatus comprising:

a frequency domain transforming portion transforming the sound signal to a frequency domain sample sequence for each predetermined time section;

a spectral envelope sequence generating portion, in the same predetermined time section, for each of a plurality of candidates for η being a positive number, estimating a spectral envelope by regarding the η-th power of absolute values of the frequency domain sample sequence as a power spectrum, obtaining a linear prediction coefficient code indicating coefficients transformable to linear prediction coefficients, the coefficients corresponding to the spectral envelope, and outputting the linear prediction coefficient code;

an encoding portion obtaining a plurality of codes by performing an encoding process for the frequency domain sample sequence using each of the plurality of candidates for η in the same predetermined time section; and a parameter determining portion outputting any one code among the plurality of codes and a code indicating η corresponding to the any one code based on at least one of code amounts of the obtained codes and encoding distortions corresponding to the obtained codes in the same predetermined time section.

2. An encoding apparatus, for encoding an inputted time-series sound signal for each of predetermined time sections in a frequency domain, the encoding apparatus comprising:

a frequency domain transforming portion transforming the sound signal to a frequency domain sample sequence for each predetermined time section;

a spectral envelope sequence generating portion, in the same predetermined time section, for each of a plurality of candidates for η being a positive number, estimating a spectral envelope by regarding the η-th power of absolute values of the frequency domain sample sequence as a power spectrum, obtaining a linear prediction coefficient code indicating coefficients transformable to linear prediction coefficients, the coefficients corresponding to the spectral envelope, and outputting the linear prediction coefficient code;

the encoding portion obtaining estimated code amounts of a plurality of codes obtained by an encoding process for the frequency domain sample sequence using each of the plurality of candidates for η in the same predetermined time section; and a parameter determining portion selects any one η among the plurality of candidates for η based on the obtained estimated code amounts and outputs a code indicating the any one η in the same predetermined time section, wherein the encoding portion further encodes the frequency domain sample sequence using the selected η to obtain a code and output the code.

3. An encoding apparatus, for encoding an inputted time-series sound signal for each of predetermined time sections in a frequency domain, the encoding apparatus comprising:

a parameter determining portion selecting any one η among the plurality of candidates for η being a positive number and outputting a code indicating the any one η for each predetermined time section;

a frequency domain transforming portion transforming the sound signal to a frequency domain sample sequence in the same predetermined time section;

a spectral envelope sequence generating portion, in the same predetermined time section, for the selected one η, estimating a spectral envelope by regarding the η-th power of absolute values of the frequency domain sample sequence as a power spectrum, obtaining a linear prediction coefficient code indicating coefficients transformable to linear prediction coefficients, the coefficients corresponding to the spectral envelope, and outputting the linear prediction coefficient code; and the encoding portion obtaining and outputting a code by performing an encoding process for the frequency domain sample sequence using the selected one η in the same predetermined time section.

4. A decoding apparatus, comprising:

a parameter code decoding portion decoding the inputted parameter code to obtain η being a positive number for each predetermined time section;

a linear prediction coefficient decoding portion obtaining coefficients transformable to linear prediction coefficients by decoding inputted linear prediction coefficient codes in the same predetermined time section;

a spectral envelope sequence generating portion obtaining a spectral envelope sequence, which is a sequence obtained by raising a sequence of an amplitude spectral envelope corresponding to the coefficients transformable to the linear prediction coefficients to the power of 1/η, using the obtained η in the same predetermined time section;

a decoding portion decoding inputted codes to obtain a frequency domain sample sequence at least based on the obtained η in the same predetermined time section; and a time domain transforming portion transforming the frequency domain sample sequence into a time-series sound signal in the same predetermined time section.

5. The decoding apparatus according to claim 4, wherein the decoding portion obtains the frequency domain sample sequence by decoding inputted integer signal codes in accordance with such bit allocation that changes or substantially changes based on the spectral envelope sequence.

6. An encoding method for encoding an inputted time-series sound signal for each of predetermined time sections in a frequency domain, the encoding method comprising:

transforming the sound signal to a frequency domain sample sequence for each predetermined time section;

estimating a spectral envelope by regarding the η-th power of absolute values of the frequency domain sample sequence as a power spectrum;

obtaining a linear prediction coefficient code indicating coefficients transformable to linear prediction coefficients, the coefficients corresponding to the spectral envelope, and outputting the linear prediction coefficient code, in the same predetermined time section, for each of a plurality of candidates for η being a positive number;

obtaining a plurality of codes by performing an encoding process for the frequency domain sample sequence using each of the plurality of candidates for η in the same predetermined time section; and outputting any one code among the plurality of codes and a code indicating η corresponding to the any one code based on at least one of code amounts of the obtained codes and encoding distortions corresponding to the obtained codes in the same predetermined time section.

7. A decoding method, comprising:

decoding the inputted parameter code to obtain η being a positive number for each predetermined time section;

obtaining coefficients transformable to linear prediction coefficients by decoding inputted linear prediction coefficient codes in the same predetermined time section;

obtaining a spectral envelope sequence, which is a sequence obtained by raising a sequence of an amplitude spectral envelope corresponding to the coefficients transformable to the linear prediction coefficients to the power of 1/η, using the obtained η in the same predetermined time section;

decoding inputted codes to obtain a frequency domain sample sequence at least based on the obtained η in the same predetermined time section; and transforming the frequency domain sample sequence into a time-series sound signal in the same predetermined time section.

8. The decoding method according to claim 7, further comprising:

obtaining the frequency domain sample sequence by decoding inputted integer signal codes in accordance with such bit allocation that changes or substantially changes based on the spectral envelope sequence.

9. A non-transitory computer-readable recording medium in which a program for causing a computer to function as each portion of the encoding apparatus of any of claims 1, 2 and 3 is recorded.

10. A non-transitory computer-readable recording medium in which a program for causing a computer to function as each portion of the decoding apparatus of claim 4 is recorded.

11. An encoding method for encoding an inputted time-series sound signal for each of predetermined time sections in a frequency domain, the encoding method comprising:

transforming the sound signal to a frequency domain sample sequence for each predetermined time section;

estimating a spectral envelope by regarding the η-th power of absolute values of the frequency domain sample sequence as a power spectrum, obtaining a linear prediction coefficient code indicating coefficients transformable to linear prediction coefficients, the coefficients corresponding to the spectral envelope, and outputting the linear prediction coefficient code, in the same predetermined time section and for each of a plurality of candidates for η being a positive number;

obtaining estimated code amounts of a plurality of codes obtained by an encoding process for the frequency domain sample sequence using each of the plurality of candidates for η in the same predetermined time section;

selecting any one η among the plurality of candidates for η based on the obtained estimated code amounts and outputs a code indicating the any one η in the same predetermined time section; and encoding the frequency domain sample sequence using the selected η to obtain a code and output the code in the same predetermined time section.

12. An encoding method for encoding an inputted time-series sound signal for each of predetermined time sections in a frequency domain, the encoding method comprising:

selecting any one η among the plurality of candidates for η being a positive number and outputting a code indicating the airy one η for each predetermined time section;

transforming portion transforming the sound signal to a frequency domain sample sequence in the same predetermined time section;

estimating a spectral envelope by regarding the η-th power of absolute values of the frequency domain sample sequence as a power spectrum, obtaining a linear prediction coefficient code indicating coefficients transformable to linear prediction coefficients, the coefficients corresponding to the spectral envelope, and outputting the linear prediction coefficient code, in the same predetermined time section and for the selected one η; and obtaining and outputting a code by performing an encoding process for the frequency domain sample sequence using the selected one η in the same predetermined time section.

13. The encoding apparatus according to any of claims 1, 2 and 3, wherein the encoding portion encodes the frequency domain sample sequence to obtain and output codes by an encoding process in which bit allocation is changed or bit allocation substantially changes based on values of the estimated spectral envelope, for each of the predetermined time sections.

14. The encoding apparatus according to any of claims 1, 2 and 3, further comprising a dividing portion dividing the frequency domain sample sequence into a first frequency domain sample sequence constituted by samples corresponding to periodicity components of the frequency domain sample sequence and a second frequency domain sample sequence constituted by samples other than the samples corresponding to the periodicity components of the frequency domain sample sequence and outputting information indicating the samples corresponding to the periodicity components as auxiliary information, wherein the encoding apparatus performs the encoding process for each of the first frequency domain sample sequence and the second frequency domain sample sequence.

15. The encoding method according to any of claims 6, 11 and 12, wherein the encoding step encodes the frequency domain sample sequence to obtain and output codes by an encoding process in which bit allocation is changed or bit allocation substantially changes based on values of the estimated spectral envelope, for each of the predetermined time sections.

* * * * *